US008500612B2

(12) United States Patent
Koch et al.

(10) Patent No.: US 8,500,612 B2
(45) Date of Patent: Aug. 6, 2013

(54) EXERCISE APPARATUS

(75) Inventors: Kregg Alan Koch, Manhattan Beach, CA (US); Michael Shannon Kadar, Pittsburgh, PA (US)

(73) Assignee: Core Stix Fitness LLC, Manhattan Beach, CA (US)

( * ) Notice: Subject to any disclaimer, the term of this patent is extended or adjusted under 35 U.S.C. 154(b) by 0 days.

(21) Appl. No.: 13/018,307

(22) Filed: Jan. 31, 2011

(65) Prior Publication Data

US 2011/0275495 A1 Nov. 10, 2011

Related U.S. Application Data

(63) Continuation of application No. 12/249,884, filed on Oct. 10, 2008, now Pat. No. 7,878,956, and a continuation-in-part of application No. 11/533,766, filed on Sep. 21, 2006, now Pat. No. 7,704,199.

(60) Provisional application No. 60/979,768, filed on Oct. 12, 2007, provisional application No. 60/721,669, filed on Sep. 29, 2005.

(51) Int. Cl.
*A63B 21/04* (2006.01)
*A63B 21/02* (2006.01)

(52) U.S. Cl.
USPC ..... 482/129; 482/121; 482/130

(58) Field of Classification Search
USPC ..... 482/121, 122, 123, 124, 125, 126, 482/129, 130
See application file for complete search history.

(56) References Cited

U.S. PATENT DOCUMENTS

| | | | | |
|---|---|---|---|---|
| 972,284 | A * | 10/1910 | Storey | 482/129 |
| 3,345,067 | A | 10/1967 | Smith | |
| 3,567,219 | A | 3/1971 | Foster | |
| 3,587,319 | A | 6/1971 | Andrews | |
| 3,802,701 | A | 4/1974 | Good | |
| 3,807,727 | A | 4/1974 | Ferguson | |
| 4,063,727 | A * | 12/1977 | Hall | 482/130 |
| 4,332,399 | A | 6/1982 | Kepple | |
| 4,494,662 | A | 1/1985 | Clymer | |

(Continued)

FOREIGN PATENT DOCUMENTS

WO WO 82/00100 1/1982

OTHER PUBLICATIONS

U.S. Appl. No. 12/767,767, filed Apr. 26, 2010, published as 2010/0273615, including its ongoing prosecution history, including without limitation Office Actions, Amendments, Remarks, and any other potentially relevant documents.

(Continued)

*Primary Examiner* — Loan Thanh
*Assistant Examiner* — Sundhara Ganesan
(74) *Attorney, Agent, or Firm* — Knobbe, Martens, Olson & Bear LLP

(57) ABSTRACT

An exercise apparatus comprising a base that can be oriented at any angle and that defines a plurality of connection interfaces, each of which can be designed to support one end of a resilient member in a cantilevered disposition. The connection interfaces can be positioned at or adjusted to a widely varying range of locations and angular orientations with respect to the base. Each resilient members can be configured to support one or more removable stiffening members that provide a resistance force when a force is exerted thereon so as to bend the resilient member.

30 Claims, 39 Drawing Sheets

U.S. PATENT DOCUMENTS

| | | | | |
|---|---|---|---|---|
| 4,620,704 | A | 11/1986 | Shifferaw | |
| 4,625,963 | A | 12/1986 | Lancellotti | |
| 4,725,057 | A | 2/1988 | Shifferaw | |
| 4,822,039 | A * | 4/1989 | Gonzales et al. | 482/146 |
| 5,013,034 | A | 5/1991 | March et al. | |
| 5,064,190 | A | 11/1991 | Holt | |
| 5,123,886 | A | 6/1992 | Cook | |
| 5,403,256 | A | 4/1995 | Squires | |
| 5,522,783 | A | 6/1996 | Gordon | |
| 5,524,893 | A | 6/1996 | McGinnis et al. | |
| 5,755,649 | A | 5/1998 | Bimby | |
| 5,759,139 | A | 6/1998 | Wright | |
| 5,860,897 | A | 1/1999 | Gilbert et al. | |
| 5,913,754 | A | 6/1999 | Lochbaum | |
| 5,971,891 | A | 10/1999 | Humphrey | |
| 6,406,410 | B1 | 6/2002 | Lochbaum | |
| 6,676,579 | B1 | 1/2004 | Lin | |
| 6,872,174 | B2 * | 3/2005 | Benach | 482/121 |
| 6,964,636 | B2 | 11/2005 | Verheem et al. | |
| 7,041,041 | B1 | 5/2006 | Evans | |
| 7,309,303 | B1 | 12/2007 | Proctor | |
| 7,704,199 | B2 | 4/2010 | Koch et al. | |
| 7,878,956 | B2 | 2/2011 | Kadar et al. | |
| 2003/0186792 | A1 | 10/2003 | Keeler | |
| 2005/0233877 | A1 * | 10/2005 | Lin | 482/126 |

OTHER PUBLICATIONS

International Search Report and Written Opinion for International Application No. PCT/US2006/36639, date of mailing: Sep. 25, 2007, in 10 pages.

Supplementary European Search Report from the European Patent Office for Application No. 0680391438/ Publication No. 1928561, document mailed on Jan. 5, 2009 in 8 pages.

* cited by examiner 1156c
1154
1152
36A
1158
1154
1158
1154a
1152
1140
1154
1140
1154b
1156
1150
1150
1150c 1150c 1150
1150
1150
1150c
1150
1150c
1142
1144a 1144
1146c
1146
36B
1144b
1148
1142
1144
1142
1148

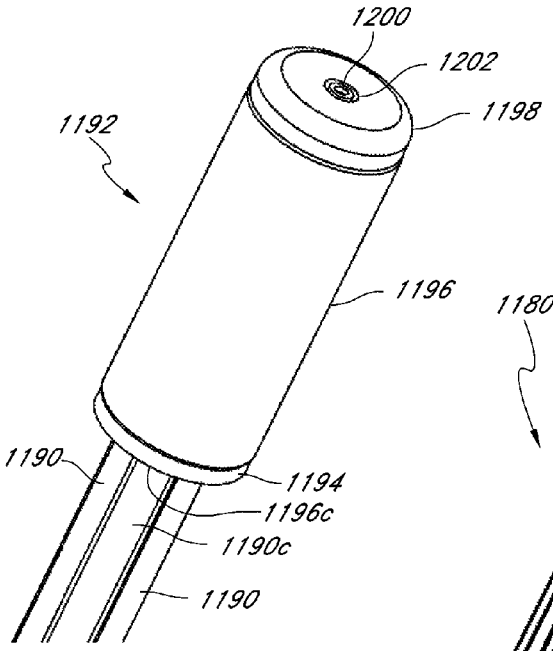
FIG. 39B
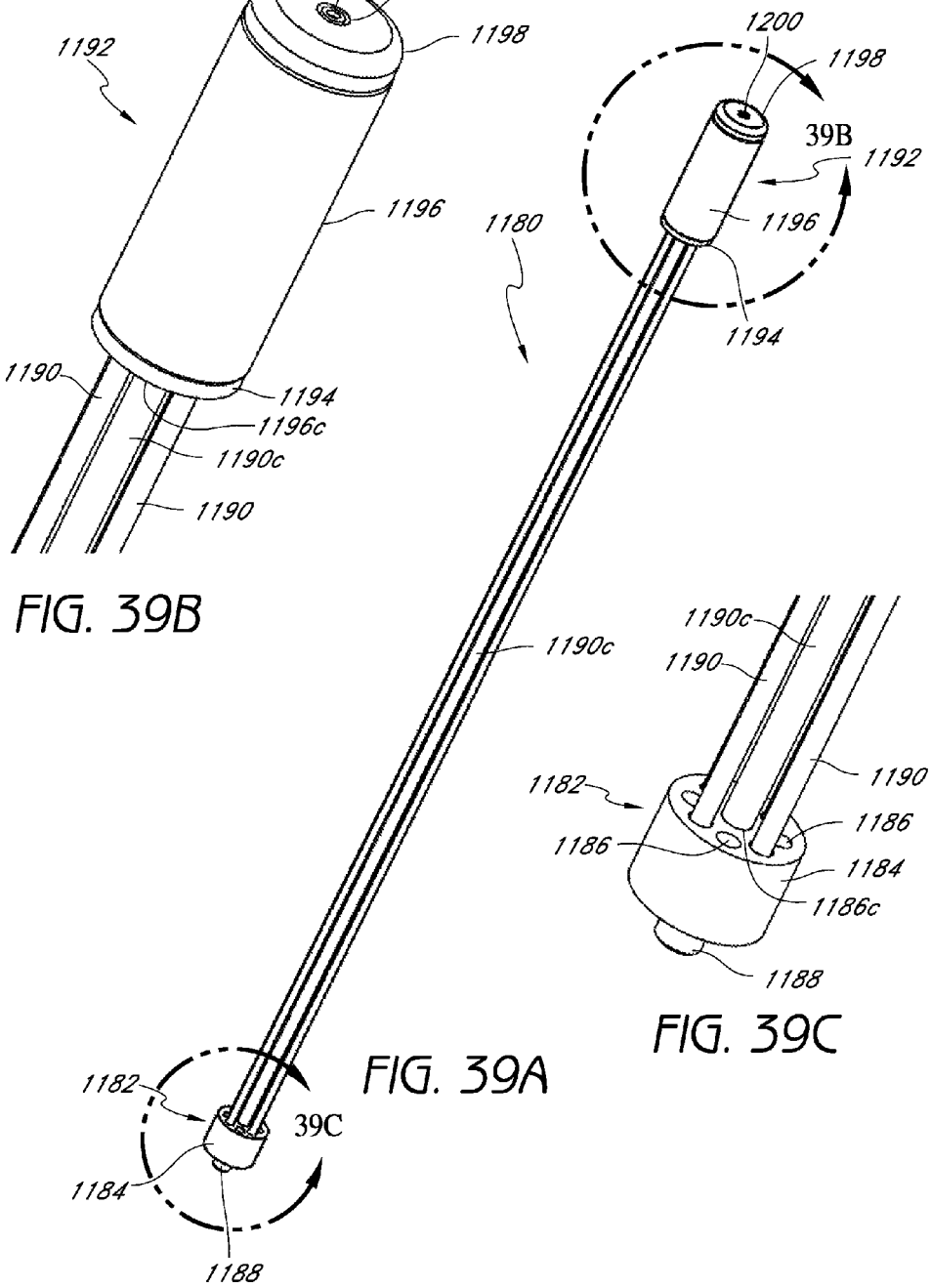
FIG. 39A
FIG. 39C 1296
1294

1296
49B
1298a
1298
1300
1300
1298b 1290
1298
49D 1294
1294
1300
1298
1294

49C
1292

EXERCISE APPARATUS

PRIORITY INFORMATION

This application is a continuation of U.S. patent application Ser. No. 12/249,884, filed Oct. 10, 2008, titled "Exercise Apparatus," now U.S. Pat. No. 7,878,956, which claims priority benefit of U.S. Provisional Application 60/979,768, filed Oct. 12, 2007, which is a continuation in part of U.S. patent application Ser. No. 11/533,766, filed Sep. 21, 2006, U.S. Pat. No. 7,704,199, issued Apr. 27, 2010, which claims priority to U.S. Provisional Application 60/721,669, filed Sep. 29, 2005. This application also claims priority benefit of U.S. Provisional Application 60/979,768, filed Oct. 12, 2007, under the appropriate legal basis including, without limitation, under 35 U.S.C. §119(e). Each of the above-listed applications and/or patents is hereby incorporated by reference as if fully set forth herein.

BACKGROUND OF THE INVENTION

1. Technical Field

This disclosure relates to the field of exercise equipment utilizing deflectable resilient members.

2. Description of the Related Art

Without limitations, in general, the exercise apparatus or device of this disclosure relates to the use of deflectable resilient members for exercising the muscles of one's body. There are presently several known types of exercise machines and devices available on the market utilizing resilient members to provide resistance training. One such device, the Isotonic-Isometric Device for Exercise and Physical Therapy, comprises a single elongated exercise rod attached to a socket that is mounted to a metal base. Different forms of the mounting apparatus permit the metal base supporting the single resistance rod to be mounted to a floor, a desk, a table, a cabinet, a wall, a door, or a door frame. These various mounting applications are achieved by the use of a vacuum cup for surface mounting, a clamp for table or desk edge mounting, or a special mounting assembly for doorway mounting.

The Isotonic-Isometric Device for Exercise and Physical Therapy is limited to a single resistance rod and is not self-contained in that the utilization of this device depends upon the availability of a suitable mounting surface or object. Additionally, the amount of resistance that can be achieved by the Isotonic-Isometric Device for Exercise and Physical Therapy appears to be directly dependant on the robustness of the mounting apparatus and the surface or object that this device is mounted to. Furthermore, a device of this type cannot be easily configured to modify the orientation of the resistance member. It requires the user to disconnect the base from the surface or object that it is mounted to and remount the base to another surface or object that can provide for the desired orientation, if such a surface or object is available.

Another device that utilizes resilient members to provide resistance training, albeit through a cable pulley system, is the Universal Exercising Machine. This device is comprised of many components that, in essence, include a collapsible rigid frame, a plurality of cantilevered resilient members, two cables connecting a user selected handle attachment to the cantilevered resilient members, and a sliding bench. The cables are necessary components to operate this device. To utilize this device, the user grips the chosen handle attachment and exerts a force on the cables causing the cantilevered resistance members to bend. Thus, resistance is generated by the cantilevered, resilient rods when the cables are pulled by the user. Because the cables cannot withstand compressive forces, the resistance force generated by the cantilevered resistance members can only be generated uni-directionally. Further, the overall size, complexity, and number of components comprising this device makes it large, expensive, difficult to manufacture and more difficult to assemble.

SUMMARY OF SOME EMBODIMENTS

The exercise apparatus of the present invention is not limited to the following description. The following is meant merely as a brief summary of the general features of the exercise apparatus of the present invention. A more complete written description is listed below. The exercise apparatus of the present invention comprises a base member that can be free standing or mounted to any horizontal, vertical, or angled surface. Resilient members, such as rods of plastic, can be removably or permanently mounted in a cantilevered fashion to the base member at any of a wide range of locations or angular orientations, so that one end of the resilient member is fixed to the base member and the other end of the resilient member is unrestrained. The user can perform a wide range of strength and physical therapy exercises for many if not all of the various muscle groups of the body by grasping the somewhat stiff resilient members in his or her hands and exerting a force on the unrestrained portion of the resilient member in any direction that is generally transverse to the longitudinal centerline of the resilient member, causing the resilient member to bend in flexure. The resilient members are preferably designed to enable multi-directional resistance and can be used independently or simultaneously, permitting the user to exercise multiple different muscles simultaneously. The apparatus is preferably designed so that it can support the user in a free standing, kneeling, or sitting position, or any other position that will maximize core strength training in a manner not generally feasible with conventional devices comprising flat benches, walls, or other similar stabilizing structures. Further, the exercise apparatus of the present invention can be readily configured for home use with little instruction to enable the user to exercise and strengthen virtually every muscle group and/or joint of the body and at any widely variable level of resistance by changing the orientation, location, and/or stiffness of the resilient members.

Other objects and features of the present invention will become apparent from the following detailed description taken in connection with the accompanying drawings. It is to be understood, however, that the drawings are designed for the purpose of illustration only and are not intended as a definition of the limits of the invention.

Certain embodiments described herein are directed to exercise devices and resilient members for exercising the muscles of one's body. However, it will be appreciated that the exercise devices and resilient members may have application to other fields. In some embodiments, a resilient member for fitness related exercise can be provided that can comprise one or more stiffening members (which can be axially resilient or axially rigid but bendable), a first member, and a second member. As used in this document, any reference to "some embodiments" or to any embodiment or component disclosed "herein" is meant to refer to any embodiments or components set forth explicitly or implicitly herein, and/or any embodiments or components incorporated by reference herein. In some embodiments, the first member can be positioned at a first portion of the resilient member and configured to be supported by a base member, the first member further being configured to support a first portion of the one or more stiffening members such that the one or more stiffening members extend therefrom in a cantilevered disposition. Further, in some embodiments, the second member can be spaced apart from the first member and configured to interact with a second portion of the one or more stiffening members such that, when a user exerts a force on the second member, at least the second portion of each of the one or more stiffening members deflects and a resistance can be provided.

In some embodiments, a resilient member for fitness related exercise can be provided that can comprise a first member configured to be supported by a base member and comprising a plurality of axial openings, a second member spaced apart from the first member and comprising a plurality of axial openings, and one or more stiffening members, wherein the first portion of the one or more stiffening members can be positioned in one or more of the plurality of axial openings in the first member such that the one or more stiffening members extend therefrom in a cantilevered disposition. Further, in some embodiments, the second portion of the one or more stiffening members can be positioned in one or more of the plurality of axial openings in the second member such that, when a user exerts a force on the second member, at least the second portion of each of the one or more stiffening members deflects and a resistance force can be provided.

In some embodiments, a resilient member for fitness related exercise is provided comprising a stiffening member defining a first portion and a second portion, a first member configured to be secured to a base member, comprising a first axial opening positioned near the axial center of the first member and plurality of additional axial openings being spaced apart from the first axial opening of the first member, a second member comprising a first axial opening positioned near the axial center of the second member and plurality of additional axial openings being spaced apart from the first axial opening of the second member, wherein the first portion of the stiffening member can be supported by the first axial opening of the first member so as to extend therefrom in a cantilevered disposition, the second portion of the stiffening member can be positioned in the first axial opening of the second member such that, when a user exerts a force on the second member, at least the second portion of the stiffening member deflects and a resistance force can be provided.

In some embodiments, a resilient member for fitness related exercise can be provided comprising a first stiffening member comprising a first portion and a second portion, a first member positioned at a first portion of the resilient member and configured to be supported by a base member, and a second member, wherein the first member can be further configured to support at least the first portion of the first stiffening member such that the first stiffening member extends therefrom in a cantilevered disposition, the second member can be configured to interact with the second portion of the first stiffening member such that, when a user exerts a force on the second member, at least a second portion of the first resilient member deflects and a resistance force can be provided.

In some embodiments, a resilient member for fitness related exercise is provided comprising one or more stiffening members, each having a first end portion and a second end portion, a first member positioned at a first portion of the resilient member and configured to be secured to a base member and to support the one or more stiffening members, and a second member configured to support the second end portion of each the one or more stiffening members such that, when a lateral force can be exerted on the second member, the second end portion of each of the one or more stiffening members deflects.

In some embodiments, a method of exercising the muscles of one's body is provided, comprising providing a resilient member, supporting the resilient member in a cantilevered disposition so that the first portion of the resilient member can be substantially prevented from pivoting relative to the exercise device base member, exerting a force on the resilient member so as to deflect at least a portion of the resilient member and effect an exercising of one or more muscles in the user's body, and varying the resistance force provided by the resilient member by adding or removing at least one additional stiffening member to the resilient member, wherein each of the at least one additional stiffening members supported by the resilient member can be supported by the resilient member such that at least a first portion of the at least one additional stiffening member extends from the first member in a cantilevered disposition. In some embodiments, the resilient member can comprise at least one stiffening member, a first member positioned at a first portion of the resilient member and configured to be supported by a base member in a cantilevered disposition so that the first portion of the resilient member can be substantially prevented from pivoting relative to the exercise device base member, the first member further configured to support a first portion of the at least one stiffening member such that the at least one stiffening member extend therefrom in a cantilevered disposition, and a second member configured to at least radially support at least a second portion of the at least one stiffening member such that, when a user exerts a force on the second member, at least the second portion of each of the at least one stiffening member deflects from the longitudinal axis of the relaxed position of each of the at least one stiffening member and a resistance is provided. In some embodiments, the resilient member can comprise at least one stiffening member that can be at least axially supported by the first and second members.

In some embodiments, a device for exercising the muscles in one's body is provided that can comprise a base and a resilient member, wherein the base can be configured to provide one or more removable supports for an end portion of the resilient member such that the resilient member extends therefrom in a cantilevered disposition, and the resilient member comprises one or more stiffening members that can be, but are not required to be axially rigid (as with any embodiments described herein), a first member positioned at a first portion of the resilient member and configured to be supported by the base member and to provide a support for the one or more stiffening members such that the one or more stiffening members extend therefrom in a cantilevered disposition, and a second member supported by at least one of the one or more stiffening members and configured such that, when a user exerts a force on the second member, at least a portion of each of the one or more stiffening members deflects and a resistance force can be provided.

BRIEF DESCRIPTION OF THE DRAWINGS

These and other features, aspects and advantages of this disclosure will now be described in connection with some embodiments of the present disclosure, in reference to the accompanying drawings. The illustrated embodiments, however, are merely examples and are not intended to limit the present disclosure. The following are brief descriptions of the drawings.

FIG. 39A is a perspective view of an embodiment of a resilient member.

FIG. 39B is an enlarged perspective view of a portion of the embodiment of the resilient member illustrated in FIG. 39A defined by curve 39B in FIG. 39A.

FIG. 39C is an enlarged perspective view of a portion of the embodiment of the resilient member illustrated in FIG. 39A defined by curve 39C in FIG. 39A.

DETAILED DESCRIPTION OF SOME EMBODIMENTS

An exercise apparatus of the present invention comprising one or more resilient members for exercising is described herein. In the following description, numerous specific details are set forth by way of exemplary embodiments in order to provide a more thorough description of the present invention. It will be apparent, however, to one skilled in the art that the present invention may be practiced without these specific details. Unless specifically noted, it is intended that the words and phrases in the specification and claims be given the ordinary and accustomed meaning as understood by those of ordinary skill in the applicable art or arts. If any other meaning is intended, that special meaning will be disclosed herein. Furthermore, the scope of the present invention is not limited by the specific details of the embodiments described below. As an example, the number, location, and orientation of the connection interfaces 56 of each of the embodiment of the exercise apparatus of the present invention are not limited to the number, location, and orientation of the connection interfaces 56 illustrated herein.

Figure 1:
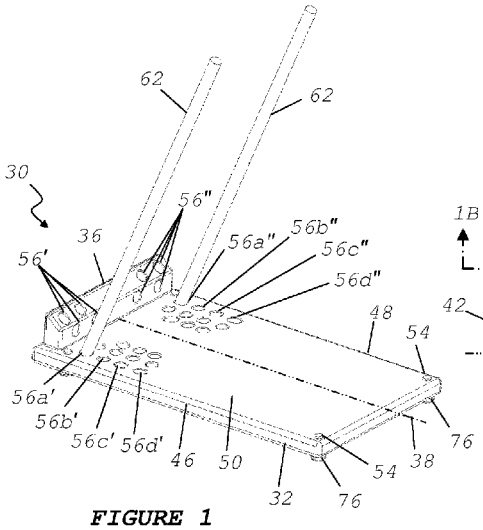
FIG. 1 is a perspective view of an embodiment of the exercise apparatus of the present invention.
Figure 1A:
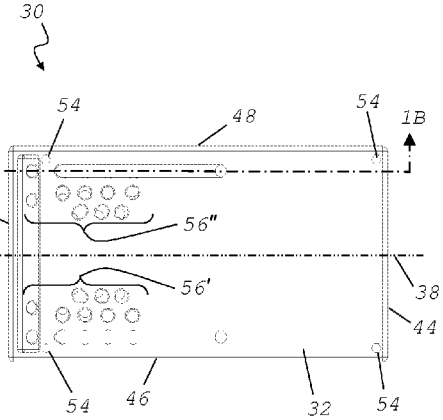
FIG. 1*a* is an aerial view of the embodiment of the exercise apparatus of the present invention illustrated in FIG. 1.
Figure 1B:
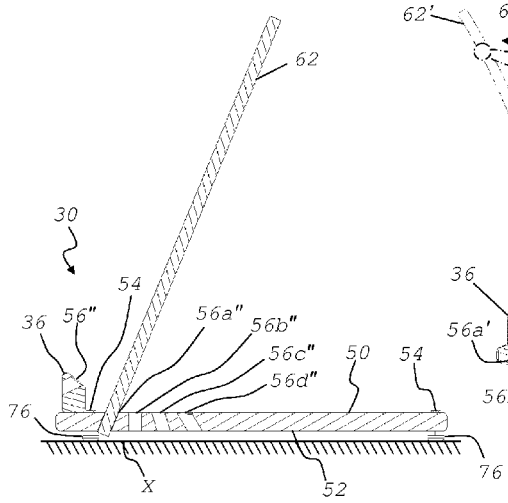
FIG. 1*b* is a sectional view of the embodiment of the exercise apparatus of the present invention illustrated in FIGS. 1 and 1*a* taken along line 1*b*-1*b* in FIG. 1*a*.
Figure 2:
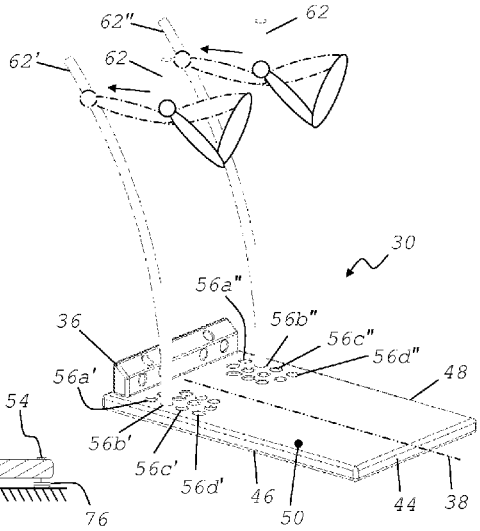
FIGS. 2 through 10 illustrate various applications of the exercise apparatus of the present invention.

Referring now in detail to the drawings, the embodiment of the exercise apparatus of the present invention illustrated in each of the FIGS. 1, 1*a*, and 1*b* comprises a base 30 and a pair of resilient members 62. The base 30 illustrated in FIGS. 1, 1*a*, and 1*b* is free standing, horizontally oriented, and is resting on ground surface X. Other embodiments of the base can be oriented horizontally, vertically, or at any other angle, and can either free standing or can be fixed to a supporting surface. The base 30 illustrated in FIGS. 1, 1*a*, and 1*b* is preferably designed to support the user of the exercise apparatus in a standing, kneeling, sitting or other position and carries one end of the resilient members 62. The base 30 can be formed in a wide variety of configurations. In the embodiments illustrated in FIGS. 1, 1*a*, and 1*b*, base 30 also comprises protruding base portion 36, back surface 42, front surface 44, left surface 46, right surface 48, primary surface 50, a plurality of left side connection interfaces 56' located between centerline 38 and left surface 46, and a plurality of right side connection interfaces 56" located between centerline 38 and right surface 48. The embodiment of each connection interface of the present invention is preferably configured to provide a removable securement for an end portion of a resilient member such that the resilient member extends therefrom in a cantilevered disposition and can be formed of a channel either partially or fully protruding through the base. The connection interfaces 56 illustrated in FIG. 1 preferably define an inner surface having substantially the same geometrical configuration as the outer surface of the portion of the resilient member 62 (i.e., either the fixed end of the resilient member 62' or the insert 64) that is in communication with the connection interface 56. The left and right side connection interfaces 56' and 56" are preferably positioned on the base 30 at a wide-ranging variety of locations and angular orientations relative to the base. In the embodiments of the exercise apparatus illustrated in FIGS. 1-10, left side connection interfaces 56' are located and oriented symmetrically with respect to right side connection interfaces 56" about centerline 38 so that the user can simultaneously perform identical exercise motions on the left and right side of the users body, as illustrated in FIG. 2. However, the exercise apparatus of the present invention is not so limited. The exercise apparatus of the present invention permits a widely variable number of locations and orientations of the connection interfaces 56 relative to the user beyond those illustrated in FIG. 1 or any other figure herein, and while the symmetry of the left side connection interfaces 56' with respect to the right side connection interfaces 56" is preferable, it is not required.

Resilient members 62 are preferably formed from a rod of resilient plastic and can be removably or permanently attached to any connection interface 56 such as any of the left side connection interfaces 56', the right side connection interfaces 56" illustrated in FIGS. 1-10, and/or in any other connection interface 56 illustrated in any of the embodiments described herein or within the scope of the present invention. For many exercises, the user would prefer only one or two resilient members 62 to be simultaneously attached to the connection interfaces 56. The connection interfaces 56 effectively restrain one end of the resilient member 62 in a cantilevered fashion so that the user can perform exercises by grasping the unrestrained portion of the resilient members 62 in his or her hands and exerting a generally transverse force on the unrestrained portion of the resilient member, causing the resilient member to bend in flexure. The stiffness of the resilient member provides the resistance needed for performing the desired exercises. The resilient members preferably permit multi-directional resistance and can preferably be used independently or simultaneously, permitting the user to perform multiple different exercises simultaneously.

Figure 12:
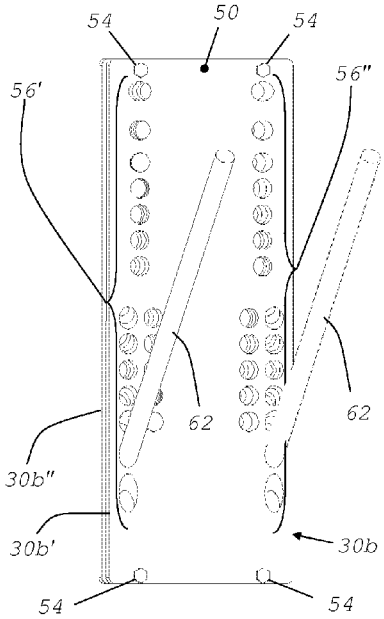
FIG. 12 is a perspective view of an embodiment of the exercise apparatus of the present invention.
Figure 13:
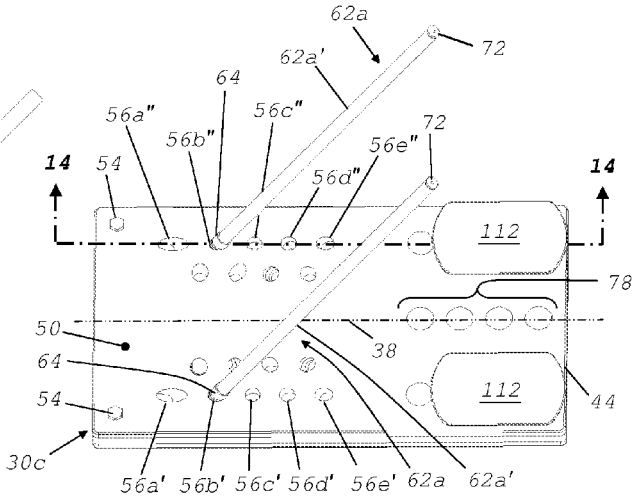
FIG. 13 is a perspective view of an embodiment of the exercise apparatus of the present invention.
Figure 14:
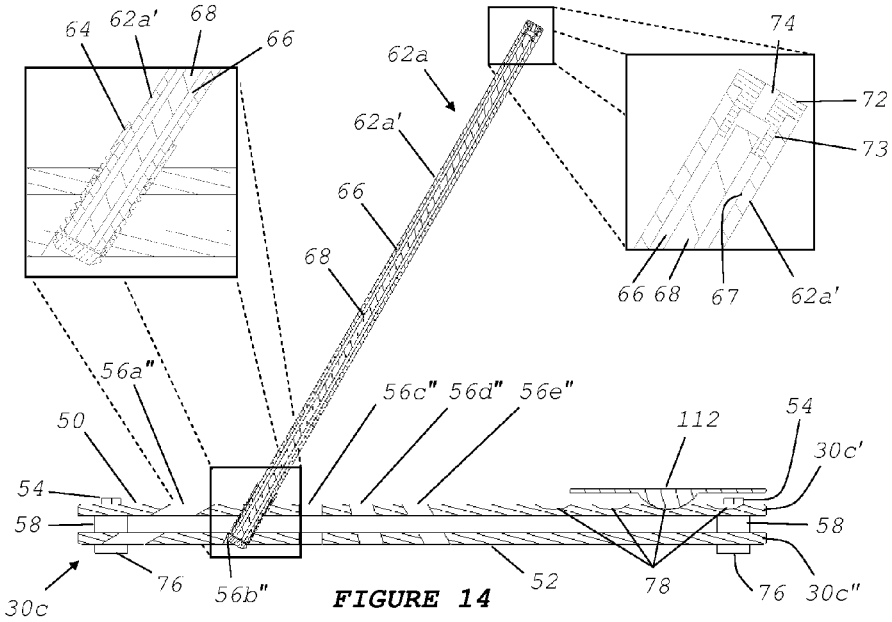
FIG. 14 is a sectional view of the embodiment of the exercise apparatus of the present invention illustrated in FIG. 13 along line 14-14.

The protruding base portion 36 preferably comprises additional connection interfaces 56 at a wide range of locations and angular orientations relative to the user. The protruding base portion 36 can be formed in a wide variety of configurations and can be bolted, screwed, hinged, welded, glued, or otherwise permanently or removably fastened to the base using any suitable or similar means of attachment. When the base is generally horizontally oriented, such as when resting on a ground surface, the base 30 can preferably support the weight of the user of the device positioned in a two leg stance, one leg stance, kneeling, sitting, or in any similar or desired exercise position on the primary surface 50. Further, a wobble board 112 of the kind found in the prior art, as illustrated in FIGS. 13 and 14, or a balance platform, or any other similar rehabilitation, exercise, or balance training devices, can also be used with the present invention to increase the difficulty and, hence, the benefit of using the exercise apparatus of the present invention. The base 30 and protruding base portion 36 can be manufactured from any generally stiff material, including wood, plastic, fiber reinforced plastic, metal, or any composite thereof. In the embodiments disclosed herein, the perimeter of the base 30 can be any geometry such as a square, rectangle, circle, oval, or any other desired shape. The embodiments of the base 30 designed for horizontal orientation preferably have a width of approximately twenty-four inches to approximately thirty-six inches and a length of approximately forty-eight inches. The embodiments of the base 30 designed for vertical orientation, as illustrated in FIG. 12, preferably have a width of approximately three inches to approximately thirty-six inches and a height preferably in the range of approximately twelve inches to approximately seventy-two inches. However, the dimensions of the base 30 are not so confined. The base can formed in a wide variety of configurations and dimensions beyond those illustrated and described herein. Additionally, stiffening members, "I" beams, or other structural members manufactured from any generally stiff material, including plastic, fiber reinforced or otherwise, metal, or any composite thereof, can be attached to base 30 to increase the rigidity of the base. Such stiffener panels, "I" beams, or other structural members would be preferably attached to the bottom surface 52 of the base 30. The base 30 can comprise base pads 76 attached to the base using bolts 54, which can serve multiple functions. First, the length of the base pads 76 can be adjusted so as to level the base on uneven surfaces. Additionally, as illustrated most clearly in FIGS. 1*b* and 12*a*, base pads 76 provide space between the bottom base surface 52 and the ground X or wall W so that the resilient members 62 can be fully engaged in the connection interfaces 56 without interference with the ground surface or wall.

Figure 19:
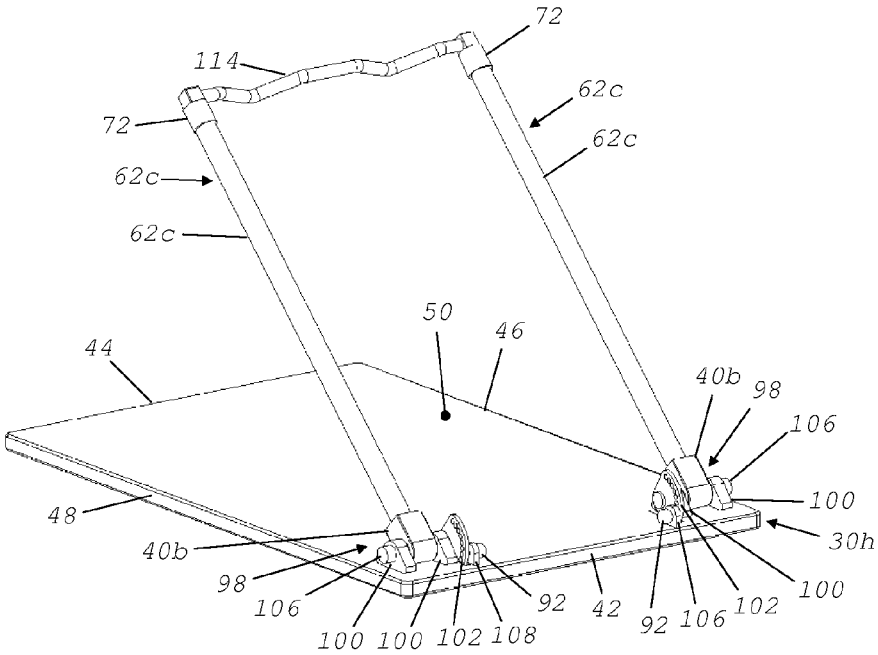
FIG. 19 is a perspective view of an embodiment of the exercise apparatus of the present invention.

The operation of the present invention will be described with reference to FIGS. 2-10 and examples of different exercises that can be performed using the exercise apparatus of the present invention. Each of these exercises has a primary benefit to particular muscle groups of the user's body, which are identified in the descriptions below. The following descriptions are not, however, exhaustive of the capabilities of the exercise apparatus of the present invention but merely disclose some of these capabilities so that the reader better understands some modes of operation of the exercise apparatus of the present invention. FIGS. 2-10 contain schematic illustrations of the user's upper forearms and upper arms (each represented by ovals), hands (represented by circles), lower and upper legs (represented by ovals), or feet (represented by rectangles), as well as other parts of the body necessary for understanding. Solid lines are used to represent the initial position of the user's body parts and resilient members 62. Dashed lines are used to represent the positions of the body parts and resilient members 62' and 62" after force has been applied to the resilient members 62 for the particular exercise described. A wide-ranging variety of exercises can be performed on the exercise apparatus of the present invention by varying the location, orientation, and posture of the user relative to the base 30, by varying the location and orientation of the resilient members 62 relative to the user, by varying the level of resistance of the resilient members 62, or by using different handles as illustrated in FIG. 19.

FIG. 2 illustrates the use of the exercise apparatus of the present invention for exercising mostly the chest, shoulders, and arms. In FIG. 2, the user stands upright on primary surface 50 at the lateral center of the base 30 facing two resilient members 62 that are attached to connection interfaces 56*b*' and 56*b*" spaced approximately the user's shoulder width apart. For this exercise, the user stands close to and grips the resilient members 62 with bent arms, and simultaneously pushes each of the resilient members 62 away from the user's body to resilient member positions 62' and 62", and then returns the resilient members 62 to their initial position. This exercise is known as the chest press. Other exercises can be performed by inserting resilient members 62 into connection interface 56*a*', 56*b*', 56*c*', or 56*d*', and 56*a*", 56*b*", 56*c*", or 56*d*", each of which has a different angular orientation. As discussed, each connection interface is designed to restrain one end of the resilient member 62. Thus, varying the angular orientation of the connection interfaces 56 varies the angular orientation of the resilient members relative to the user such that the user can perform different exercises by attaching the resilient member to a different connection interface.

Figure 3:
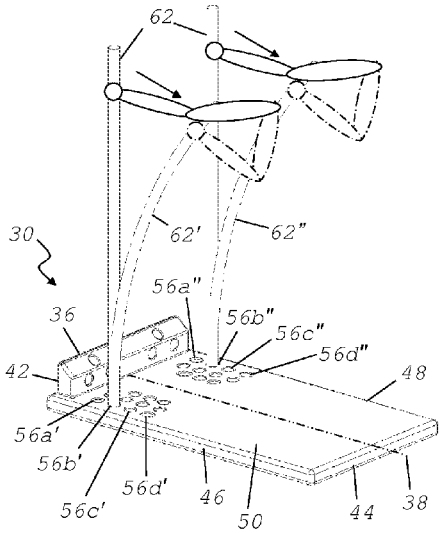

FIG. 3 illustrates the use of the exercise apparatus of the present invention for exercising mostly the upper and mid back, shoulders, and arms. In FIG. 3, the user stands upright on primary surface 50 at the lateral center of the base 30 at approximately an arm's length distance from the two vertically oriented resilient members 62 again inserted into connection interfaces 56*b*' and 56*b*". Grasping the resilient members 62 directly with his or her hands, the user simultaneously pulls the resilient members 62 toward the user's body to resilient member positions 62' and 62", and then returns the resilient members 62 to their initial position.

Figure 4:
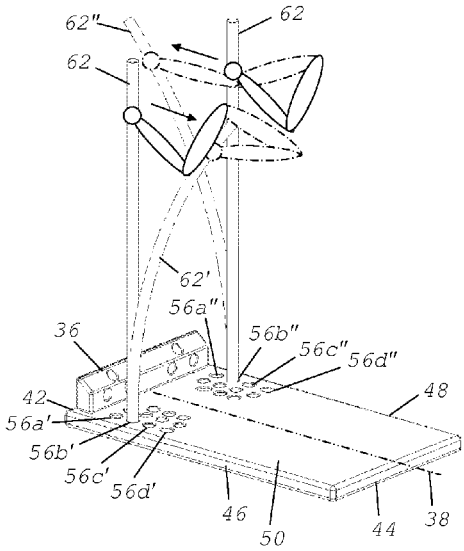

The exercise illustrated in FIG. 4 is a combination of the exercises performed in FIGS. 2 and 3. For this exercise, the user stands upright on primary surface 50 at the lateral center of the base 30 with arms slightly bent in front of the user's body, grasping the resilient members 62 again inserted into connection interfaces 56*b*' and 56*b*" The user first pushes the resilient member 62 located in connection interface 56*b*", bending the resilient member 62 to position 62". This mostly exercises the right side of the user's chest, shoulders, and arms. The user simultaneously pulls the resilient member 62 located in connection interface 56*b*', bending the resilient member 62 to position 62'. This mostly exercises the left side of the user's upper and mid back, shoulders, and arms. The user then returns both resilient members 62 to the original position and then alternates the forces applied to each resilient member 62 such that the user applies a pulling force to the resilient member 62 located in connection interface 56*b*" and a pushing force to the resilient member 62 located in connection interface 56*b*' and then, again, returning both resilient members 62 to their initial position. By alternating, the user is able to simultaneously exercise back, shoulder, arm, and chest muscles.

Figure 5:
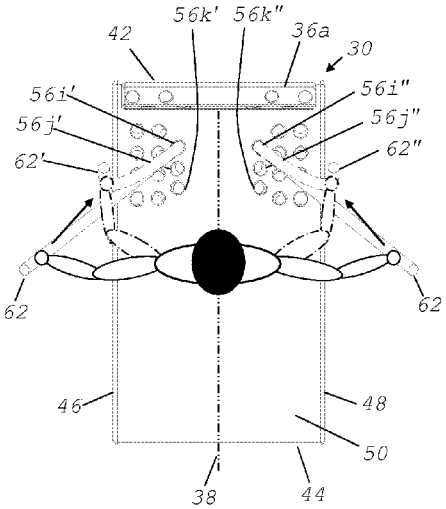

FIG. 5 illustrates the use of the exercise apparatus of the present invention for upper body conditioning exercise mostly for the chest, anterior shoulder, and arms. For this exercise, the user stands on primary surface 50 in an upright position at the lateral center of the base 30 facing two resilient members 62 that are inserted into connection interfaces 56*i*' and 56*i*", which are spaced laterally narrower that the user's shoulder width and angled back toward but laterally away from the user's body. For this exercise, the user extends his or her arms laterally so that his or her hands are approximately shoulder height with arms slightly bent, grasps the resilient members 62 directly with his or her hands, simultaneously pushes the resilient members 62 forward toward resilient member positions 62' and 62", and then returns the resilient members 62 to the initial position. The user can alter the motion of this exercise by inserting resilient members 62 into any of the other connection interfaces 56*i*', 56*j*', or 56*k*', and 56*i*", 56*j*", or 56*k*", each of which hosts a different angular orientation relative to the user.

Figure 6:
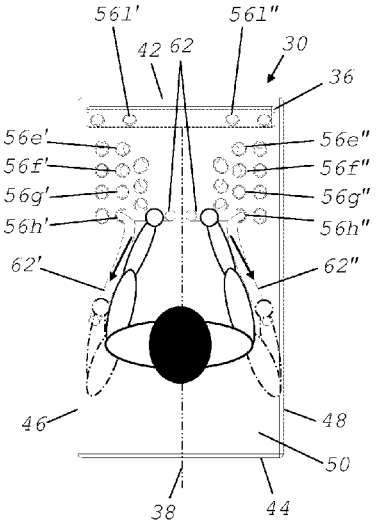

FIG. 6 illustrates the use of the exercise apparatus of the present invention for upper body conditioning exercise mostly for the upper and mid back, shoulders, and arms. For this exercise, the resilient members 62 are inserted in connection interfaces 56*h*' and 56*h*", which are both oriented such that the tops of each of the resilient members 62 are angled toward the base centerline 38. The user begins the exercise with each of his or her hands in a closer proximity to one another and pulls each of the resilient members 62 at a slightly outward angle relative to base centerline 38, forcing the resilient members 62 to bend to resilient member positions 62' and 62", and then returns the resilient members 62 to their initial position.

Figure 7:
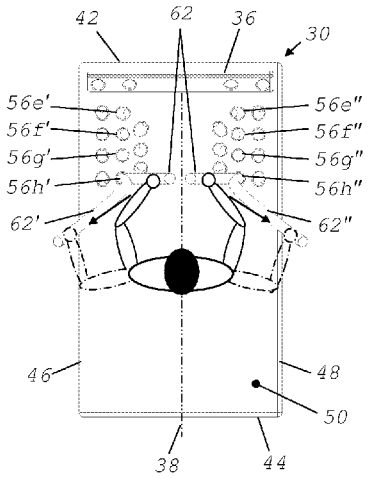

FIG. 7 illustrates the use of the exercise apparatus of the present invention for upper body conditioning exercise mostly for the upper back, shoulders, and arms. The user stands on primary surface 50 in an upright position at the lateral center of the base 30 with arms extending in front of the user's body but slightly bent, elbows in line with the user's shoulder and hand, facing resilient members 62 inserted in connection interfaces 56*h*' and 56*h*". Grasping the resilient members 62, the user simultaneously pulls each of the resilient members 62 away from base centerline 38 and away from back surface 42 in a controlled movement to resilient member positions 62' and 62", and then returns the resilient members 62 to their initial position.

Figure 8:
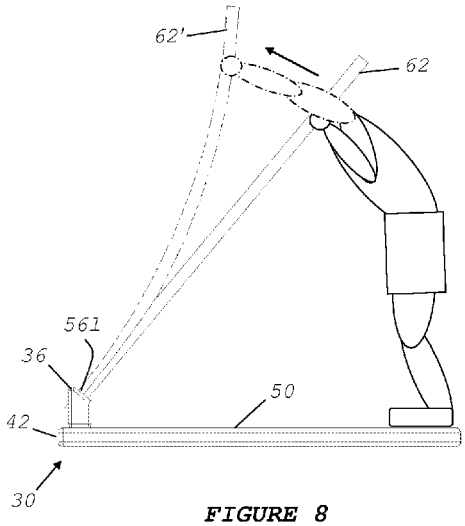

FIG. 8 illustrates the use of the exercise apparatus of the present invention for upper body conditioning mostly for the upper shoulders and arms. For this exercise, the user stands on primary surface 50 at the lateral center of the base 30 with knees slightly bent and waist slightly bent so that his or her upper body is angled forward, gripping resilient members 62, inserted in connection interfaces 561, just above the user's shoulders. The user simultaneously pushes each of the resilient members 62 up and away from the user's shoulders to resilient member position 62' and then returns the resilient members to the initial position.

Figure 9:
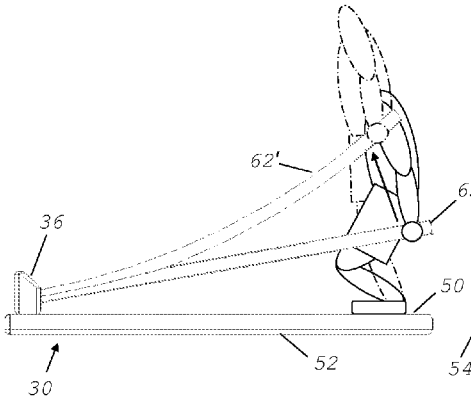

FIG. 9 illustrates the use of the exercise apparatus of the present invention for upper body conditioning exercise mostly for the upper and lower legs, upper cervical musculature, upper trapezius shoulders, and lower back. This exercise is known as a squat shrug. For this exercise, the user stands on primary surface 50 at the lateral center of the base 30 facing protruding base portion 36, with knees bent, upper body mostly upright, and with arms straight down at the user's sides, gripping both resilient members 62 just below the user's knees. Using mainly leg and trapezius muscles, the user thrusts upward straightening his or her knees to a standing position while simultaneously shrugging his or her shoulders upward to resilient member positions 62' and then returns the resilient members 62 to their initial position.

Figure 10:
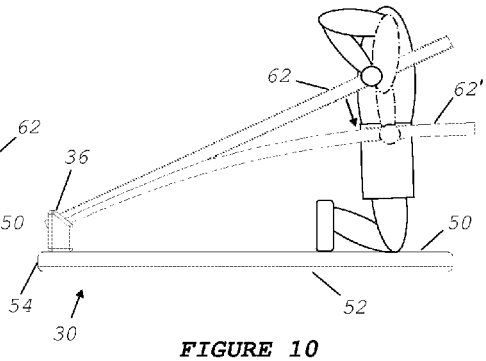

FIG. 10 illustrates the use of the exercise apparatus of the present invention mainly for exercising the user's arms. For this exercise, the user kneels on primary surface 50 with back and knees bent facing away from protruding base portion 36, with arms by his or her side and bent at the elbows, gripping resilient members 62 inserted in connection interfaces 56*o*' and 56*o*". The user either simultaneously or independently pushes each of the resilient members 62 down toward primary surface 50 to resilient member positions 62' using mainly only his or her arms, and then returns the resilient members 62 to their initial position.

Figure 11:
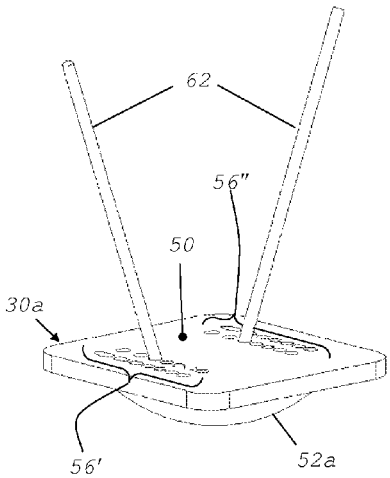
FIG. 11 is a perspective view of an embodiment of the exercise apparatus of the present invention.

The embodiment of the exercise apparatus of the present invention illustrated in FIG. 11 comprises base 30*a*, which is generally horizontally oriented and has a non-flat bottom surface 52*a*, and resilient members 62 inserted in connection interfaces 56. Base 30*a* is wide enough for the user to stand with his or her feet approximately a shoulder distance apart and comprises a plurality of connection interfaces 56 at a wide ranging variety of locations and angular orientations. Portions of the base 30*a* can be made from a material such as metal, plastic, or any other sufficiently rigid material, while other portions such the bottom surface 52*a* can optionally be made from a pliable material such as rubber or a soft plastic. Having a non-flat bottom surface increases the difficulty and, hence, improves the conditioning benefit to the user by requiring the user to maintain his or her balance while exercising.

Figure 12A:
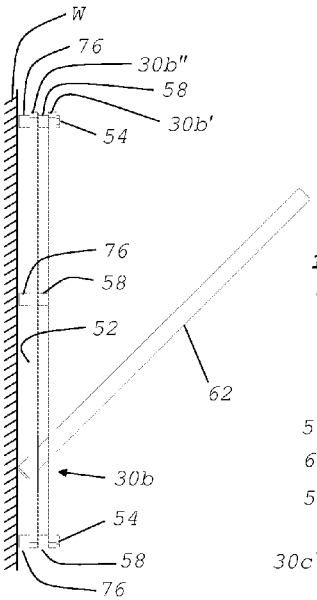
FIG. 12*a* is a side view of the embodiment of the exercise apparatus of the present invention illustrated in FIG. 12.

The embodiment of the exercise apparatus of the present invention illustrated in FIGS. 12 and 12*a* comprise a two layer base defining an upper base portion 30*b'* and lower base portion 30*b"* spaced apart by base member spacers 58 and affixed together using base bolt 54, and a plurality of connection interfaces 56 at a wide range of locations and angular orientations. Base 30 is generally vertically oriented and attached to a vertical wall surface W using bolts 54, but can be attached to the wall surface, or any other surface, using bolts, screws, adhesive, welds, or any other similar or suitable attachment means. Base pads 76 preferably provide enough space between the bottom surface 52 and the vertical wall surface W to enable the resilient members 62 to fully engage in the connection interfaces to prevent their inadvertent removal without interference with the wall surface. For this embodiment, the user performs many of his or her desired exercises while standing on the ground, either facing toward or away from primary surface 50. Base pads 76 are preferably attached to bottom surface 52 of this or any other base illustrated or described herein using screws, bolts, adhesive, welds, or any other suitable attachment means to enable the user to level the base and to provide a space between the base bottom surface 52 and the supporting surface.

The embodiment of the exercise apparatus of the present invention illustrated in FIGS. 13 and 14 comprises base 30*c*, which is generally horizontally oriented, and resilient members 62*a* inserted in threaded connection interfaces 56*b'* and 56*b"*. The base 30*c* of the embodiment of the exercise apparatus illustrated in FIGS. 13 and 14 is made from two base member portions 30*c'* and 30*c"* formed from a wide ranging array of materials such as plastic, metal, wood, fiberglass, or any other similar or suitable material. The base member portions 30*c'* and 30*c"* are oriented generally parallel to one another and fixed together using base member spacers 58 and base bolts 54. Base 30*c* further comprises a plurality of base depressions 78, twelve being shown, each designed for receiving and limiting the lateral movement of a wobble board 112 or other similar device to increase the difficulty of exercises performed by making the user's stance unstable. The number, geometric configuration, and location of each of the base depressions 78 is widely variable. In the embodiment of the exercise apparatus of the present invention illustrated in FIGS. 13 and 14, each of the left side connection interfaces 56' have a different location and angular orientation, and are each symmetrical with the right side connection interfaces 56" about centerline 38.

In addition to being comprised only of a single resilient member, the resilient member of each of the embodiments disclosed in this patent can be comprised of multiple components, as is the resilient member 62' shown in FIGS. 13 and 14. The resilient members 62*a* shown in FIGS. 13 and 14 are each comprised of a resilient member 62*a'* that has a longitudinal bore 66 extending longitudinally therethrough, a threaded insert 64 which is attached to one end of the resilient member and inserted into the connection interface, a stiffener member 68 inserted into the longitudinal bore 66, and cap 72 that is attached to the unrestrained end of the resilient member to seal the longitudinal bore 66. Again, the resilient members 62*a* shown in FIGS. 13 and 14 are an alternate embodiment of the other embodiments of the resilient members 62 illustrated or described herein and can be used interchangeably with any of the resilient members, base embodiments, and connection interface embodiments disclosed herein. For the resilient members 62*a* shown in FIGS. 13 and 14, the stiffener member 68 is formed of a resilient rod that can be inserted into the longitudinal bores 66 to increase the resistance provided by the resilient member 62*a* and can be of any cross-section, round or otherwise, or can be in the form of a helical spring or similar configuration. The cap 72 is preferably fixed to the free end of the resilient member to seal the longitudinal bore 66 and also to serve as an interface with any handle or other similar attachment that the user desires to attach to the resilient members 62*a*. The cap 72 preferably defines a hole 74 which enables a handle to be bolted to the cap 72. Cap surface 73 and the portion of the inner bore surface 67 at the unrestrained end of the resilient member preferably comprise threads, pins, channels, protrusions, or other suitable locking features to prevent the inadvertent removal of the cap 72.

In the embodiment of the resilient member 62*a* illustrated in FIGS. 13 and 14, each insert 64 and each connection interface 56 are preferably threaded or comprise other suitable locking features so that, when the inserts 64 are inserted into the connection interfaces, the inserts 64 and, hence, the resilient members 62*a*, will not become inadvertently disengaged during use. Each insert 64 also serves another function—to provide a common interface with the connection interfaces. A resilient member with a non-circular cross-section could not be securely inserted into a cylindrical connection interface. An insert 64 with a circular cross-sectional portion can be affixed to the end of the non-circular resilient member so that the resilient member can be inserted into the cylindrical connection interface. Furthermore, an effective way to vary the resistance of the exercise is to vary the cross-sectional thickness of the resilient member 64. Attaching an insert 64 with a portion that matches the geometry of the connection interfaces 56 to the end of each such varying resilient member would overcome the mismatch that would otherwise prevent the resilient members of varying cross-sectional configurations that do not match the configuration of the connection interfaces from inserting into the connection interfaces. Thus, each insert 64 provides an interface between the resilient member and the connection interfaces so that resilient members of varying diameter or cross-sectional geometry can be inserted in the same connection interface.

Figure 15:
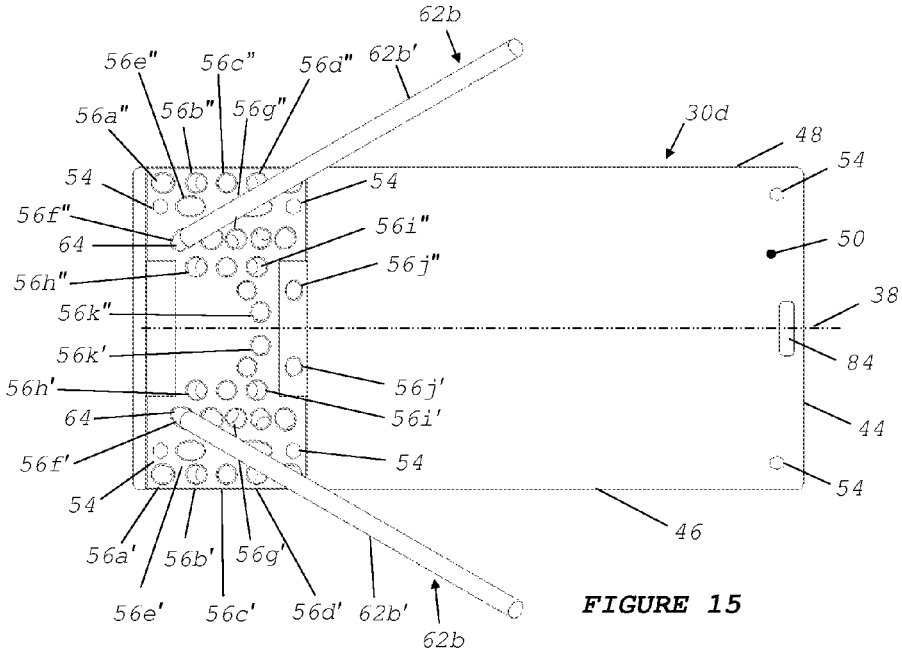
FIG. 15 is an aerial view of an embodiment of the exercise apparatus of the present invention.
Figure 15A:
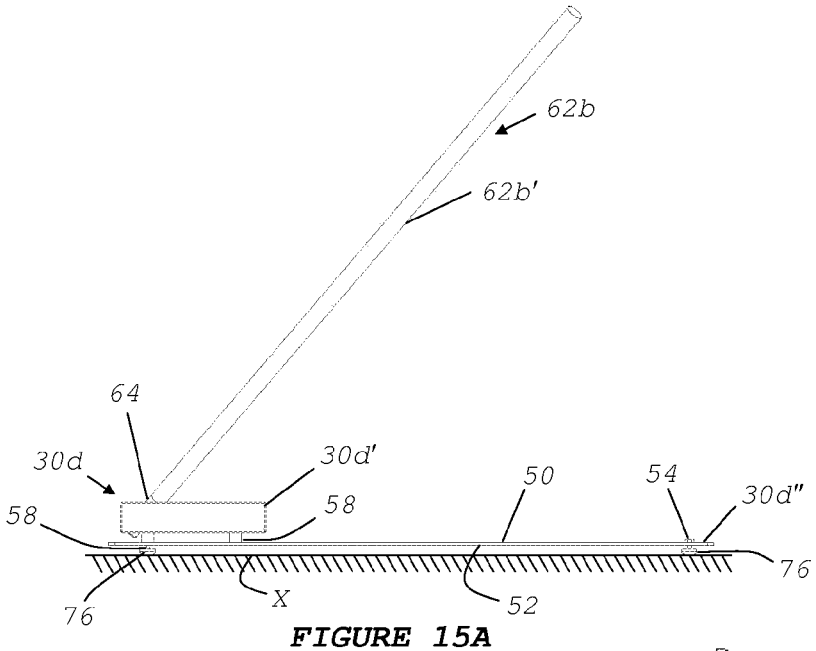
FIG. 15*a* is a side view of the embodiment of the exercise apparatus of the present invention illustrated in FIG. 15.

The embodiment of the present invention illustrated in FIGS. 15 and 15*a* comprises base 30*d*, which is generally horizontally oriented, and two resilient members 62*b*, each of which is comprised of resilient member 62*b'* and insert 64. Base 30*d* is defined by upper base portion 30*d'* and lower base portion 30*d"* attached together using bolts 54 and spacers 58. Base 30*d* defines a handle 84 to facilitate the transport of the base. Connection interfaces 56 are preferably formed in the upper base portion 30*d'* only and base spacers 58 provide space between the upper base portion 30*d'* and lower base portion 30*d"* to ensure that the resilient members can be sufficiently engaged in the connection interfaces without interference with the lower base portion 30*d*". Upper base portion 30*d*' is thick enough in cross-section to enable the resilient members 62' to engage in the connection interfaces 56 to a depth sufficient to secure the resilient members and to prevent their inadvertent removal.

Figure 16:
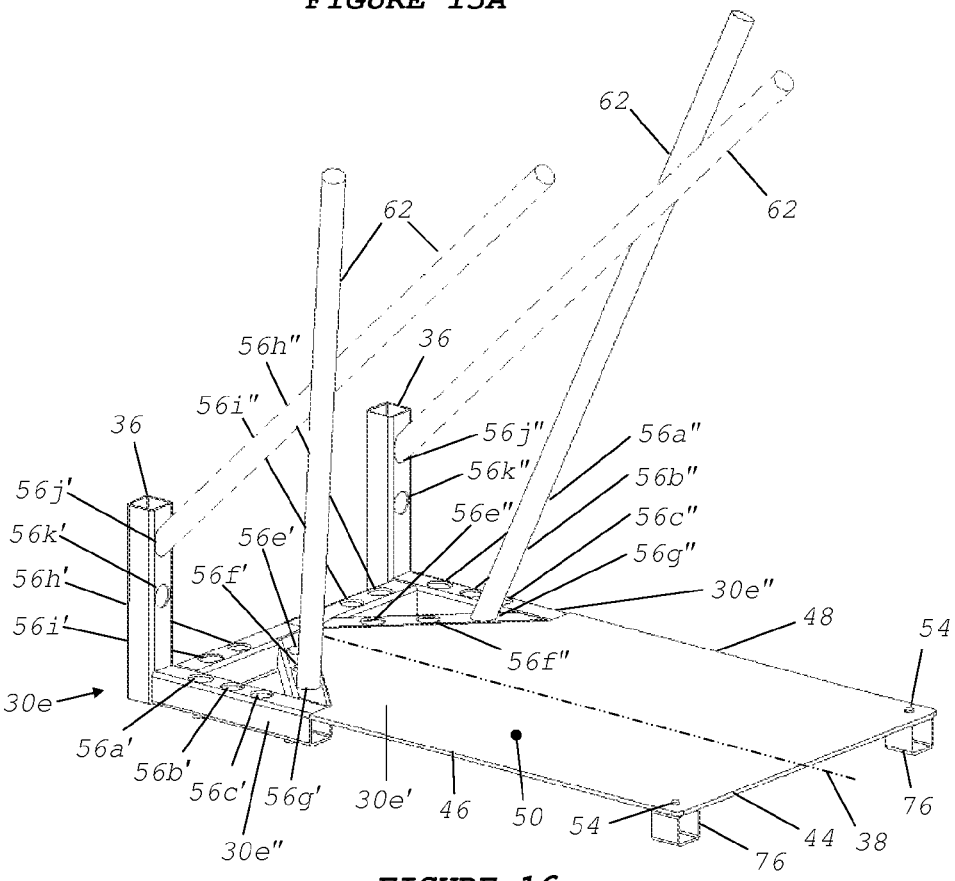
FIG. 16 is a perspective view of an embodiment of the exercise apparatus of the present invention.

The embodiment of the base 30*e* of the present invention illustrated in FIG. 16 is generally horizontally oriented and comprises main base portion 30*e*', several horizontally oriented tubular base portions 30*e*", two protruding base portions 36 (each of which defines connection interfaces 56 at different locations and orientations relative to the user and can be attached using bolts, welds, or other similar attachment means), and two base pads 76 attached to the base 30 using base bolts 54. The exercise apparatus of the present invention illustrated in FIG. 16 comprises four resilient members 62 simultaneously inserted into four connection interfaces 56. The two resilient members 62 illustrated in phantom lines are shown merely to illustrate the orientation of the connection interfaces 56*j*' and 56*j*" only. It is not required or even beneficial that more than one or two resilient members are simultaneously inserted into the connection interfaces. As mentioned, the base 30*e* is comprised of multiple tubular members preferably formed from tubing with a hollow, rectangular cross-section and one large, flat plate member, fixed together using bolts, screws, brackets, welds, adhesive, notches, protrusions, or by any other suitable fastening means. The left side connection interfaces 56*a*'-56*k*' and the right side connection interfaces 56*a*"-56*k*" are symmetrical about a plane normal to the primary surface 50 and intersecting centerline 38.

Figure 17:
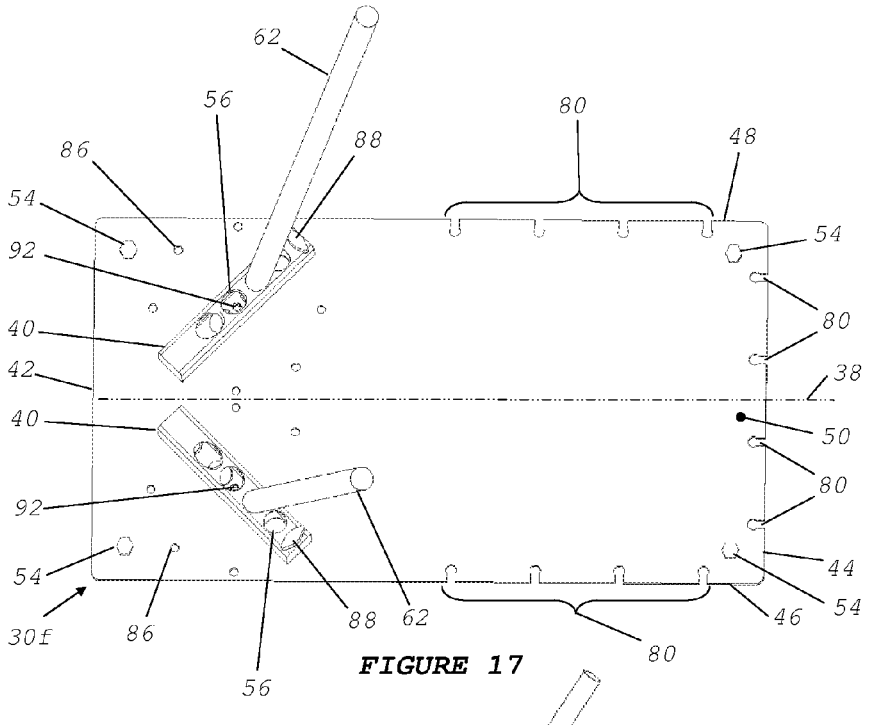
FIG. 17 is a perspective view of an embodiment of the exercise apparatus of the present invention.

The embodiment of the present invention illustrated in FIG. 17 comprises base 30*f*, two resilient members 62, two adjustable base members 40, rotation pins 92 attached to base 30*f* through a hole in each of the adjustable base members and about which adjustable base members 40 rotate, multiple insert pin openings 86 cut into the base 30 preferably in a radial arrangement about the rotation pin 92, and two insert pins 88 that lock each of the adjustable base members 40 in the desired angular orientation by engaging in the desired insert pin openings 86. Insert pins 88 and insert pin openings 86 can be threaded or define other features to prevent the inadvertent removal of the insert pins 88. Each of the adjustable base members 40 define multiple connection interfaces 56 at different locations and angular orientations for receiving the resilient member 62. By altering the angular orientation of each of the adjustable base members 40 and/or inserting the resilient member 62 into a different connection interface 56, the exercise apparatus of the present invention can be configured to permit the user to perform a wide range of exercises. Base 30*f* further defines base notches 80 cut into the perimeter of the base into which resistance bands and other similar devices can be secured to permit the user to perform additional exercises when standing, kneeling, or sitting on the base.

Figure 18:
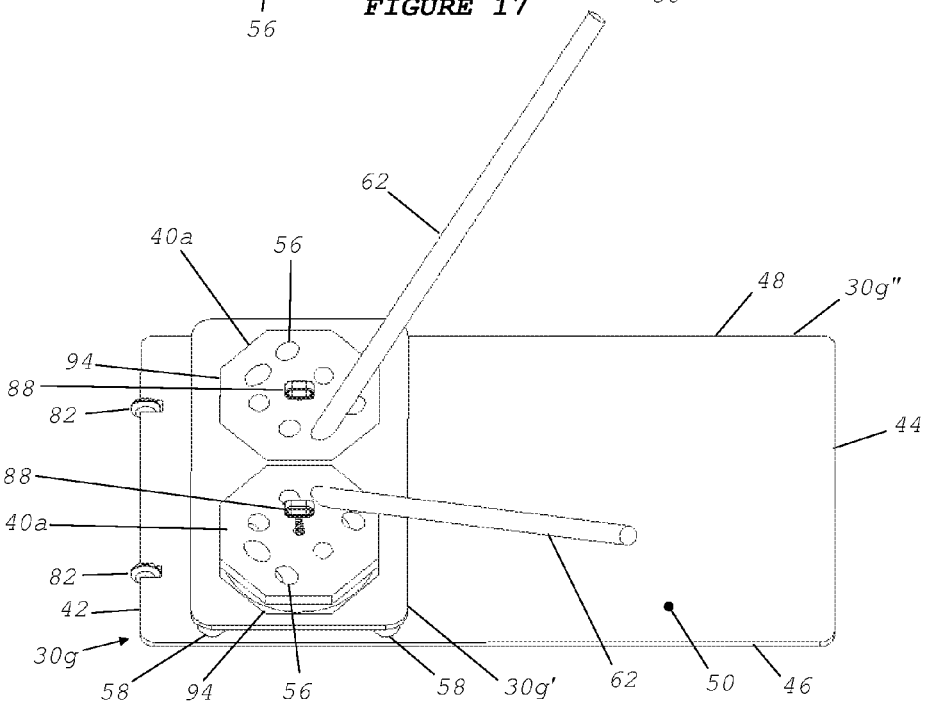
FIG. 18 is an exploded perspective view of an embodiment of the exercise apparatus of the present invention

Similar to the embodiment illustrated in FIG. 17, the embodiment of the present invention illustrated in FIG. 18 also permits the user to adjust the location and angular orientation of the resilient members 62 by varying the angular orientation of the adjustable base members 40*a* and/or inserting the resilient members 62 into one of a plurality of connection interfaces 56 on each adjustable base members 40*a*, seven being shown. Each connection interface 56 is arranged at a different location and angular orientation on the adjustable base member 40*a*. Base 30*g* defines upper base portion 30*g*' and lower base portion 30*g*" which are preferably separated from one another using multiple base member spacers 58 which are attached to the base 30*g* using bolts, welds, adhesive, or any other suitable connection means. The upper base portion 30*g*' has two cutouts 94 into which each adjustable base member 40*a* is removably inserted. The two adjustable base members 40*a* are secured in the desired angular orientation by inserting the insert pin 88, which is located at the center point of each of the adjustable base members 40*a* and passes through the adjustable base members 40*a*, into a hole located in the base 30 and aligned with insert pin 88.

In the embodiment illustrated in FIG. 18, both the insert pin 88 and the base hole into which the insert pin 88 is inserted preferably comprise locking features, such as threads, pins, protrusions, channels, or other suitable features so that, when the insert pin 88 is engaged in the base hole, the adjustable base members 40*a* are firmly secured to the base 30*g*. The insert pin 88, the base hole, and the cutouts 94 in the base 30*g* prevent the adjustable base members 40*a* from rotating, translating, or otherwise moving from the desired location. The user adjusts the angular orientation of the adjustable base members 40*a* by removing the insert pin 88, lifting the adjustable base member 40*a* out of the cutout 94, changing the angular orientation of the adjustable base members 40*a*, and then reinserting adjustable base member 40*a* into the cutout 94, and inserting the insert pin 88 into the base hole. Each cutout 94 is defined by a geometry approximately matching, but slightly oversized as compared to, the geometry of the side surfaces of each of the adjustable base members 40*a* such that each of the adjustable base members 40*a* can be removably but snuggly inserted partially or fully into each of the two cutouts 94. Base 30*g* further defines two base wheels 82 to facilitate transport of the base.

The embodiment of the present invention illustrated in FIG. 19 permits the user to adjust the location and angular orientation of the resilient members 62*c* by varying the angular orientation of the adjustable base members 40*b* with respect to the mount assembly 98. The base 30*h* can be oriented at any angle, horizontal, vertical, or otherwise. Each of the two adjustable base members 40*b* independently rotate about mount assembly axle 106 so that the angular orientation of the adjustable base members 40*b* and, consequently, the resilient members 62*c*, can be adjusted by the user of this device. Each of the adjustable base members 40*b* is locked by the user in the desired angular orientation by inserting the mount assembly adjustment pin 104, which is mounted to and can translate through the mount assembly pin bracket 108 into any one of the holes of the mount assembly radial hole bracket 102. Mount assembly pin bracket 108 is fixed to the base 30*h* by bolting, screwing, welding, or by suitable features or methods. Mount assembly radial hole bracket 102 is fixed to the mount assembly axle 106 so that it rotates along with the adjustable base member 40*b*. A "W" shaped handle assembly 114 is preferably attached to the caps 72 of the resilient members 62*c* using a hand bolt, screw, or other suitable attachment means. Attaching a "W" shaped handle or any other handle to the resilient members permits the user to perform a wider variety of exercises by providing different positions where the user can grip the exercise apparatus of the present invention. Other handles, such as rope handles, individual handles, or straight handles, can be similarly attached to the resilient members to enable a variety of additional gripping points for the user.

Further adjustability of the angular orientation of the mount assembly 98 with respect to the base can be achieved by mounting the mount assembly 98 to a freely rotatable but lockable plate. The rotating plate would be locked into the desired angular orientation by inserting an insert pin or other suitable locking mechanism through the rotatable plate into an insert pin opening in the base. Alternatively, the rotatable plate could comprise a foot pedal attached to the insert pin so that, by pressing the pedal, the insert pin can be disengaged from the aforementioned array of insert holes in base and permit the free rotation of the rotatable plate. By releasing the pedal when the rotatable plate is in the desired orientation, the pin or other suitable component will be engaged in the array of insert holes in base.

Figure 20:
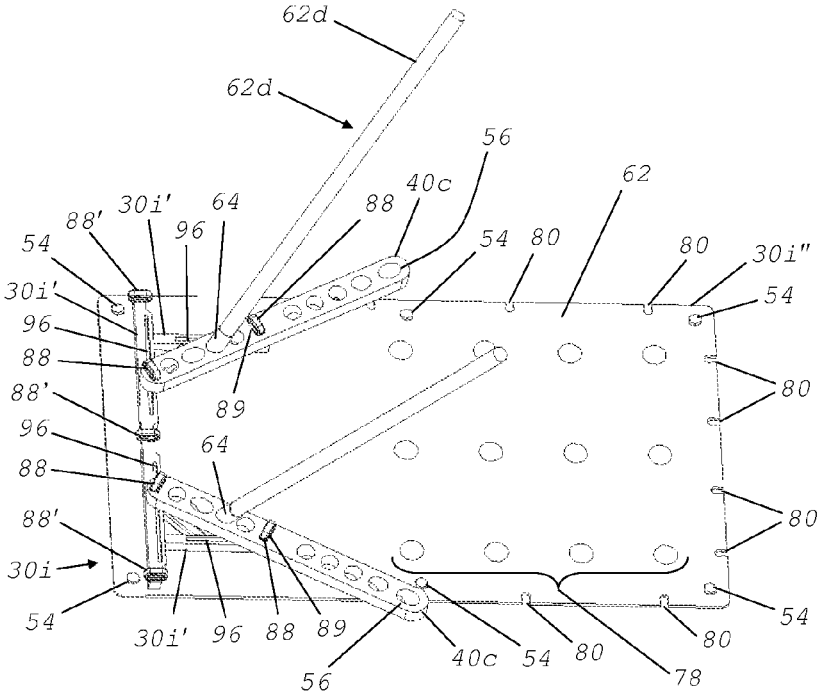
FIG. 20 is a perspective view of an embodiment of the exercise apparatus of the present invention.
Figure 21A:
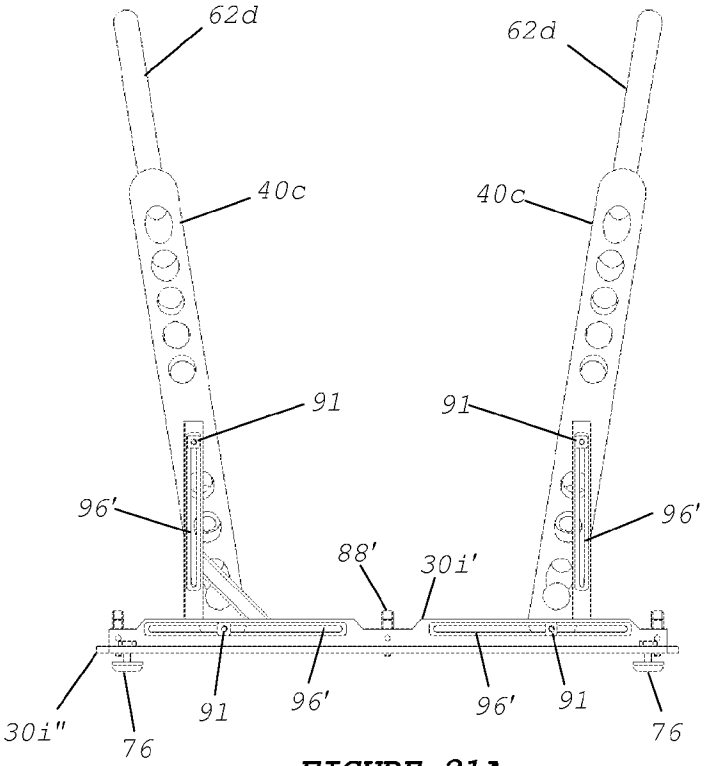
FIG. 21*a* is a back view of the embodiment of the exercise apparatus of the present invention illustrated in FIG. 21 taken along line 21*a*-21*a* in FIG. 21.
Figure 21:
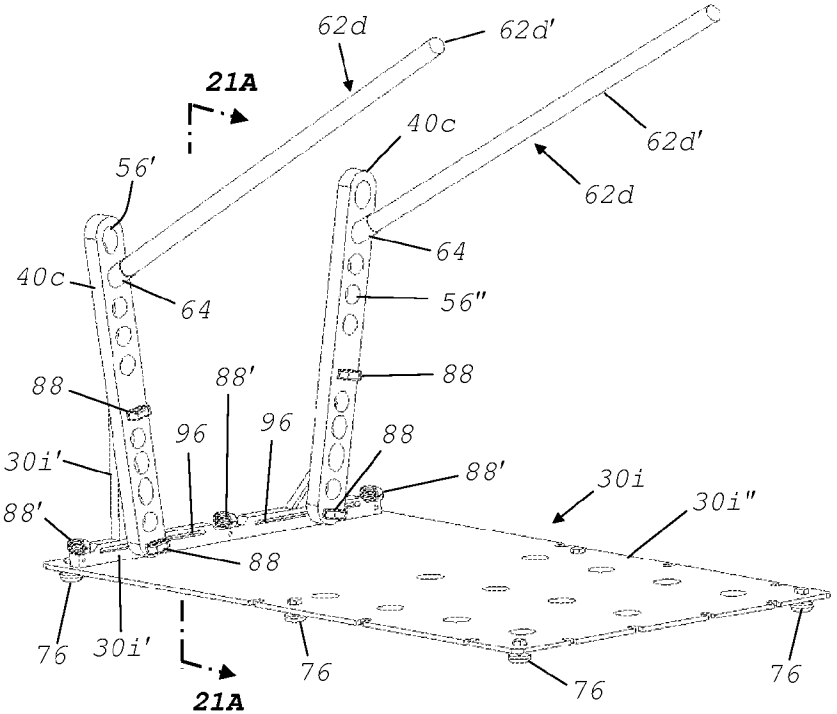
FIG. 21 is a perspective view of an embodiment of the exercise apparatus of the present invention.

The embodiment of the present invention illustrated in FIGS. 20, 21*a*, and 21*b* also permits the user to adjust the location and angular orientation of the resilient members 62*d* by varying the angular orientation of the adjustable base members 40*c* and/or inserting the resilient members 62*d* into one of the nine connection interfaces 56 on each adjustable base members 40*c*. Each connection interface 56 is preferably arranged at a different location and angular orientation on the adjustable base member 40*c*. Multiple upper base portions 30*i*' having a generally rectangular cross-section are fixed to the lower base portion 30*i*" by threaded insert pins 88'. The user adjusts the angular orientation of the adjustable base members 40*c* by loosening and sliding the threaded insert pins 88, and hence the adjustable base member 40*c*, to a different position in slots 96 and then tightening the threaded insert pins 88. To secure each adjustable base member 40*c* in its desired position, each of the threaded insert pins 88 pass through a hole 89 in the adjustable base member 40*c*, through slot 96, and engage in the nut 91 that is slidably positioned within the larger slot 96' formed on the bottom sides of the upper base portions 30*i*'. The base 30*i* further comprises base notches 80 and base depressions 78, both of which can be incorporated into any embodiment of the present invention. FIG. 21 illustrates the identical embodiment of the present invention illustrated in FIG. 20, except that upper base portions 30*i*' are fixed in a generally vertical orientation to the base 30*i* using threaded insert pins 88', permitting the user to further vary the location and orientation of each resilient member 62*d*.

Figure 22A:
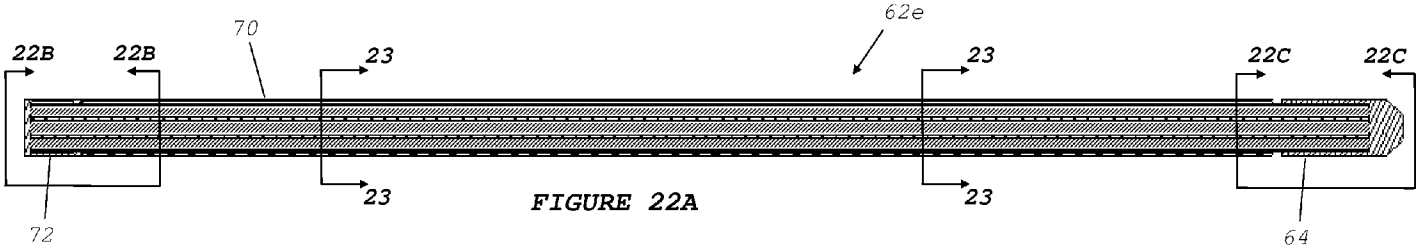
FIGS. 22*a*, 22*b*, and 22*c* are sectional views of an embodiment of the resilient member of the present invention.
Figure 22C:
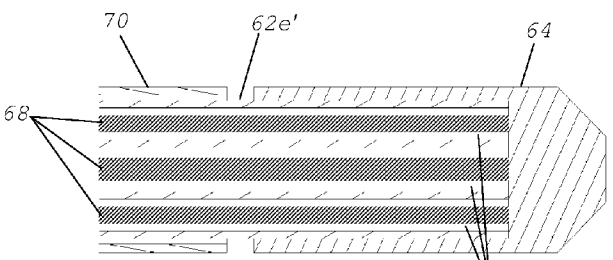
Figure 22B:
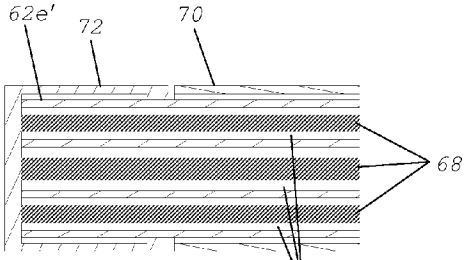
Figure 23:
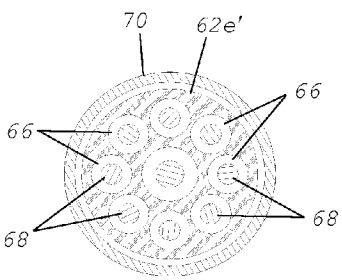
FIG. 23 is a sectional view of the embodiment of the resilient member of the present invention taken along line 23-23 in FIG. 22*a*.

FIGS. 22*a*, 22*b*, and 22*c* are longitudinal cross-sectional views, and FIG. 23 is transverse cross-sectional view, of an embodiment of a resilient member 62*e* comprising multiple stiffener members 68 which, when inserted by the user into the longitudinal bores 66 of resilient member 62*e*', increase the stiffness and resistance of the resilient member 62*e*. Resilient member 62*e*' can comprise multiple longitudinal bores 66 (as shown in the embodiment illustrated in FIGS. 22 and 23), or merely one longitudinal bore 66 into which one or more stiffener members 68 can be inserted. Thus, resilient member 62*e*' can be solid in cross-section or hollow with any number of longitudinally oriented longitudinal bores 66 therein, as described above. The stiffener members 68 can be any of a variety of diameters, geometries, and stiffnesses, so long as they fit inside longitudinal bores 66. Additionally, sleeve 70 having a toroidally shaped cross-section can be inserted by the user over the outer surface of the resilient member 62*e*' to achieve greater stiffness and, hence, resistance of the resilient member 62*e*. The resilient member 62*e* depicted in the embodiment of the present invention illustrated in FIGS. 22-23 can be interchanged with any of the aforedescribed resilient member described herein.

Referring to FIGS. 22*a* and 22*b*, the cap 72 is affixed onto the unrestrained end of the resilient member 62*e*' to seal the longitudinal bore or bores 66 and encapsulate stiffener members 68. Cap 72 preferably provides an interface with the resilient member 62*e*' to which the "W" shaped handle 114, rope handle, individual handle, or any other handle or attachments that the user desires can be attached by using a hand bolt, screw, or other suitable attachment means. Cap 72 and resilient member 62*e*' preferably define threads, pins, protrusions, or other suitable locking features to firmly secure the cap 72 to the resilient member 62*e*'.

Resilient member 62', stiffener member 68, and sleeve 70 can be manufactured from any resilient material, e.g., a polymer, elastomer, a pliable metallic alloy, plastic-fiberglass or other fiber composite, or any other suitable material that will elastically bend without permanent deformation when force as applied by the user, such as any one or more of the following: nylon, delrin, polyvinyl chloride, rubber, elastomeric materials, aluminum, steel, spring steel, carbon, or glass elastomers, or any other suitable materials that can form a flexible yet stiff resilient member. The resilient member can be of any cross-sectional geometry and can be straight, angled, or curved to accommodate different exercises. The length of the resilient member preferably ranges from approximately twelve inches to approximately sixty inches depending on the exercise the resilient member is to be used for. However, the length is not so limited. The diameter or cross-sectional width of the resilient member can similarly vary between approximately one-half inch to two inches, depending on the desired stiffness and other factors, such as user comfort, but is preferably in the range of one inch to one and a half inches. The cap 72 and insert 64 can be manufactured from any rigid material, e.g., a polymer, metal or metal alloy, plastic-fiberglass or other fiber composite, or any other suitably rigid material.

Figure 24C:
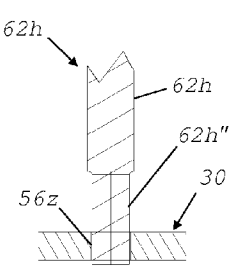
FIG. 24*c* is a sectional view of an embodiment of the resilient member and an embodiment of the connection interface of the present invention.
Figure 24B:
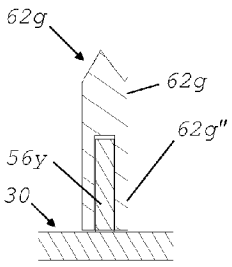
FIG. 24*b* is a sectional view of an embodiment of the resilient member and an embodiment of the connection interface of the present invention.
Figure 24A:
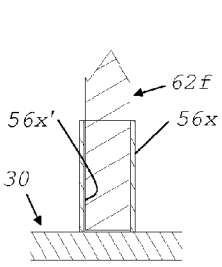
FIG. 24*a* is a sectional view of an embodiment of the resilient member and an embodiment of the connection interface of the present invention.

The geometry of the connection interfaces 56 can be generally cylindrical or conical, or can be of any cross-sectional geometry, square, hexagonal, or otherwise. The geometry of the embodiment of the connection interface 56*x* illustrated in FIG. 24*a* is cylindrical, defining a cylindrical interior portion 56*x*' into which resilient member 62*f* is inserted. Connection interface 56*x* protrudes from the base 30 a sufficient distance, preferably three inches, to ensure that the resilient member is securely engaged. The embodiment of the connection interface 56*y* illustrated in FIG. 24*b* is configured as a cylindrical projection projecting from the base. Resilient member 62*g* is attached to connection interface 56*y* such that the connection interface 56*y* fits snuggly into the cylindrical opening 62*g*" in the end of the resilient member 62*g*. Connection interface 56*y* protrudes from the base 30 a sufficient distance, preferably three inches, to ensure that the resilient member is securely engaged. The connection interface 56*z* illustrated in FIG. 24*c* is formed of a square cutout in base 30. The portion of the resilient member 62*h*" that is inserted into connection interface 56*z* has an outer surface geometry that substantially matches the geometry of the interior surface of the connection interface 56*z* but is sized to fit snuggly within the connection interface 56*z*. Further, the end of the resilient member 62 that is attached to a connection interface, i.e., either the end of the resilient member 62' or the insert 64, can be threaded, notched, or contain some other protrusion to prevent it from becoming inadvertently unattached from the connection interface 56. The connection interface 56 would also comprise complementary locking features. Alternatively, the resilient member 62 can be devoid of any locking features on its exterior surface so that it can be easily removed from the connection interfaces 56. A connection interface defining a defining a conical geometry is preferable because, when the surface of the resilient member that mates with the connection interface is also conical, the resilient member can be inserted firmly to ensure a snug fit between the connection interface and the resilient member.

It is believed that the exercise apparatus of the present invention will be understood from the foregoing description, and it will be apparent that various changes may be made in the form, construction and arrangement of the parts without departing from the spirit or scope of the invention or sacrificing all of the material advantages, the forms herein above described being merely preferred or exemplary embodiments thereof.

The following detailed description is now directed to certain specific embodiments of the present disclosure. In this description, reference is made to the drawings wherein like parts are designated with like numerals throughout the description and the drawings.

Figure 25:
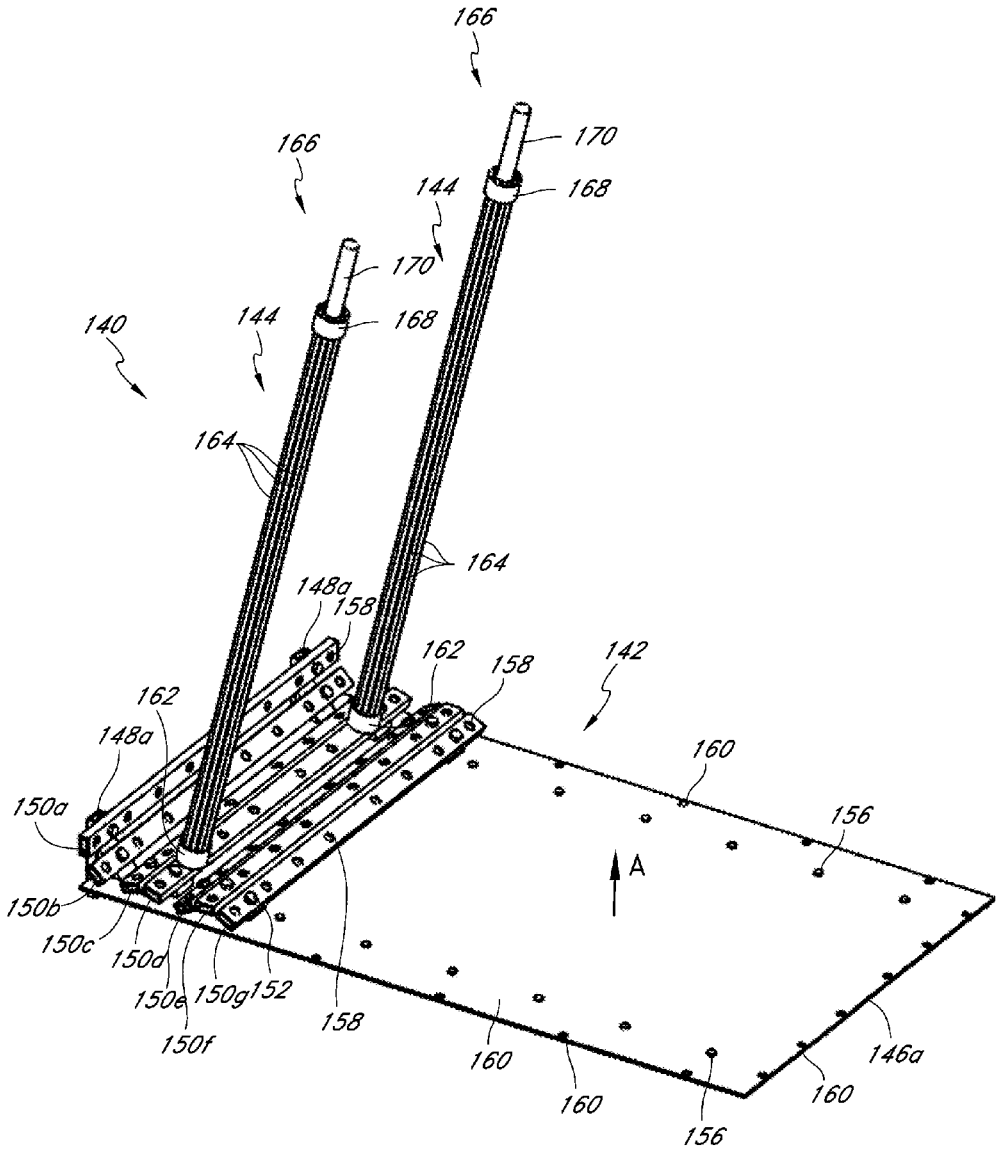
FIG. 25 is a perspective view of an embodiment of an exercise device.

FIG. 25 is a perspective view of an embodiment of an exercise device 140. The exercise device 140 can comprise a base 142 and resilient members 144. In the illustrated embodiment, the base 142 can be configured to be free standing on a generally flat, horizontal surface so as to provide a supporting surface for a user of the exercise device in a standing, sitting, kneeling, or any other desired position. However, the exercise device 140 is not so limited. In some embodiments, the base 142 can be attached to and, hence, supported by a horizontal, vertical or inclined surface, or can be configured to be free standing in a vertical or any angular orientation. As used in this document, any reference to "some embodiments" or to any embodiment or component disclosed "herein" is meant to refer to any embodiments or components set forth explicitly or implicitly herein, and/or any embodiments or components incorporated by reference herein.

Figure 26:
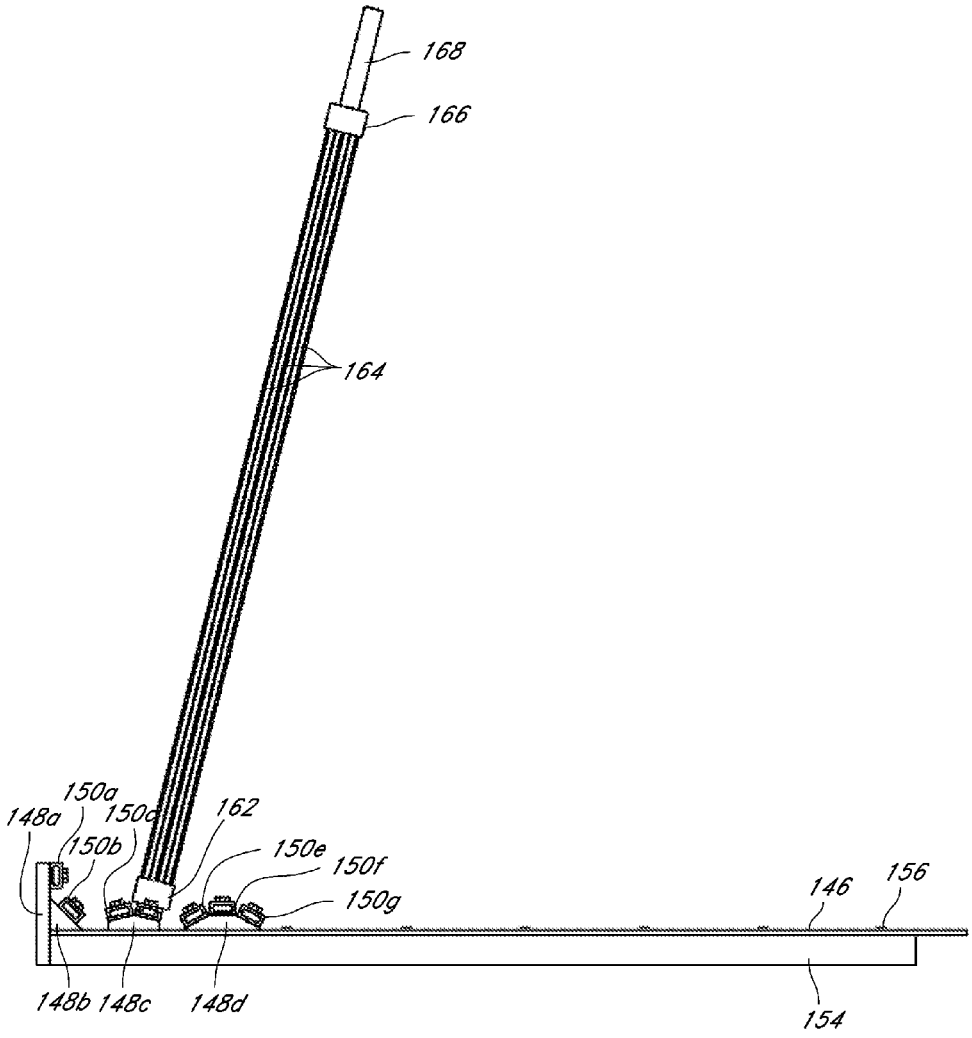
FIG. 26 is a side view of the embodiment of the exercise device shown in FIG. 25.

As illustrated in FIGS. 25-26, the base 142 can comprise a supporting base member 146, a pair of first base interface members 148*a*, a pair of second base interface members 148*b*, a pair of third base interface members 148*c*, a pair of fourth base interface members 148*d*, and a plurality of base connection members 150 can be made from steel, aluminum, or any other suitable rigid material and secured to the base interface members 148*a*-148*d* with a plurality of bolts or screws 152 threadably engaged in the base interface members 148*a*-148*d*. However, the base connection members 150 can be directly or indirectly secured to the base interface members 148*a*-148*d* by any other means, including but not limited to the use of welds, rivets, adhesive, fusion, or by any other suitable method or method known in the art. In addition, the base connection members 150 can be secured directly to the supporting base member 146. Alternatively, any of the base connection members 150 can be integrally formed with one or more of the base interface members 148*a*-148*d*.

In the illustrated embodiment, the base 142 can also comprise support rails 154 can be bolted to the supporting base member 146 with a plurality of bolts or screws 156, as well as cross-members (not shown) spanning substantially laterally between the support rails 154. In the illustrated embodiment, there can be four equally spaced cross-members spanning substantially laterally between the support rails 154 to increase the rigidity of the supporting base member 146. The support rails 154 and cross-members can also be secured to the supporting base member 146 by any other suitable means, including but not limited to the use of welds, rivets, adhesive, fusion, or by any other suitable method or method known in the art. In some embodiments, the base 142 can be sized and configured such that support rails and other supporting components or members can be not needed. The support rails 154 and cross-members can increase the rigidity and support strength of the base 142 to provide a beneficial support surface for the user of the exercise device 140 in a standing, sitting, kneeling, or other position.

The base connection members 150 each can comprise a plurality of connection interfaces 158. In some embodiments, each of one or more connection interfaces 158 can be configured to provide a removable securement for an end portion of a resilient member such that the resilient member extends therefrom in a cantilevered disposition. In some embodiments, each of one or more connection interfaces 158 can be formed of a channel either partially or fully protruding through one or more base connection members 150. In some embodiments, each of one or more connection interfaces 158 can be formed of a channel either partially or fully protruding through the supporting base member 146.

In some embodiments, the connection interfaces 158 can define an inner surface having substantially the same geometrical configuration and size as an outer surface of the portion of the resilient member 144 that can be secured to the connection interface connection interface 158. Alternatively, the connection interfaces 158 can be configured to be protrusions extending from the supporting base member 146 or other intermediary component. Accordingly, another embodiment of a resilient member 144 can be configured to define an opening at or near the bottom thereof such that, when the opening on the resilient member 144 is inserted over the protruding connection interface, the resilient member 144 can be secured thereto in a cantilevered disposition.

Each connection interface connection interface 158 can be configured to at least restrain one end of the resilient member 144 in a cantilevered fashion so that a user can perform exercises by grasping the unrestrained portion of one or more resilient members 144 in his or her hand or hands and, exerting a generally transverse force against the unrestrained portion of the resilient member 144, causes the resilient member 144 to bend in flexure. The stiffness of the resilient member 144 provides the resistance desired for performing the exercises. The resilient member 144 can permit multi-directional resistance and can be used independently or simultaneously, permitting the user to perform multiple different exercises simultaneously.

Figure 27:
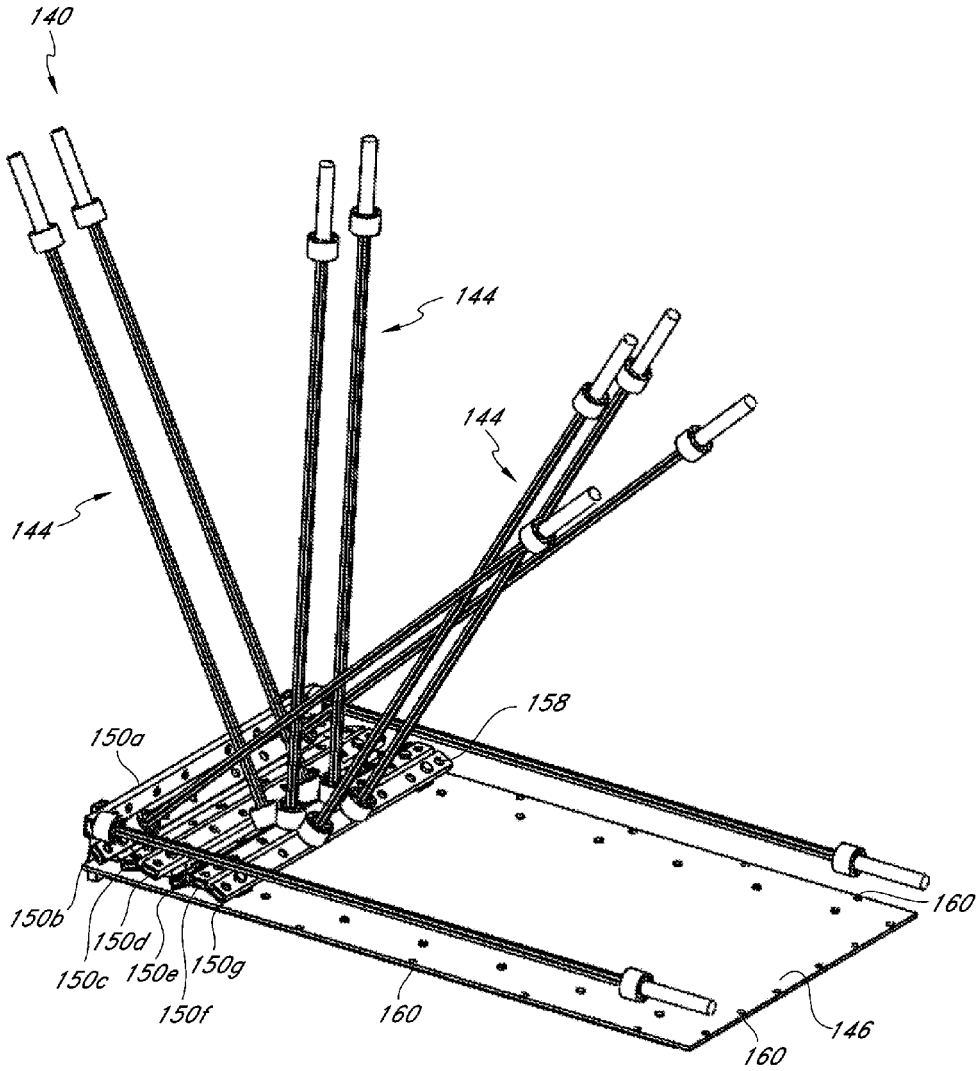
FIG. 27 is a perspective view of an embodiment of an exercise device including a plurality of an embodiment of a resilient member positioned in a variety of locations and angular orientations.

FIG. 27 is a perspective view of an embodiment of an exercise device, including a plurality of an embodiment of a resilient member positioned in a variety of locations and angular orientations. FIG. 27 illustrates the wide ranging variety of locations and angular orientations that each of the resilient members 144 can be positioned in relative to the supporting base member 146. However, the number, location, and orientation of the base connection members 150 and the connection interfaces 158 of the exercise device 140 are not limited to the number, location, and orientation of the base connection members 150 and connection interfaces 158 described or illustrated herein. The exercise device 140 can be configured such that the base connection members 150 and connection interfaces 158 are widely ranging in number, location, and orientation.

In some embodiments, the connection interfaces 158 are arranged so as to by symmetrical about a plane bisecting the supporting base member 146 and perpendicular to the supporting base member front edge 146*a* so that the user can simultaneously perform identical exercise motions on the left and right side of his or her body. However, the exercise device is not so limited. The exercise device can permit a widely variable number of locations and orientations of the connection interfaces 158 relative to the user beyond those described above and illustrated herein. Thus, while the connection interfaces 158 can be symmetrically arranged, the exercise device is not so limited.

In the illustrated embodiment, the exercise device 140 can comprise a base connection member 150*a* having eight connection interfaces 158 each defining a centerline axis (not shown) that can be angled approximately ninety degrees relative to an axis A that can be normal to a top surface of the supporting base member 146, a base connection member

150*b* having eight connection interfaces 158 each defining a centerline axis (not shown) that can be angled approximately forty-five degrees relative to axis A in a direction toward base member front edge 146*a*, a base connection member 150*c* having eight connection interfaces 158, each defining a centerline axis (not shown) that can be angled approximately thirteen degrees relative to axis A in a direction away from base member front edge 146*a*, a base connection member 150*d* having eight connection interfaces 158 each defining a centerline axis (not shown) that can be angled approximately thirteen degrees relative to axis A in a direction toward base member front edge 146*a*, a base connection member 150*e* having eight connection interfaces 158 each defining a centerline axis (not shown) that can be angled approximately twenty-six degrees relative to axis A in a direction away from base member front edge 146*a*, a base connection member 150*f* having eight connection interfaces 158 each defining a centerline axis (not shown) that can be angled approximately parallel to axis A, and a base connection member 150*g* having eight connection interfaces 158 each defining a centerline axis (not shown) that can be angled approximately twenty-six degrees relative to axis A in a direction toward base member front edge 146*a*.

In some embodiments, the exercise device 140 can comprise a base connection member 150 having one or more connection interfaces 158 each defining a centerline axis (not shown) that can be angled from approximately zero to approximately ten degrees relative to axis A in a direction away from base member front edge 146*a*. In some embodiments, the exercise device 140 can comprise a base connection member 150 having one or more connection interfaces 158 each defining a centerline axis (not shown) that can be angled from approximately zero to approximately ten degrees relative to axis A in a direction toward base member front edge 146*a*. In some embodiments, the exercise device 140 can comprise a base connection member 150 having one or more connection interfaces 158 each defining a centerline axis (not shown) that can be angled from approximately ten to approximately twenty degrees relative to axis A in a direction away from base member front edge 146*a*. In some embodiments, the exercise device 140 can comprise a base connection member 150 having one or more connection interfaces 158 each defining a centerline axis (not shown) that can be angled from approximately ten to approximately twenty degrees relative to axis A in a direction toward base member front edge 146*a*. In some embodiments, the exercise device 140 can comprise a base connection member 150 having one or more connection interfaces 158 each defining a centerline axis (not shown) that can be angled from approximately twenty to approximately thirty degrees relative to axis A in a direction away from base member front edge 146*a*. In some embodiments, the exercise device 140 can comprise a base connection member 150 having one or more connection interfaces 158 each defining a centerline axis (not shown) that can be angled from approximately twenty to approximately thirty degrees relative to axis A in a direction toward base member front edge 146*a*. In some embodiments, the exercise device 140 can comprise a base connection member 150 having one or more connection interfaces 158 each defining a centerline axis (not shown) that can be angled from approximately thirty to approximately fifty degrees relative to axis A in a direction away from base member front edge 146*a*. In some embodiments, the exercise device 140 can comprise a base connection member 150 having one or more connection interfaces 158 each defining a centerline axis (not shown) that can be angled from approximately thirty to approximately fifty degrees relative to axis A in a direction toward base member front edge 146*a*.

In some embodiments, the exercise device 140 can comprise a base connection member 150 having one or more connection interfaces 158 each defining a centerline axis (not shown) that can be angled from approximately fifty to approximately seventy degrees relative to axis A in a direction away from base member front edge 146*a*. In some embodiments, the exercise device 140 can comprise a base connection member 150 having one or more connection interfaces 158 each defining a centerline axis (not shown) that can be angled from approximately fifty to approximately seventy degrees relative to axis A in a direction toward base member front edge 146*a*. In some embodiments, the exercise device 140 can comprise a base connection member 150 having one or more connection interfaces 158 each defining a centerline axis (not shown) that can be angled from approximately seventy to approximately ninety degrees relative to axis A in a direction away from base member front edge 146*a*. In some embodiments, the exercise device 140 can comprise a base connection member 150 having one or more connection interfaces 158 each defining a centerline axis (not shown) that can be angled at between approximately seventy and approximately ninety degrees relative to axis A in a direction toward base member front edge 146*a*. In some embodiments, the exercise device 140 can comprise a base connection member 150 having one or more connection interfaces 158 each defining a centerline axis (not shown) that can be angled from approximately ninety to approximately one hundred and twenty degrees relative to axis A in a direction away from base member front edge 146*a*. In some embodiments, the exercise device 140 can comprise a base connection member 150 having one or more connection interfaces 158 each defining a centerline axis (not shown) that can be angled from approximately ninety to approximately one hundred and twenty degrees relative to axis A in a direction toward base member front edge 146*a*.

Finally, supporting base member 146 can comprise one or more base cut-outs 160 that can be formed through the supporting base member 146 around the perimeter of the supporting base member 146, as illustrated most clearly in FIGS. 25 and 27. The base cut-outs 160 can be sized and configured so as to secure therein one or more axial resistance bands or other similar exercise devices. This can allow the user to perform additional exercises when standing, kneeling, or sitting on the supporting base member 146.

Referring again to FIGS. 25-26, the exercise device 140 can comprise a pair of resilient members 144. The embodiments of the resilient members 144 shown in FIGS. 25-26 each comprise a first member 162 (also referred to herein as an insert member or carrying member), one or more stiffening members 164, and a second member 166 (also referred to herein as a handle member or retention member). In the illustrated embodiment and in every embodiment disclosed herein, each stiffening member can be formed from nylon, Delrin, polyvinyl chloride, or other suitable polymers, resilient materials, or fiber-based materials, such as fiberglass or glass-filled polymers, or any combination or composite thereof or of any other suitable material. Additionally, in the illustrated embodiment and in every embodiment disclosed herein, each stiffening member 164 can define a cylindrical cross-section, but may define any cross-sectional geometry such as a triangle, square, or any other polygonal or any other suitable geometry.

In the illustrated embodiment, the handle member 166 can comprise a handle retention portion 168 and a gripping portion 170. Without limitation, the retention portion of any embodiment described herein can be configured to provide lateral, or radial, support to the upper end of each of the stiffening members that are inserted therein. Further, without limitation, the gripping portion of any embodiment herein can be configured to provide a gripping surface for a user of the resilient members, to which a lateral force can be applied that will cause the resilient member to deflect, developing a resistance and effecting an exercising motion for the user. Additionally, other handles, bars, or grips can be secured to the handle member of any embodiment described herein to provide other gripping orientations and surfaces for the user. For example, without limitation, the handle member can be configured to secure a single rubber or metal handle, a rope handle, or a "W" shaped bar thereto for this purpose.

In the embodiment illustrated in FIGS. 25-26, the retention portion 168 and gripping portion 170 may be integrally formed from a single piece of material, which can be aluminum, a high strength polymer, or other suitable material. In some embodiments, retention portion 168 and gripping portion 170 may be formed from two different pieces of material and fixed together by adhesives, or one or more bolts, screws, rivets, or welds, or by any other suitable fastening method or combination of the foregoing. Either the retention portion 168 or gripping portion 170 may be formed from a material of the group comprising plastic, aluminum, steel, fiberglass, or any other suitable material. The retention portion 168 and gripping portion 170 can be rigid. In some embodiments, the retention portion 168 can be comprised of a material that has beneficial lubrication properties or a low coefficient of friction so as to permit the stiffening member or members 164 secured by the retention portion 168 to axially translate substantially unrestricted relative to the retention portion 168 when the resilient member 144 is deflected.

Figures 35, 36A, 36B, 37:
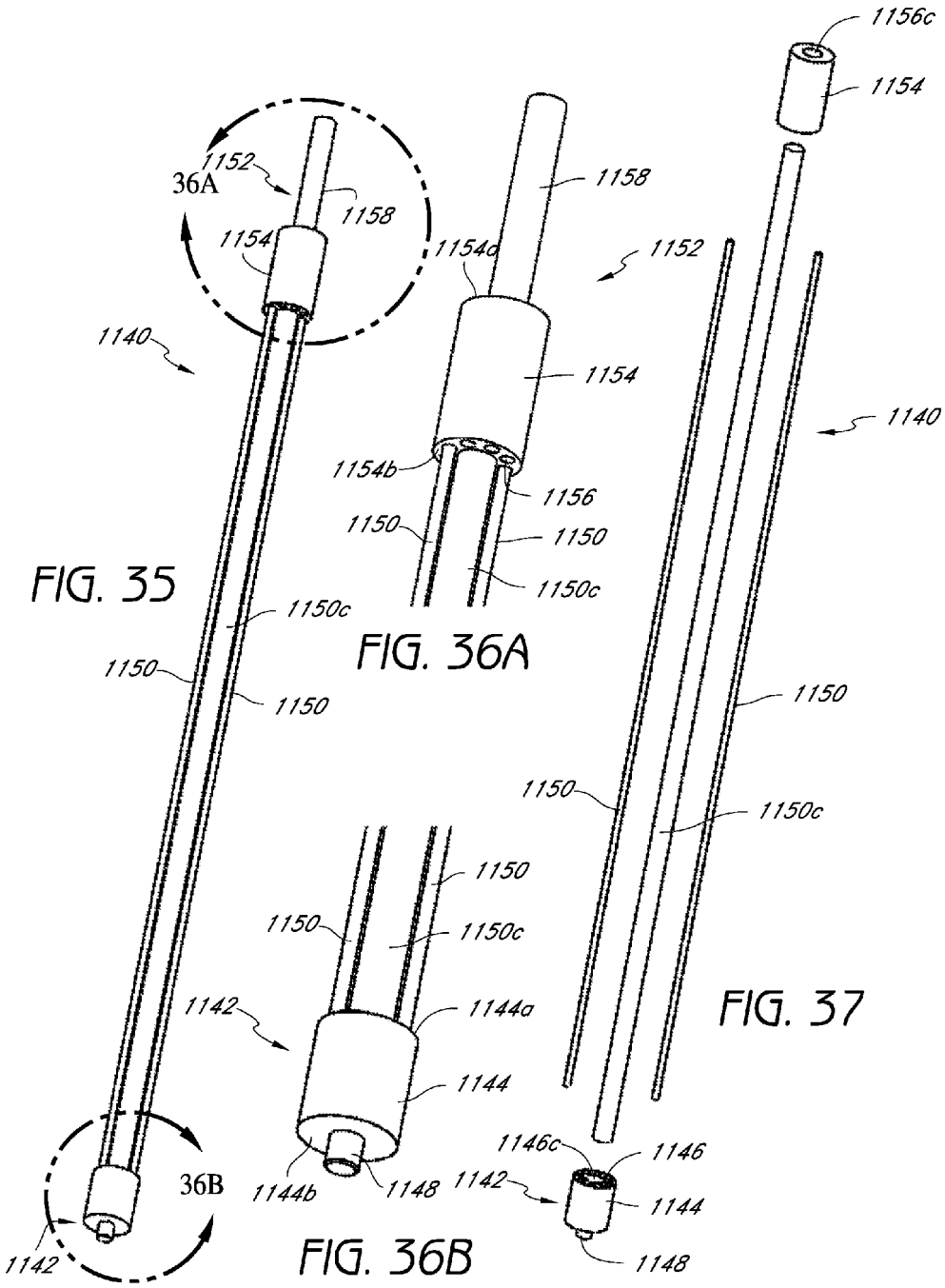
FIG. 35 is a perspective view of an embodiment of a resilient member.
FIG. 36A is an enlarged perspective view of a portion of the embodiment of the resilient member illustrated in FIG. 35 defined by curve 36A in FIG. 35.
FIG. 36B is an enlarged perspective view of a portion of the embodiment of the resilient member illustrated in FIG. 35 defined by curve 36B in FIG. 35.
FIG. 37 is an exploded perspective view of the embodiment of the resilient member illustrated in FIG. 35.
Figure 38B:
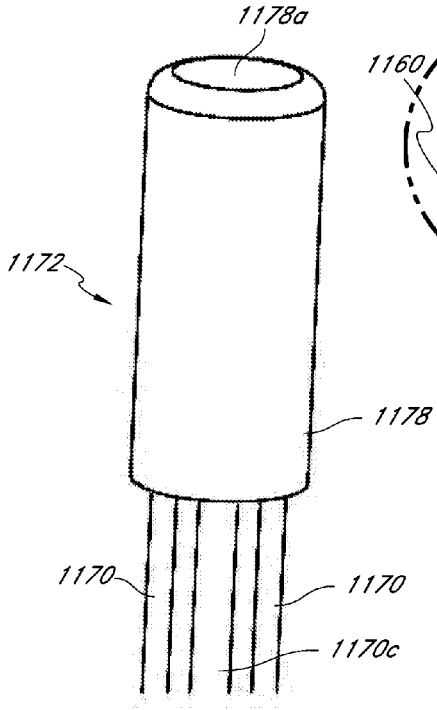
FIG. 38B is an enlarged perspective view of a portion of the embodiment of the resilient member illustrated in FIG. 38A defined by curve 38B in FIG. 38A.
Figure 38C:
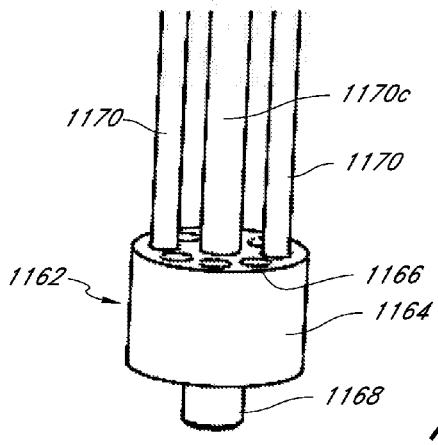
FIG. 38C is an enlarged perspective view of a portion of the embodiment of the resilient member illustrated in FIG. 38A defined by curve 38C in FIG. 38A.
Figure 38A:
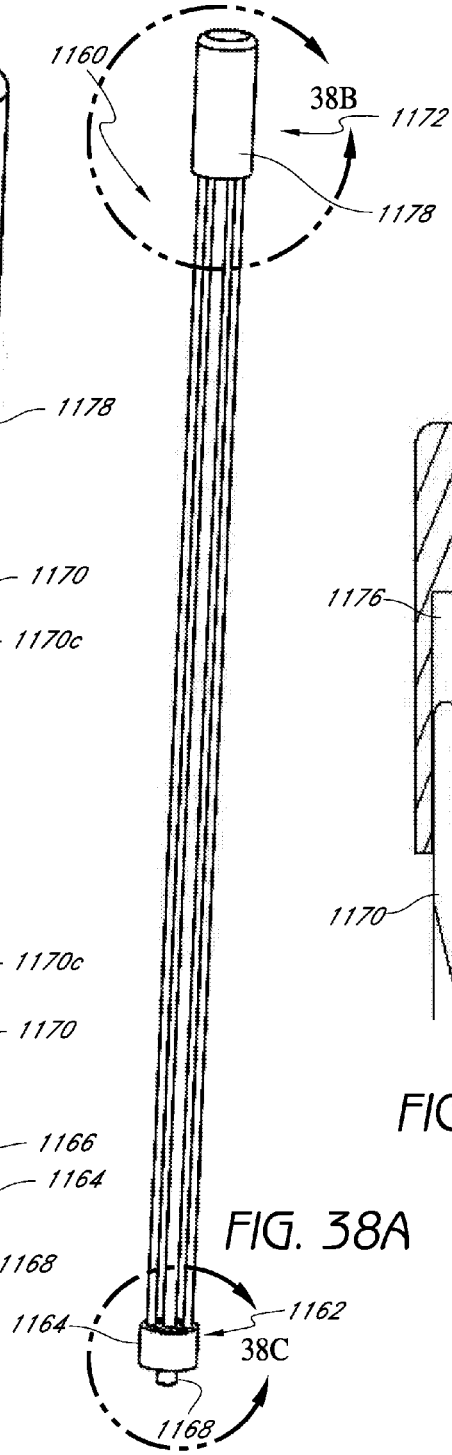
FIG. 38A is a perspective view of an embodiment of a resilient member.
Figure 38D:
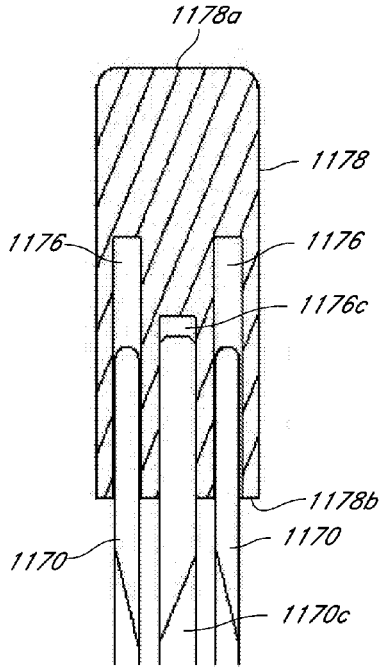
FIG. 38D is a section view of a portion of the embodiment of the resilient member illustrated in FIG. 38A taken through the axial center of such resilient member.

In the embodiment of the resilient member 162*a* illustrated in FIGS. 37 and 38, each insert 164 and each connection interface 156 can be threaded or comprise other suitable locking features so that, when the inserts 164 are inserted into the connection interfaces, the inserts 164 and, hence, the resilient members 162*a*, will not become inadvertently disengaged during use. Each insert 164 also serves another function—to provide a common interface with the connection interfaces. A resilient member with a non-circular cross-section could not be securely inserted into a cylindrical connection interface. An insert 164 with a circular cross-sectional portion can be affixed to the end of the non-circular resilient member so that the resilient member can be inserted into the cylindrical connection interface. Furthermore, an effective way to vary the resistance of the exercise can be to vary the cross-sectional thickness of the resilient member 164. Attaching an insert 164 with a portion that matches the geometry of the connection interfaces 156 to the end of each such varying resilient member would overcome the mismatch that would otherwise prevent the resilient members of varying cross-sectional configurations that do not match the configuration of the connection interfaces from inserting into the connection interfaces. Thus, each insert 164 provides an interface between the resilient member and the connection interfaces so that resilient members of varying diameter or cross-sectional geometry can be inserted in the same connection interface.

The embodiment of the resilient member 180 illustrated in FIGS. 28A-30C can comprise an insert member 182, one or more stiffening members 190, and a handle member 192. Each insert member 182 can comprise a retention portion 184 comprising a plurality of openings 186 through the top surface 184*a* that can be formed at a depth so as to not pass through the bottom surface 184*b* of the retention portion 184, and a connection portion 188 that can protrude from the bottom surface 184*b* of the retention portion 184. In some embodiments, the connection portion 188 can be an opening in the insert member 182 configured to be secured by a protrusion extending from the base or supporting base member. Additionally, the retention portion 184 and the connection portion 188 can be integrally formed from a single piece of material, or can be formed from multiple different pieces of the same or different material and joined together with welds, adhesive, screws, pins, threads, or other fastening means. In the illustrated embodiment, the retention portion 184 can be sized and configured to provide cantilever support to the first or lower end portion of each of a plurality of stiffening members 190 in each of the openings 186.

The retention portion 184 in the illustrated embodiment, or the retention portion in any embodiment described herein, can define a circular cross-section, but may define any suitable cross-section such as triangular, square, pentagonal, hexagonal, or other polygonal or desired shape. With the exception of the four openings 186 near the axial center of the insert member 182, the openings 186 can be sized and configured to define an inside surface that can be geometrically similar to, but slightly larger than, the end portion of the stiffening member 190 that can be supported in such opening 186 so that each of the stiffening members 190 can be removably inserted into each of those openings 186, yet sized and configured to eliminate excess lateral movement of the stiffening members 190 within the openings 186. Additionally, the retention portion in any embodiment described herein may comprise any desired or suitable number or configuration of openings.

However, in some embodiments, it can be preferred that the four stiffening members 190*c* positioned near the axial center of the insert member 182 be sufficiently tightly secured to the insert member 182 so that such stiffening members 190*c* cannot be inadvertently removed from the insert member 182 when the resilient members 180 are being used. Accordingly, in some embodiments, the four openings 186 positioned near the axial center of the insert member 182 can be sized and/or configured for a tight or even an interference fit with each of the four stiffening members 190*c* that are supported therein. Additionally, adhesive, screws, pins, threads, or other fastening means can be used to securely fasten each of the four stiffening members 190*c* positioned within each of the four openings 186 positioned at or near the axial center of the insert member 182 so as to prevent the stiffening members 190*c* from becoming removed from the openings 186 when an axial force is exerted on such stiffening members 190*c*.

In some embodiments, each opening 186 can define a circular cross-section. However, each opening 186 may define any suitable cross-section such as triangular, square, pentagonal, hexagonal, or other polygonal or desired shape. Similarly, the end portion of each of the stiffening members 190 that can be supported by each opening 186 can define a circular cross-section, but may define any suitable cross-section such as triangular, square, pentagonal, hexagonal, or other polygonal or desired shape.

Similarly, each handle member 198 can comprise a handle retention portion 194 comprising a plurality of openings 196 through the top surface 194*a* and the entire thickness of the handle retention portion 194. In the illustrated embodiment, the retention portion 194 can define a circular cross-section, but may define any suitable cross-section such as triangular, square, pentagonal, hexagonal, or other polygonal or desired shape. Each handle member 198 can also comprise a gripping portion 198 that can protrude axially from the top surface 194*a* of the handle retention portion 194. Additionally, in some embodiments, the holes 196*c* located near the axial center of the handle retention portion 194 can also penetrate through the bottom surface 194*b* of the handle member 198 and into a portion of the handle member 198 so as to align with the holes 196*c* located near the axial center of the handle retention portion 194.

In the illustrated embodiment, the handle retention portion 194 can be sized and configured to provide radial or lateral support to the upper end portion of each of a plurality of stiffening members 190 in each of the openings 196. In some embodiments, with respect to the stiffening members 190*c* located near the axial center of the handle retention portion 194, the handle retention portion 194 and openings 196 near the axial center of the handle retention portion 194 can be sized and configured to provide lateral, axial, and rotational support to the upper end portion of each of the four stiffening members 190*c* positioned near the axial center of the handle member 192 so as to restrain the stiffening members 190*c* from lateral, axial, and rotational movement relative to the handle member 192. Accordingly, in some embodiments, one or more of the four openings 196 positioned near the axial center of the handle member 192 can be sized and/or configured for a tight or even an interference fit with each of the four stiffening members 190*c* that are supported therein. Additionally, adhesive, screws, pins, threads, or other fastening means can be used to secure each of the four stiffening members 190*c* positioned within one or more of the four openings 196 positioned at or near the axial center of the insert member 192 so as to prevent the stiffening members 190*c* from becoming removed from the openings 196 when an axial force is exerted on such stiffening members 190*c*. Additionally, the handle retention portion in any embodiment described herein may comprise any desired or suitable number or configuration of openings, not limited to those described herein.

In some embodiments, with respect to the stiffening members 190*c* located near the axial center of the handle retention portion 194, the handle retention portion 194 can be sized and configured to provide lateral, axial, and rotational support to the upper end portion of only one of the four stiffening members 190*c* positioned near the axial center of the handle member 192. It may be preferable to provide axial support to only one of the stiffening members 190*c* located near the axial center of the handle retention portion 194 for a couple of reasons. First, it can be preferable to provide axial support to at least one of the stiffening members 190*c* located near the axial center of the handle retention portion 194 so that the handle member 192 will not become inadvertently removed from the stiffening members 190 when an axial force is exerted by a user on the handle member 192. Second, it may be preferable to permit three of the four centermost stiffening members 190 to freely translate in the axial direction because they are not collinear with the neutral bend axis (not shown) of the resilient member 180, but, rather, may be positioned off-center from the neutral bend axis (not shown). If each of the stiffening members 190 were axially restrained by the handle retention portion 194, because they are each offset from the neutral bend axis (not shown) of the resilient member 180, they may each experience an greatly increased stress when the resilient member 180 is deflected. This increased stress may cause each of such stiffening members 190 to buckle or to fail. However, the stiffening members 190 that are not axially restrained at their second portion can each have a neutral bend axis (not shown) that corresponds with their axial centerline, so as to avoid the heightened stresses that would otherwise be experienced by such stiffening members 190.

With the exception of the openings 196 for which axial restraint is desired, as discussed above, each of the other openings 196 can be sized and configured to define an inside surface that can be geometrically similar to, but slightly larger than, the end portion of the stiffening member 190 that can be supported in such opening 196 so that each of the stiffening members 190 can translate freely in the axial direction through each of those openings 196, yet sized and configured to eliminate excess lateral movement of the stiffening members 190 within the openings 196.

Figures 30A, 30B, 30C:
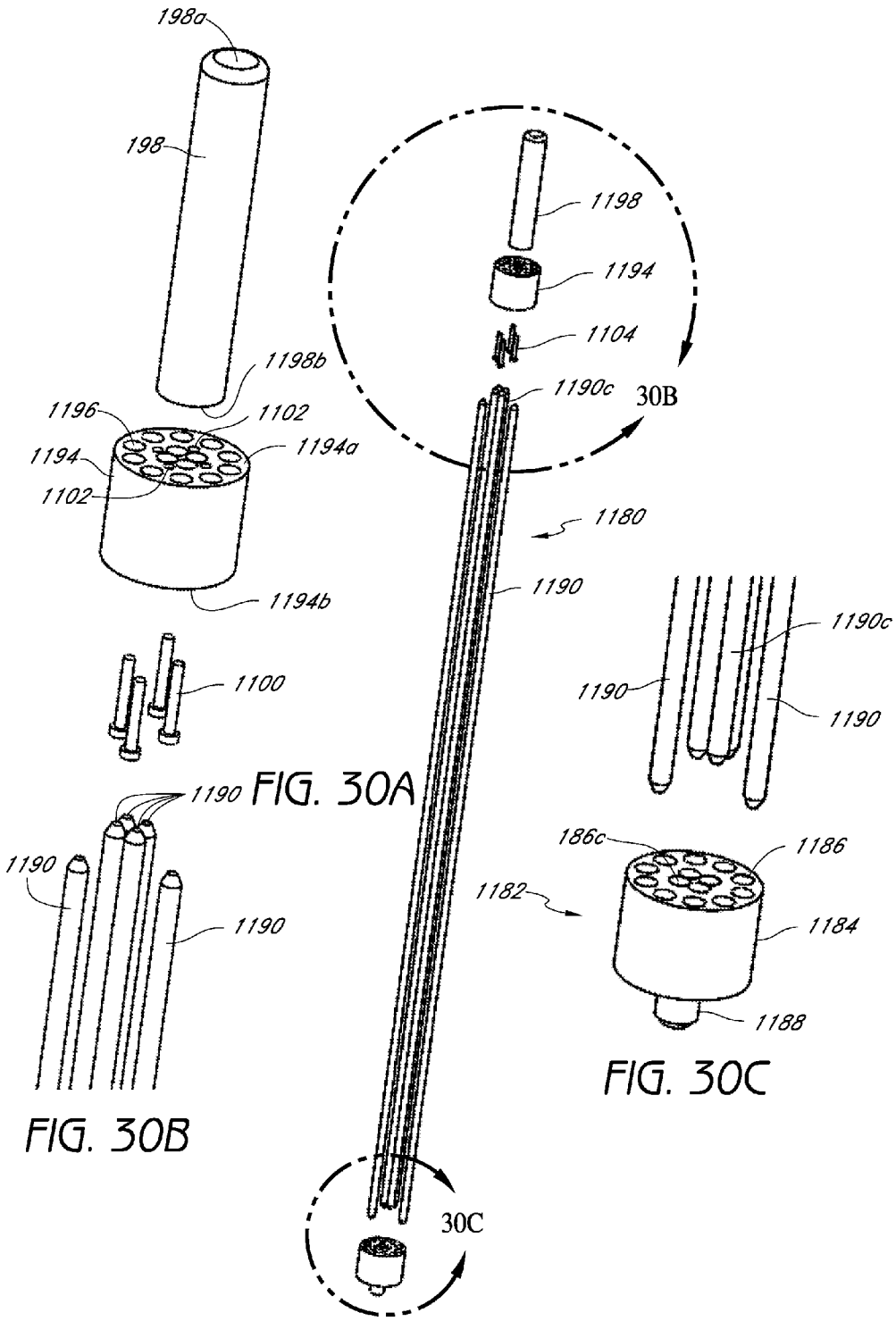
FIG. 30A is an exploded perspective view of the embodiment of the resilient member illustrated in FIG. 28A.
FIG. 30B is an enlarged perspective view of a portion of the embodiment of the resilient member illustrated in FIG. 30A defined by curve 30B in FIG. 30A.
FIG. 30C is an enlarged perspective view of a portion of the embodiment of the resilient member illustrated in FIG. 30A defined by curve 30C in FIG. 30A.

The handle member 198 can be secured to the handle retention portion 194 such that the bottom surface 194*b* of the handle member 198 can abut the top surface 194*a* of the handle retention portion 194. FIGS. 30A-30C are exploded perspective views of the embodiment of the resilient member illustrated in FIG. 28A. In the embodiment illustrated therein, the handle member 198 can be secured to the handle retention portion 194 by a plurality of bolts or screws 1100 passing through through-holes 1102 (that can be recessed) and threading into corresponding threaded holes (not shown) in the handle member 198. Alternatively, the handle member 198 can be secured to the handle retention portion 194 by any other suitable method, such as by, but not limited to, welds, fusion, or adhesion.

Figure 28B:
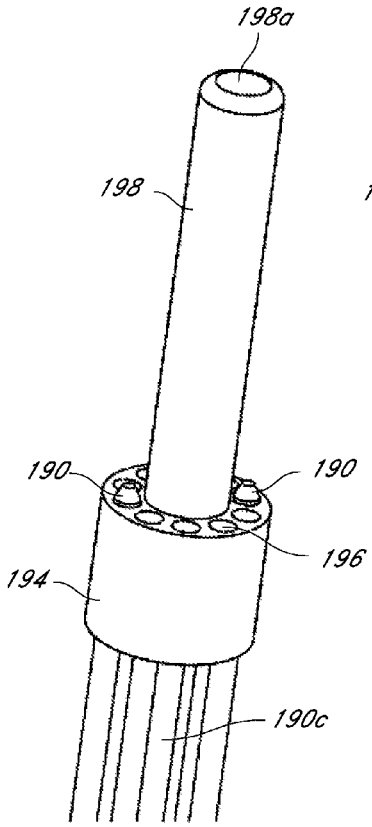
FIG. 28B is an enlarged perspective view of a portion of the embodiment of the resilient member illustrated in FIG. 28A defined by curve 28B in FIG. 28A.
Figure 28C:
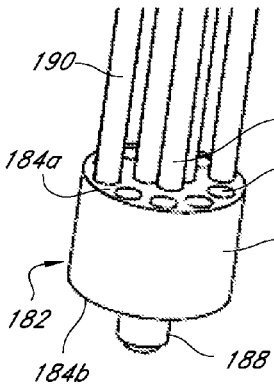
FIG. 28C is an enlarged perspective view of a portion of the embodiment of the resilient member illustrated in FIG. 28A defined by curve 28C in FIG. 28A.
Figure 28A:
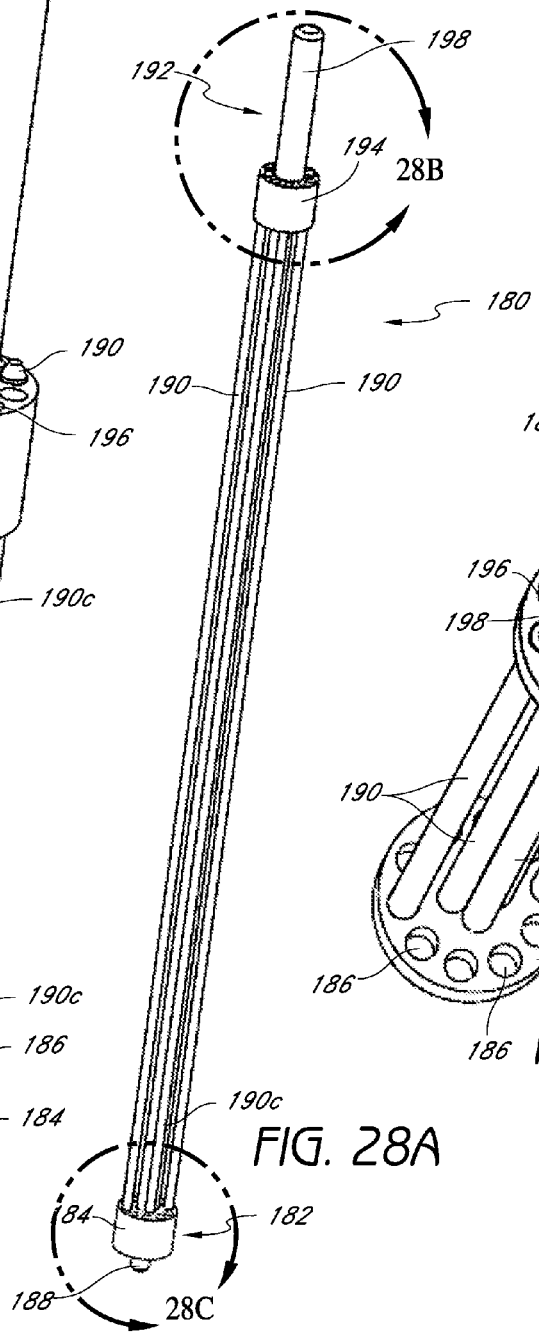
FIG. 28A is a perspective view of an embodiment of a resilient member.
Figure 29:
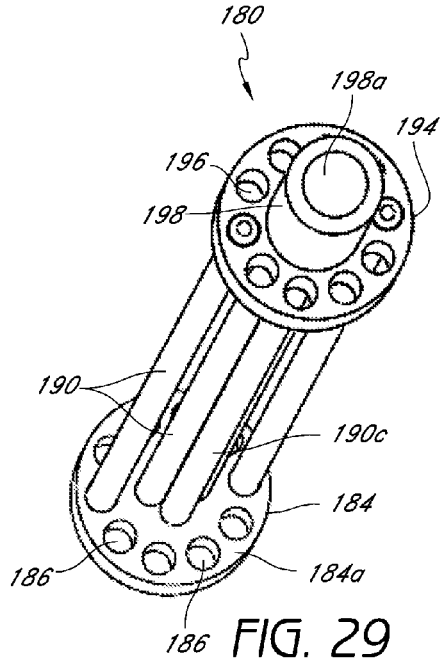
FIG. 29 is a perspective view of the embodiment of the resilient member illustrated in FIG. 28A.
Figure 31B:
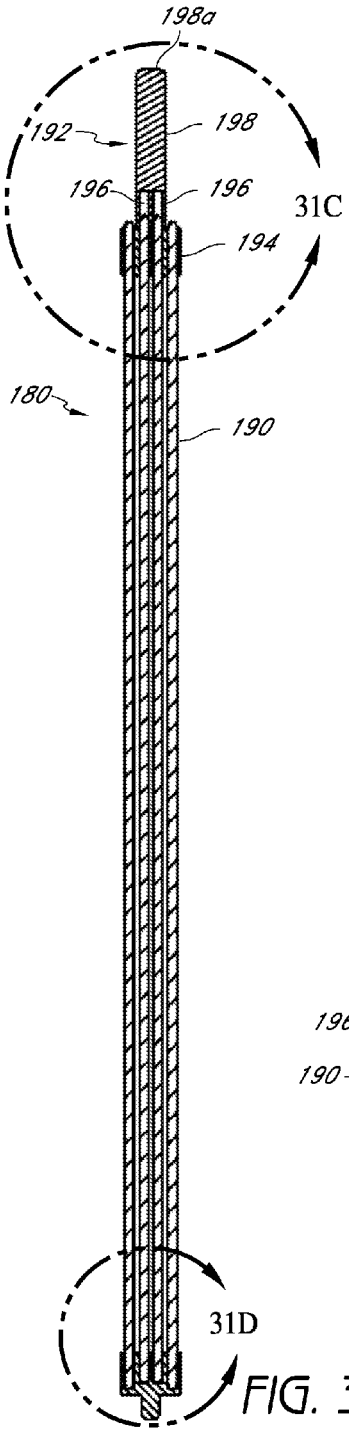
FIG. 31B is a section view of the embodiment of the resilient member illustrated in FIG. 31A taken along line 31B-31B in FIG. 31A.
Figure 31A:
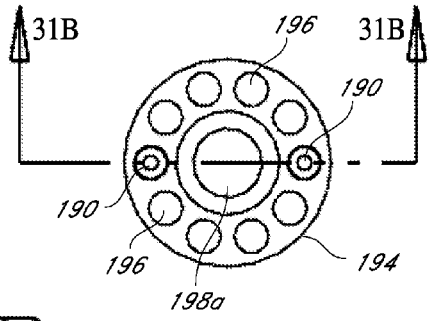
FIG. 31A is a top view of the embodiment of the resilient member illustrated in FIG. 28A.
Figure 31C:
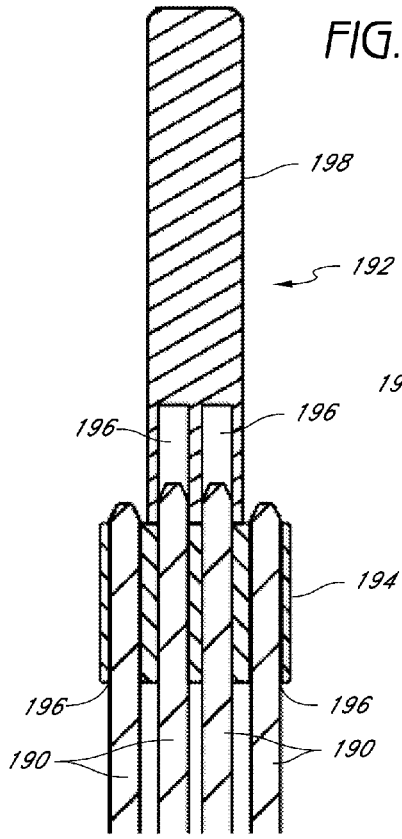
FIG. 31C is an enlarged section view of a portion of the embodiment of the resilient member illustrated in FIG. 31B defined by curve 31C in FIG. 31B.
Figure 31D:
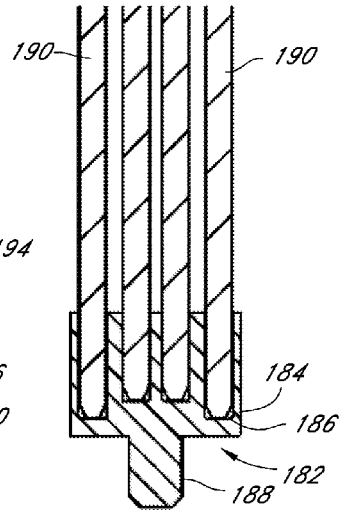
FIG. 31D is an enlarged section view of a portion of the embodiment of the resilient member illustrated in FIG. 31B defined by curve 31D in FIG. 31B.

FIG. 31B is a section view of the embodiment of the resilient member illustrated in FIG. 28A taken along line 31B-31B in FIG. 31A. As illustrated therein, the openings 196 in the handle member 198 can be sized such that, if axial restraint of the stiffening members 190*c* located near the axial center of the handle member 192 is not desired, there can be sufficient space for the stiffening members 190*c* to translate axially therein. Additionally, as illustrated therein, each of the stiffening members 190 can define a chamfer at both of the endmost edges to facilitate the insertion of such stiffening members 190 into the respective openings 186, 196.

Figures 32A, 32B, 32C, 32D:
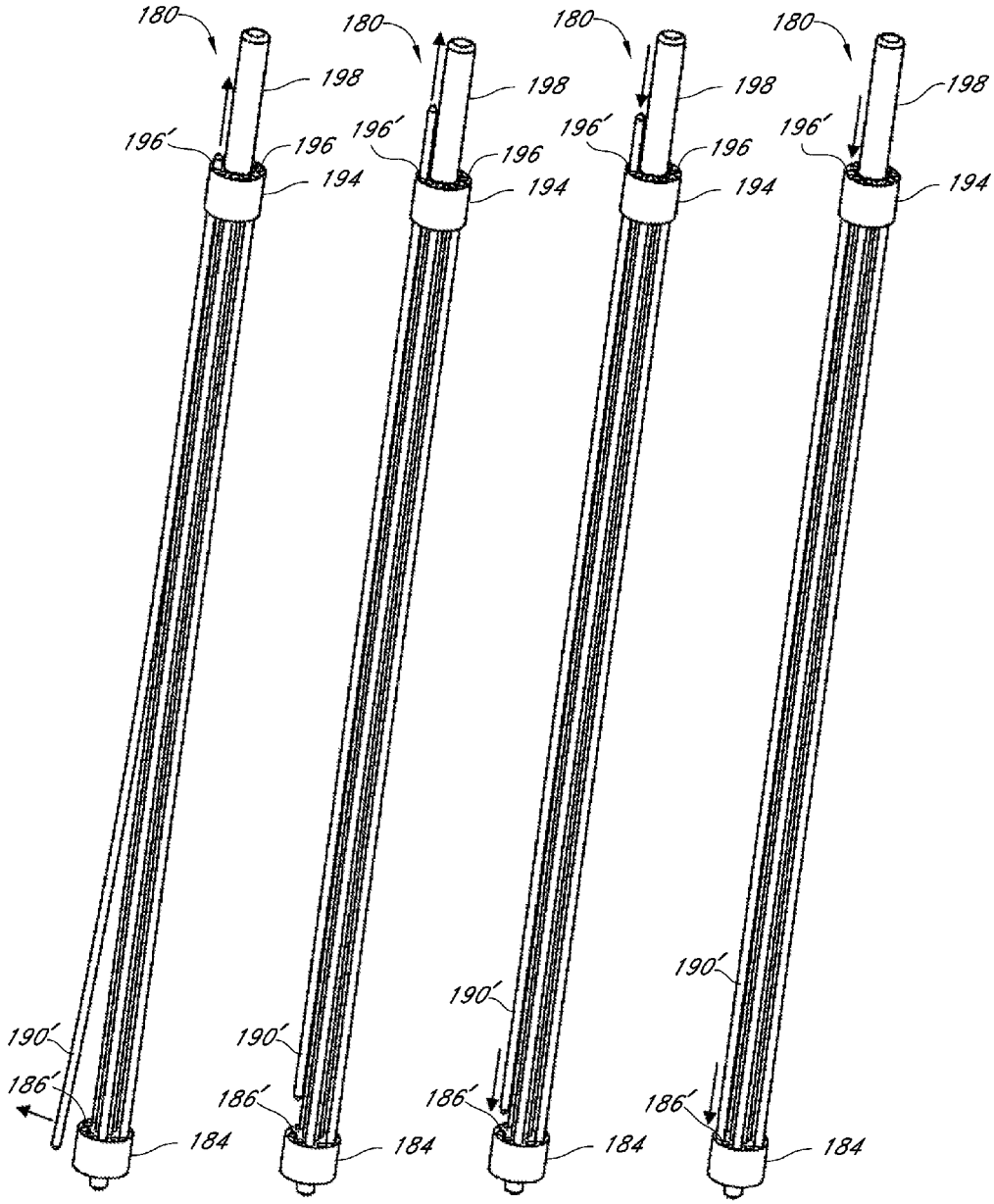
FIGS. 32A-32D are perspective views of the embodiment of the resilient member illustrated in FIG. 28A, illustrating the addition of an embodiment of a stiffening member to such resilient member.
Figure 33:
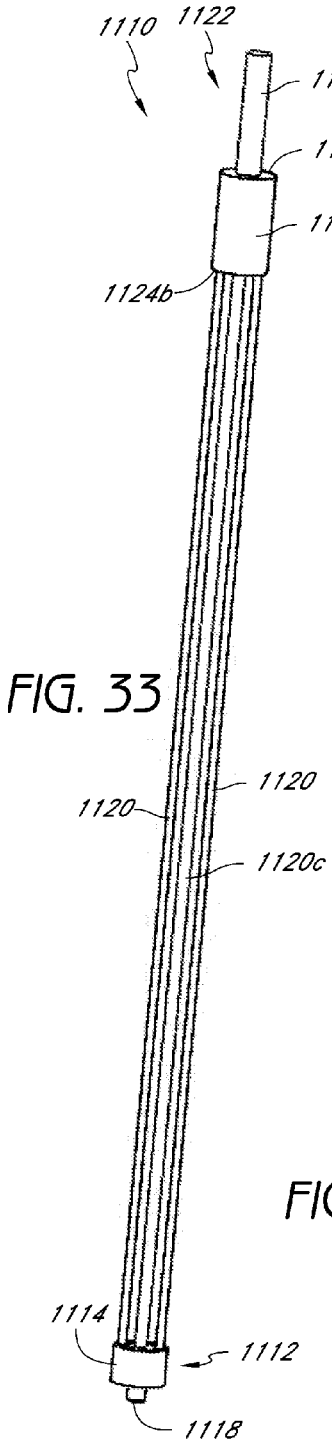
FIG. 33 is a perspective view of an embodiment of a resilient member.

FIGS. 32A-32D are perspective views of the embodiment of the resilient member 180 illustrated in FIG. 28A, illustrating the addition of an embodiment of a stiffening member 190 to such resilient member 180. As illustrated in FIG. 32A, the upper portion of the embodiment of the stiffening member 190' that is desired to be installed in the resilient member 180 can be first inserted through the opening 196' in the handle retention portion 194 in the upward direction. The bottom portion of the stiffening member 190' can be deflected outward due to the interference with the retention portion 184. As illustrated in FIG. 32B, the stiffening member 190' can be continued to be translated axially upward through the opening 196' in the handle retention portion 194 far enough such that the bottom edge of the stiffening members 190' can be above the top surface 184*a* of the retention portion 184. The bottom portion of the stiffening member 190' can be then allowed to straighten so that it can be inserted in the desired opening 186' in the retention portion 184. As illustrated in FIG. 32C, the stiffening member 190' can be translated axially downward through the opening 196' in the handle retention portion 194 such that the bottom portion of the stiffening member 190' can be translated downward into the opening 186' of the retention portion 184. As illustrated in FIG. 32D, the stiffening member 190' can be continued to be translated axially downward through the opening 196' in the handle retention portion 194 until the bottom portion of the stiffening member 190' can be fully engaged in the opening 186' of the retention portion 184. The resilient member 180 with the additional stiffening member 190' can be then ready to be used.

FIGS. 33 and 34A-34C are a perspective view and section views, respectively, of another embodiment of a resilient member 1110. The embodiment of the resilient member 1110 illustrated in FIGS. 33 and 34A-34C can comprise an insert member 1112, one or more stiffening members 1120, and a handle member 1122. Each insert member 1112 can comprise a retention portion 1114 comprising a plurality of openings 1116 through the top surface 1114*a* that can be at a depth so as to not pass through the bottom surface 1114*b* of the retention portion 1114, and a connection portion 1118 that can protrude from the bottom surface 1114*b* of the retention portion 1114. In the illustrated embodiment, the retention portion 1114 can be sized and configured to provide cantilever support to the lower end portion of each of a plurality of stiffening members 1120 in each of the openings 1116. In the illustrated embodiment, the retention portion 1114 can define a circular cross-section, but may define any suitable cross-section such as triangular, square, pentagonal, hexagonal, or other polygonal or desired shape. With the exception of the opening 1116 at or near the axial center of the insert member 1112, the openings 1116 can be sized and configured to define an inside surface that can be geometrically similar to, but slightly larger than, the end portion of the stiffening member 1120 that can be supported in such opening 1116 so that each of the stiffening members 1120 can be removably inserted into each of those openings 1116, yet sized and configured to eliminate excess lateral movement of the stiffening members 1120 within the openings 1116.

However, in some embodiments, it can be preferred that the centermost stiffening member 1120*c* be sufficiently tightly supported by the insert member 1112 so that such stiffening members 1120*c* cannot be inadvertently removed from the insert member 1112 when the resilient members 1110 are being used. Accordingly, in some embodiments, the centermost opening 1116 can be sized and/or configured for a tight or even an interference fit with the stiffening member 1120*c* that can be supported therein. Additionally, the centermost stiffening member 1120*c* can be secured to the centermost opening 1116*c* as described above so as to prevent the inadvertent removal of the stiffening member 1120*c* when an axial force is exerted thereon. The stiffening members 1120 can be of any geometry, material, or size as disclosed above. In the embodiment illustrated in FIGS. 34A-34C, the centermost stiffening member 1120*c* can be sized to have a larger cross-sectional area and, hence, to be stiffer than the radially positioned stiffening members 1120.

The handle member 1122 can comprise a handle retention portion 1124 and a gripping portion 1128. In the illustrated embodiment, the handle retention portion 1124 can be sized and configured to provide radial or lateral to the upper end portion of each of a plurality of stiffening members 1120 that can be positioned in each of the openings 1126. In some embodiments, as in the illustrated embodiment, the openings 1126 in the handle retention portion 1124 can be formed so as to not penetrate through the top surface of the handle retention portion 1124. In some embodiments, with respect to the centermost stiffening member 1120*c*, the centermost opening 1126*c* in the gripping portion 1128 can be sized and configured to provide lateral, axial, and rotational support to the upper end portion of the centermost stiffening member 1120*c* so as to restrain the stiffening member 1120*c* from lateral, axial, and rotational movement relative to the gripping portion 1128. Accordingly, in some embodiments, the centermost opening 1126*c* in the gripping portion 1128 can be sized and/or configured for a tight or even an interference fit with the stiffening member 1120*c* that can be supported therein. Additionally, the stiffening member 1120*c* positioned within the centermost opening 1126*c* can be fastened as described above so as to prevent the stiffening member 1120*c* from becoming inadvertently removed from the opening in the handle gripping portion 1128 when an axial force can be exerted on the gripping portion 1128.

Figure 34A:
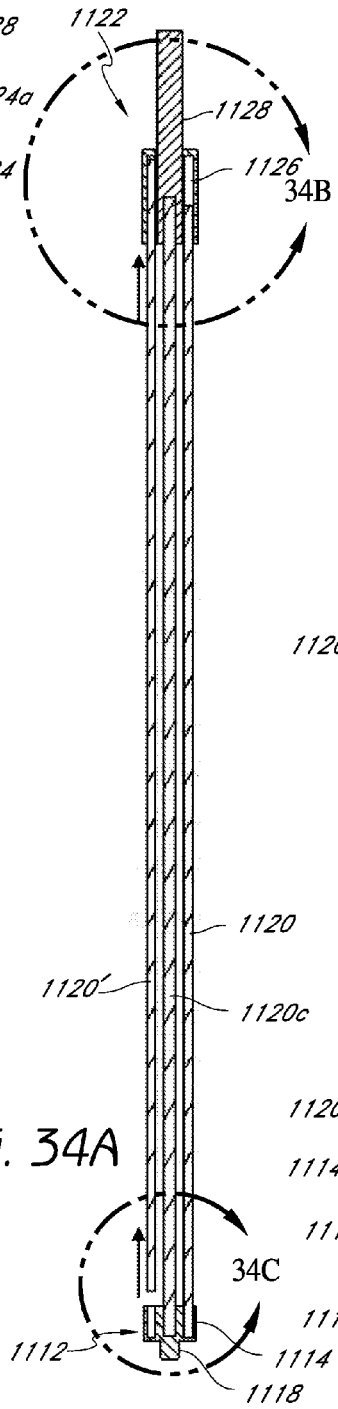
FIG. 34A is a section view of the embodiment of the resilient member illustrated in FIG. 33 taken through the axial center of such resilient member.
Figure 34B:
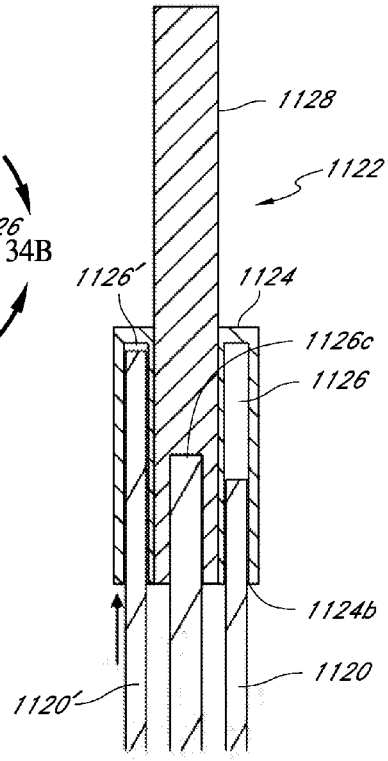
FIG. 34B is an enlarged section view of a portion of the embodiment of the resilient member illustrated in FIG. 34A defined by curve 34B in FIG. 34A.

As is illustrated most clearly in FIG. 34B, the gripping portion 1128 can be positioned within an axial opening in the center of the retention portion 1124. The gripping portion 1128 can be secured to the retention portion 1124 by any suitable method or mechanism, such as by, but not limited to, pins, rivets, bolts, screws, welds, adhesive, or other suitable forms of fusion or adhesion. Additionally, referring to FIG. 34B, the retention portion 1124, the radially positioned openings 1126 (i.e., the openings 1126 surrounding the centermost opening 1126*c*), and the stiffening members 1120 are each sized so as to permit the stiffening members 1120 to translate axially within such openings 1126 without interference from the inside top surface of the opening 1126 when the resilient member 1110 can be deflected during use.

In some embodiments, the gripping portion 1128 can be made from plastic, steel, aluminum, fiberglass, or any other material (that can be rigid) or composite thereof. Similarly, in some embodiments, the retention portion 1124 can be made from plastic, steel, aluminum, fiberglass, or any other material (that can be rigid) or composite thereof, and can be comprised of a material that has beneficial lubrication properties or a low coefficient of friction so as to permit the stiffening member or members 1120 secured by the retention portion 1124 to axially translate substantially freely relative to the retention portion 1124 when the resilient member 1110 is deflected.

Figure 34C:
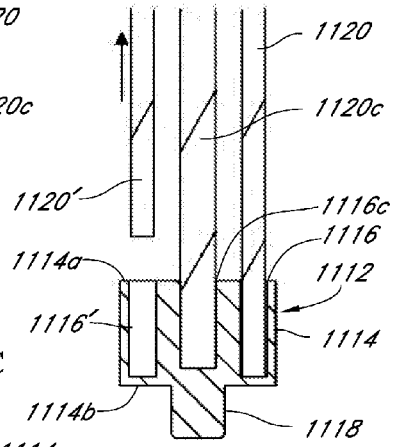
FIG. 34C is an enlarged section view of a portion of the embodiment of the resilient member illustrated in FIG. 34A defined by curve 34C in FIG. 34A.

Further, as illustrated in FIGS. 34A-34C, the radially positioned openings 1126 can be configured so as to allow a user to easily add or remove a stiffening member 1120' from the resilient member 1110. To add or remove a stiffening member 1120' from the resilient member 1110, a user can first insert the upper portion of the desired stiffening member 1120' into the desired opening 1126' in an upward direction until the bottom edge of the stiffening member 1120' can be higher than the top surface 1114*a* of the insert member 1112. The user then inserts the bottom portion of the stiffening member 1120' all the way down into the corresponding opening 1116' in the retention portion 1114.

FIGS. 35A-36B, and 37 are perspective views and an exploded view, respectively, of another embodiment of a resilient member 1140. The embodiment of the resilient member 1140 illustrated in FIGS. 35-37 can comprise an insert member 1142, one or more stiffening members 1150, and a handle member 1152. Each insert member 1142 can comprise a retention portion 1144 comprising a plurality of openings 1146 through the top surface 1144*a*, that can be at a depth so as to not pass through the bottom surface 1144*b* of the retention portion 1144, and a connection portion 1148 that can protrude from the bottom surface 1144*b* of the retention portion 1144.

In the illustrated embodiment, the retention portion 1144 can be sized and configured to provide cantilever support to the lower end portion of each of a plurality of stiffening members 1150 in each of the openings 1146. In the illustrated embodiment, the retention portion 1144 can define a circular cross-section, but may define any suitable cross-section such as triangular, square, pentagonal, hexagonal, or other polygonal or desired shape. With the exception of the opening 1146*c* at or near the axial center of the insert member 1142, the openings 1146 can be sized and configured to define an inside surface that can be geometrically similar to, but slightly larger than, the end portion of the stiffening member 1150 that can be supported in such opening 1146 so that each of the stiffening members 1150 can be removably inserted into each of those openings 1146, yet sized and configured to eliminate excess lateral movement of the stiffening members 1150 within the openings 1146.

However, it can be preferred that the centermost stiffening member 1150*c* be sufficiently tightly secured to the insert member 1142 so that such stiffening members 1150*c* cannot be inadvertently removed from the insert member 1142 when the resilient members 1140 are being used. Accordingly, in some embodiments, the centermost opening 1146 can be sized and/or configured for a tight or even an interference fit with the stiffening member 1150*c* that can be supported therein. Additionally, the centermost stiffening member 1150*c* can be secured to the centermost opening 1146*c* as described above so as to prevent the inadvertent removal of the stiffening member 1150*c* when an axial force can be exerted thereon. The stiffening members 1150 can be of any geometry, material, or size as disclosed above. In the embodiment illustrated in FIGS. 35-37, the centermost stiffening member 1150*c* can be sized to have a larger cross-sectional area and, hence, to be stiffer than the radially positioned stiffening members 1150.

In the illustrated embodiment, the handle member 1152 can be comprised of a handle retention portion 1154 and a gripping portion 1158. The handle retention portion 1154 can be sized and configured to provide radial or lateral to the upper end portion of each of a plurality of stiffening members 1150 that can be positioned in each of the openings 1156. In some embodiments, as in the illustrated embodiment, the openings 1156 in the handle retention portion 1154 can be configured so as to penetrate through the top surface of the handle retention portion 1154. In some embodiments, with respect to the centermost stiffening member 1150*c*, the centermost opening 1156*c* in the retention portion 1154 can be sized and configured to provide lateral, axial, and rotational support to the upper end portion of the centermost stiffening member 1150*c* so as to restrain the stiffening member 1150*c* from lateral, axial, and rotational movement relative to the retention portion 1154. Accordingly, in some embodiments, the centermost opening 1156*c* in the retention portion 1154 can be sized and/or configured for a tight or even an interference fit with the stiffening member 1150*c* that can be supported therein. Additionally, the stiffening member 1150*c* positioned within the centermost opening 1156*c* can be fastened as described above so as to prevent the retention portion 1154 from inadvertently moving or rotating relative to the stiffening member 1150*c* when an axial force is exerted on the handle gripping portion 1158 or retention portion 1154.

As shown most clearly in FIG. 38, in this embodiment, the gripping portion 1158 can be essentially the upper portion of the centermost stiffening member 1150*c* that has passed through a center opening in the retention portion 1154. Additionally, referring to FIG. 36A, the retention portion 1154, the radially positioned openings 1156, and the stiffening members 1150 are each sized so as to permit the stiffening members 1150 to translate axially within such openings 1156 without interference from the inside top surface of the opening 1156 when the resilient member 1140 is deflected during use.

In the illustrated embodiment, the gripping portion 1158, which can be the upper portion of the stiffening member 1150*c*, can be made from a resilient material such as nylon, Delrin, polyvinyl chloride, or other suitable polymers, resilient materials, or fiber-based materials, such as fiberglass or glass-filled polymers. Similarly, in some embodiments, the retention portion 1154 can be made from plastic, steel, aluminum, fiberglass, or any other material (that can be rigid) or composite thereof, and can be comprised of a material that has beneficial lubrication properties or a low coefficient of friction so as to permit the stiffening member or members 1150 secured by the retention portion 1154 to axially translate substantially freely relative to the retention portion 1154 when the resilient member 1140 is deflected.

Further, as with the resilient member 1110 described above, the radially positioned openings 1156 are configured so as to allow a user to easily add or remove a stiffening member 1150 from the resilient member 1140. To add or remove a stiffening member 1150 from the resilient member 1140, a user can first insert the upper portion of the desired stiffening member 1150 into the desired opening 1156 in an upward direction until the bottom edge of the stiffening member 1150 can be higher than the top surface 1144*a* of the insert member 1142. The user then inserts the bottom portion of the stiffening member 1150 all the way down into the corresponding opening 1156 in the retention portion 1144.

FIGS. 38A-38C, and 38D are perspective views and a section view, respectively, of another embodiment of a resilient member 1160. The embodiment of the resilient member 1160 illustrated in FIGS. 38A-38D can comprise an insert member 1162, one or more stiffening members 1170, and a handle member 1172. Each insert member 1162 can comprise a retention portion 1164 comprising a plurality of openings 1166 through the top surface 1164*a*, that can be at a depth so as to not pass through the bottom surface 1164*b* of the retention portion 1164, and a connection portion 1168 that can protrude from the bottom surface 1164*b* of the retention portion 1164. In the illustrated embodiment, the retention portion 1164 can be sized and configured to provide cantilever support to the lower end portion of each of a plurality of stiffening members 1170 in each of the openings 1166. In the illustrated embodiment, the retention portion 1164 can define a circular cross-section, but may define any suitable cross-section such as triangular, square, pentagonal, hexagonal, or other polygonal or desired shape. In some embodiments, with the exception of the opening 1166*c* at or near the axial center of the insert member 1162, the openings 1166 can be sized and configured to define an inside surface that can be geometrically similar to, but slightly larger than, the end portion of the stiffening member 1170 that can be supported in such opening 1166 so that each of the stiffening members 1170 can be removably inserted into each of those openings 1166, yet sized and configured to eliminate excess lateral movement of the stiffening members 1170 within the openings 1166.

However, the centermost stiffening member 1170*c* can be sufficiently tightly secured to the insert member 1162 so that such stiffening members 1170*c* can be not inadvertently removed from the insert member 1162 when the resilient members 1160 are being used. Accordingly, in some embodiments, the centermost opening 1166*c* can be sized and/or configured for a tight or even an interference fit with the stiffening member 1170*c* that can be supported therein. Additionally, in some embodiments, the centermost stiffening member 1170*c* can be secured to the centermost opening 1166*c* as described above so as to prevent the inadvertent removal of the stiffening member 1170*c* when an axial force is exerted thereon. The stiffening members 1170 can be of any geometry, material, or size as disclosed above. In the embodiment illustrated in FIGS. 38A-38D, the centermost stiffening member 1170*c* can be sized to have a larger cross-sectional area and, hence, to be stiffer than the radially positioned stiffening members 1170.

In the illustrated embodiment, a handle member 1172 can comprise only a gripping portion 1178, which can also be configured to provide lateral and/or axial restraint to one or more stiffening members 1170. In the illustrated embodiment, the openings 1176 in the gripping portion 1178 can be configured so as to not penetrate through the top surface of the gripping portion 1178. In some embodiments, with respect to the centermost stiffening member 1170*c*, the centermost opening 1176*c* in the gripping portion 1178 can be sized and configured to provide lateral, axial, and rotational support to the upper end portion of the centermost stiffening member 1170*c* so as to restrain the stiffening member 1170*c* from lateral, axial, and rotational movement relative to the gripping portion 1178. Accordingly, in some embodiments, the centermost opening 1176*c* in the gripping portion 1178 can be sized and/or configured for a tight or even an interference fit with the stiffening member 1170*c* that can be supported therein. Additionally, the stiffening member 1170*c* positioned within the centermost opening 1176*c* can be fastened as described above so as to prevent the stiffening member 1170*c* from becoming inadvertently removed from the opening in the gripping portion 1178 when an axial force is exerted on the gripping portion 1178.

In the illustrated embodiment, the gripping portion 1178 can be made from a substantially rigid material such as plastic, steel, aluminum, fiberglass, or any other material (that can be rigid) or composite thereof, and can be comprised of a material that has beneficial lubrication properties or a low coefficient of friction so as to permit the stiffening member or members 1170 secured by the retention portion 1174 to axially translate substantially freely relative to the retention portion 1174 when the resilient member 1160 is deflected. Alternatively, the gripping portion 1178 can be comprised of any suitable material regardless of lubrication or frictional properties, and the openings 1176, or the openings of any embodiment of the gripping portion described herein, can be coated or lined with a material having beneficial frictional or lubrication properties.

Further, as with the resilient member 1110 described above, the radially positioned openings 1176 can be configured so as to allow a user to easily add or remove a stiffening member 1170 from the resilient member 1160. To add or remove a stiffening member 1170 from the resilient member 1160, a user can first insert the upper portion of the desired stiffening member 1170 into the desired opening 1176 in an upward direction until the bottom edge of the stiffening member 1170 can be higher than the top surface 1164*a* of the insert member 1162. The user then inserts the bottom portion of the stiffening member 1170 all the way down into the corresponding opening 1166 in the retention portion 1164.

Figure 40:
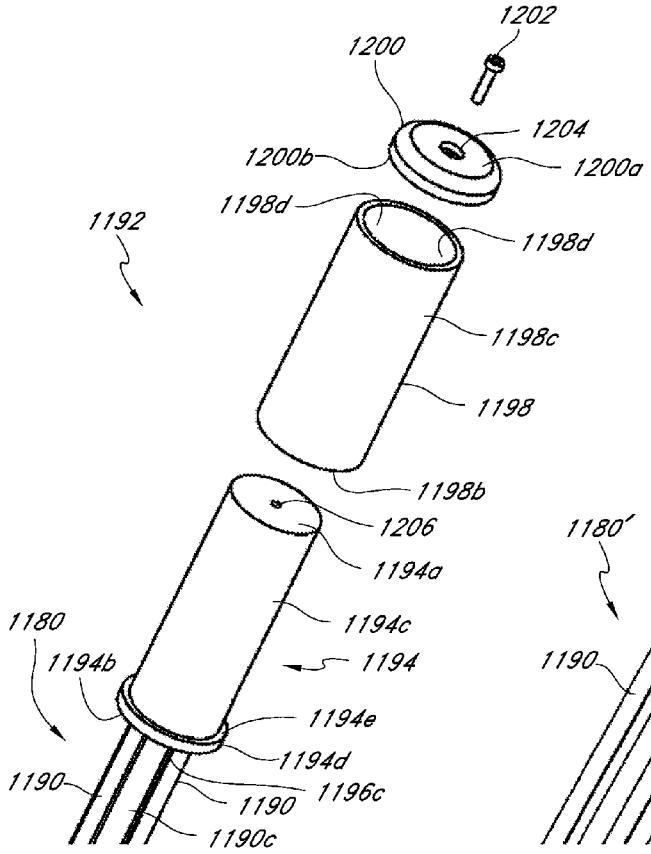
FIG. 40 is an exploded perspective view of the portion of the embodiment of the resilient member illustrated in FIG. 39B.

FIGS. 39A-39C and 40 are perspective views and an exploded perspective view, respectively, of another embodiment of a resilient member 1180. The embodiment of the resilient member 1180 illustrated in FIGS. 39A-40 can be similar to the embodiment of the resilient member 1160 described above, except that, in some embodiments, the handle member 1192 can be configured to provide a substantially freely rotating gripping portion 1196. As illustrated in FIG. 40, the handle member 1192 can be comprised of a handle retention portion 1194 and a gripping portion 1198.

The handle retention portion 1194 can be sized and configured to provide radial or lateral to the upper end portion of each of a plurality of stiffening members 1190 that can be positioned in each of the openings 1196. In the illustrated embodiment, the openings 1196 in the handle retention portion 1194 do not penetrate through the top surface of the handle retention portion 1194. In some embodiments, with respect to the centermost stiffening member 1190*c*, the centermost opening 1196*c* in the retention portion 1194 can be sized and configured to provide lateral, axial, and rotational support to the upper end portion of the centermost stiffening member 1190*c* so as to restrain the stiffening member 1190*c* from lateral, axial, and rotational movement relative to the retention portion 1194. Accordingly, in some embodiments, the centermost opening 1196*c* in the retention portion 1194 can be sized and/or configured for a tight or even an interference fit with the stiffening member 1190*c* that can be supported therein. Additionally, the stiffening member 1190*c* positioned within the centermost opening 1196*c* can be fastened as described above so as to prevent the stiffening member 1190*c* from becoming inadvertently removed from the opening in the retention portion 1194 when an axial force is exerted on the handle retention portion 1194.

As is illustrated most clearly in FIG. 40, the handle retention portion 1194 can define a cylindrical outer surface 1194*c* that can be sized and configured to be similar to, but slightly smaller in diameter than, the inside surface 1198*d* of the gripping portion 1198 so that, when the gripping portion 1198 can be inserted over the outside surface 1194*c* of the handle retention portion 1194, the gripping portion 1198 can be substantially free to rotate about the handle retention portion 1194. An extended portion 1194*d* of the handle retention portion 1194 can be sized and configured to provide a supporting surface 1194*e*, to restrain the axial movement of the gripping portion 1198 in the downward direction, while not substantially inhibiting the rotational movement of the gripping portion 1198.

Similarly, a cap member 1200, which can be bolted or screwed to the top of the handle retention portion 1194 with bolt 1202 passing through opening 1204 in the cap member 1200 and threading into threaded hole 1206 in the handle retention portion 1194 such that the bottom surface 1200*b* of the cap member 1200 abuts and can be secured against the top surface 1194*a* of the handle retention portion 1194. However, the cap member 1200 may be secured to the handle retention portion 1194 by any suitable method. The cap member 1200 can be sized and configured to provide a supporting surface 1200*b* to restrain the axial movement of the gripping portion 1198 in the upward direction, while not substantially inhibiting the rotational movement of the gripping portion 1198. The gripping portion 1198, or any gripping portion described herein, can be made from plastic, rubber, aluminum, steel, fiberglass, or any other suitable material or combination or composite thereof.

Figure 41:
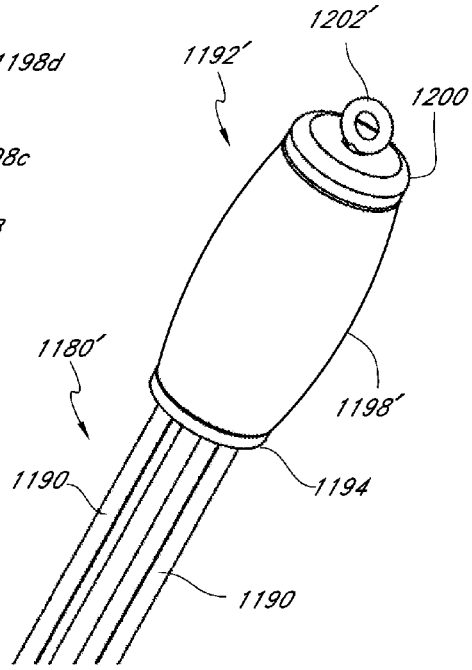
FIG. 41 is a perspective view of a portion of an embodiment of a resilient member.

FIG. 41 is a perspective view of a portion of an embodiment of a resilient member 1180' that can be similar to the resilient member 1180 described above, except for the following. First, the gripping portion 1198' of the handle member 1192' can define a curved outer surface. Further, the fastener 1202' used to secure the cap 1200 to the handle retention portion 1194 comprises a loop through which a handle or other alternative grip can be attached, either directly or with the use of a carabiner or other linking member.

FIGS. 42A-42C, and 43 are perspective views and an exploded perspective view, respectively, of another embodiment of a resilient member 1210. The embodiment of the resilient member 1210 illustrated in FIGS. 42A-43 can comprise an insert member 1212, one or more stiffening members 1220, and a handle member 1222. Each insert member 1212 can be similarly configured as compared to other embodiments of the insert members described above.

The handle member 1222 can comprise a handle retention portion 1224 comprising openings 1226. The handle member 1222 can also comprise a gripping portion 1228, and a sleeve member 1230. The gripping portion 1228 can be configured to fit within an opening 1224*d* in the handle retention portion 1224 in a similar fashion as described above with respect to resilient member 1110. The sleeve member 1230 can be size and configured such that the inner surface 1230*d* of the sleeve member 1230 has a similar size and shape as compared to, but slightly larger than, the outer surface 1224*c* of the handle retention portion 1224 so that the sleeve member 1230 can be inserted over the handle retention portion 1224. An extended portion 1224*e* of the handle retention portion 1224 can be sized and configured to provide a supporting surface 1224*f*, to restrain the axial movement of the sleeve member 1230 in the downward direction so that the bottom surface 1230*b* of the sleeve member 1230 does not move below the supporting surface 1224*f* of the handle retention portion 1224. Similar features or a similar or other suitable means can be used to prevent or inhibit the sleeve member 1230 from moving in the upward direction once the sleeve member 1230 can be positioned over the handle retention portion 1224.

In the illustrated embodiment, the openings 1226 can be configured so as to not penetrate through the top surface of the handle retention portion 1224. In some embodiments, with respect to the centermost stiffening member 1220*c*, the centermost opening 1226*c* in the gripping portion 1228 can be sized and configured to provide lateral, axial, and rotational support to the upper end portion of the centermost stiffening member 1220*c* so as to restrain the stiffening member 1220*c* from lateral, axial, and rotational movement relative to the gripping portion 1228. Accordingly, in some embodiments, the centermost opening 1226*c* in the gripping portion 1228 can be sized and/or configured for a tight or even an interference fit with the stiffening member 1220*c* that can be supported therein. Additionally, the stiffening member 1220*c* positioned within the centermost opening 1226*c* can be fastened as described above so as to prevent the stiffening member 1220*c* from becoming inadvertently removed from the opening 1226*c* in the handle gripping portion 1228 when an axial force is exerted on the gripping portion 1228.

Figures 42A, 42B, 42C, 43:
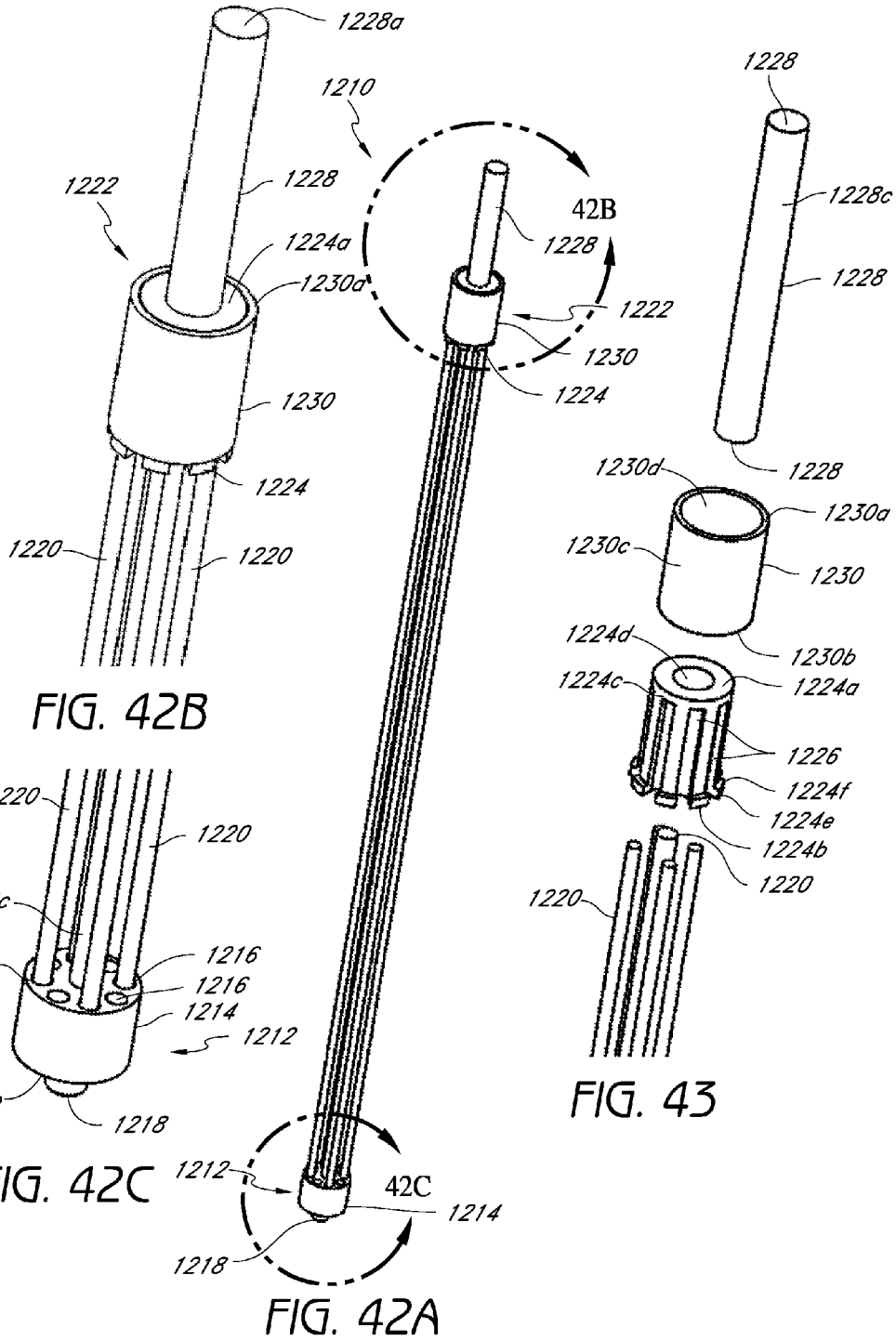
FIG. 42A is a perspective view of an embodiment of a resilient member.
FIG. 42B is an enlarged perspective view of a portion of the embodiment of the resilient member illustrated in FIG. 42A defined by curve 42B in FIG. 42A.
FIG. 42C is an enlarged perspective view of a portion of the embodiment of the resilient member illustrated in FIG. 42A defined by curve 42C in FIG. 42A.
FIG. 43 is an exploded perspective view of the portion of the embodiment of the resilient member illustrated in FIG. 42B.
Figures 44A, 44B, 44C:
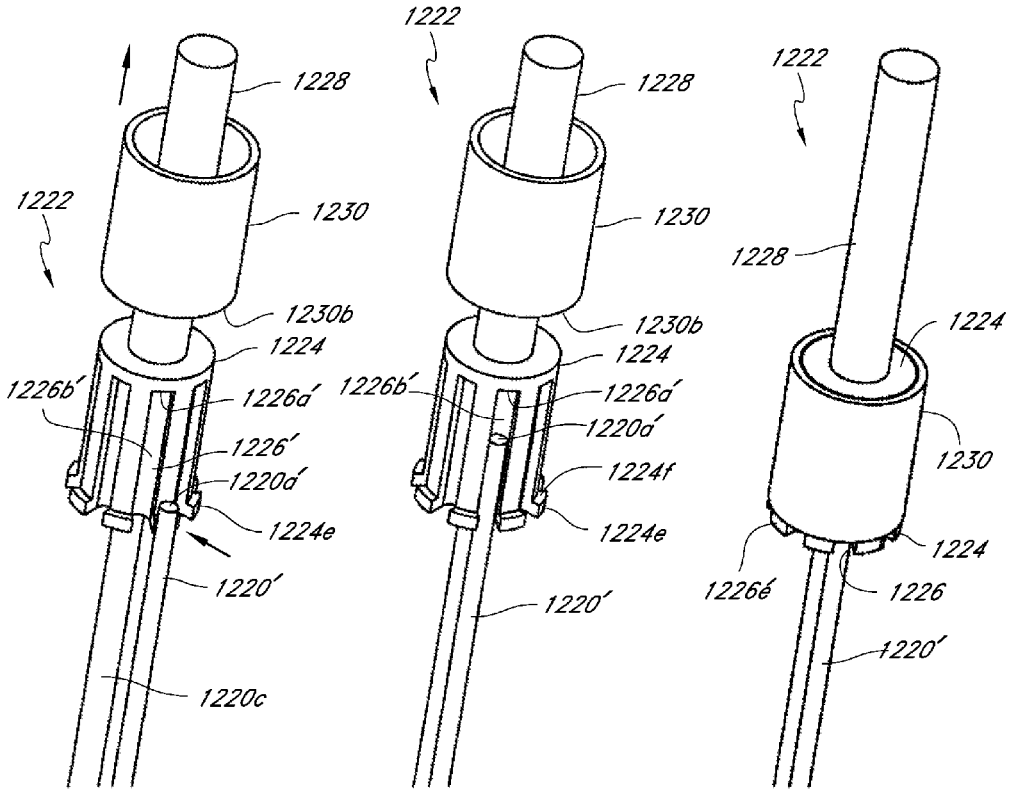
FIGS. 44A-44C are perspective views of the embodiment of the resilient member illustrated in FIG. 42A, illustrating the addition of an embodiment of a stiffening member to such resilient member.

FIGS. 44A-44C are perspective views of a portion of the embodiment of the resilient member 1210 illustrated in FIGS. 42A-43, illustrating the addition of an embodiment of a stiffening member 1220' to such resilient member 1210. As illustrated therein, the radially positioned openings 1226 can be configured so as to allow a user to easily add or remove a stiffening member 1220' from the resilient member 1210. In some embodiments, to add a stiffening member 1220' to the resilient member 1210, a user can first insert the bottom portion of the stiffening member 1220' into the desired opening 1216 in the insert member 1214 (not shown). The user then slides the sleeve member 1230 in the upward direction until the bottom surface 1230*b* of the sleeve member 1230 can be above the top surface 1220*a*' of the stiffening member 1220'. The user can then exert a lateral force on the top portion of the stiffening member 1220', as indicated by the arrow in FIG. 44A, to push the top portion of the stiffening member 1220' into the desired opening 1226' until the outer surface of the stiffening member 1220' abuts the inner surface 1226*b*' of the desired opening 1226', as illustrated in FIG. 44B. The user then slides the sleeve member 1230 in the downward direction until the bottom surface 1230*b* of the sleeve member 1230 abuts the supporting surface 1224*f* of the extended portion 1224*e* of the handle retention portion 1224, as illustrated in FIG. 44C. Additionally, the handle retention portion 1224 can be configured to, or can comprise features such as, but not limited to, detents or flexible tabs that bias or cause the stiffening members 1220 to be held within the openings 1226 during the period of time that the sleeve member 1230 can be slid upward.

Figure 45A:
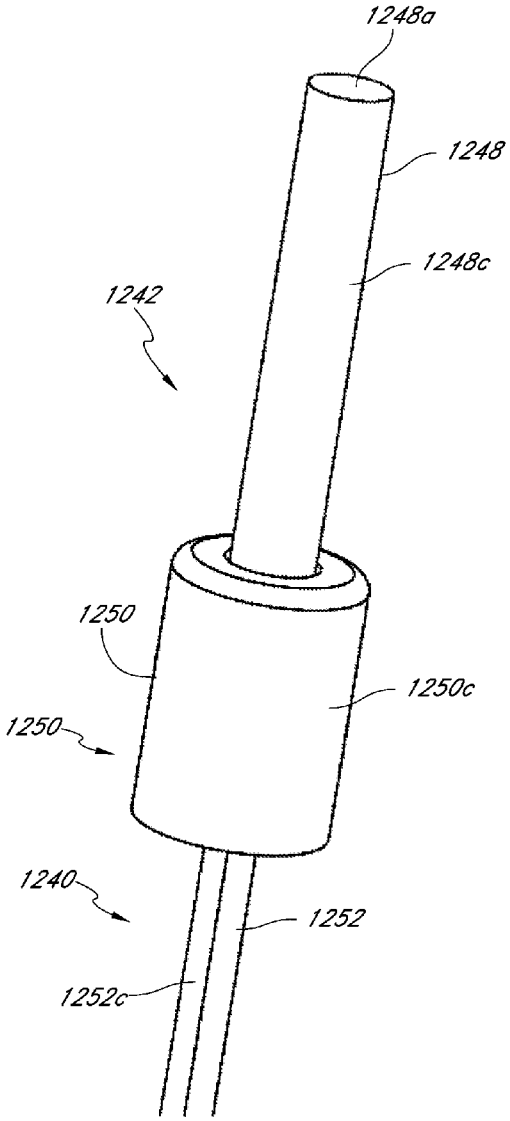
FIG. 45A is a perspective view of a portion of an embodiment of a resilient member.
Figure 45B:
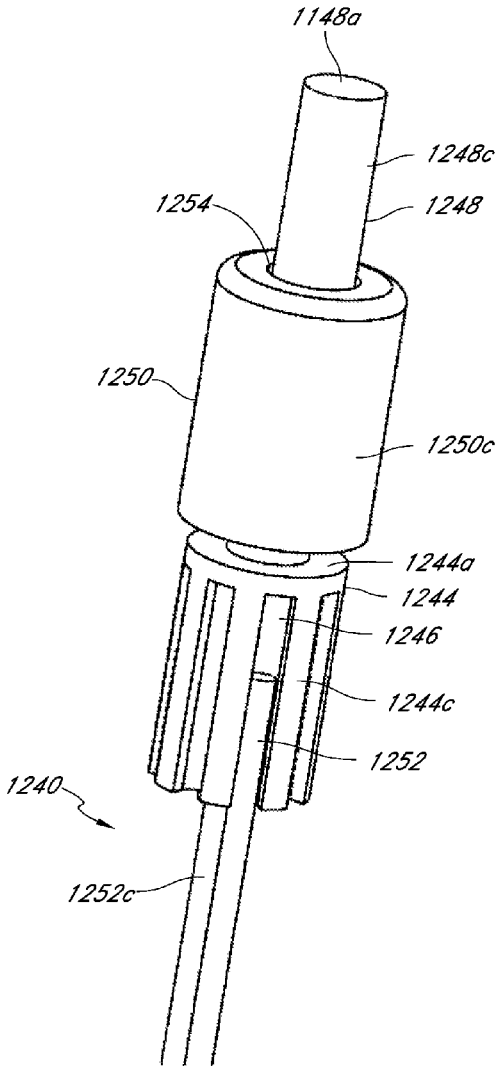
FIG. 45B is a partially exploded perspective view of the portion of the embodiment of the resilient member illustrated in FIG. 45A.

The embodiment of the resilient member 1240 illustrated in FIGS. 45A-45B can be similar in most respects to the resilient member 1210 described above, except that, in some embodiments, the sleeve member 1250 illustrated in FIGS. 45A-45B can have a constricted upper portion that defines a through-hole 1254 that can be sized and configured to have a diameter that can be slightly larger than the diameter of the outer surface 1248*c* of the gripping portion 1248. The constricted upper portion provides a supporting surface that prevents the sleeve member 1250 from sliding down below the handle retention portion 1244. In this configuration, there may not be any need for the extended portion 1224*e* of the handle retention portion 1224 that is illustrated in FIG. 44C.

Figure 46:
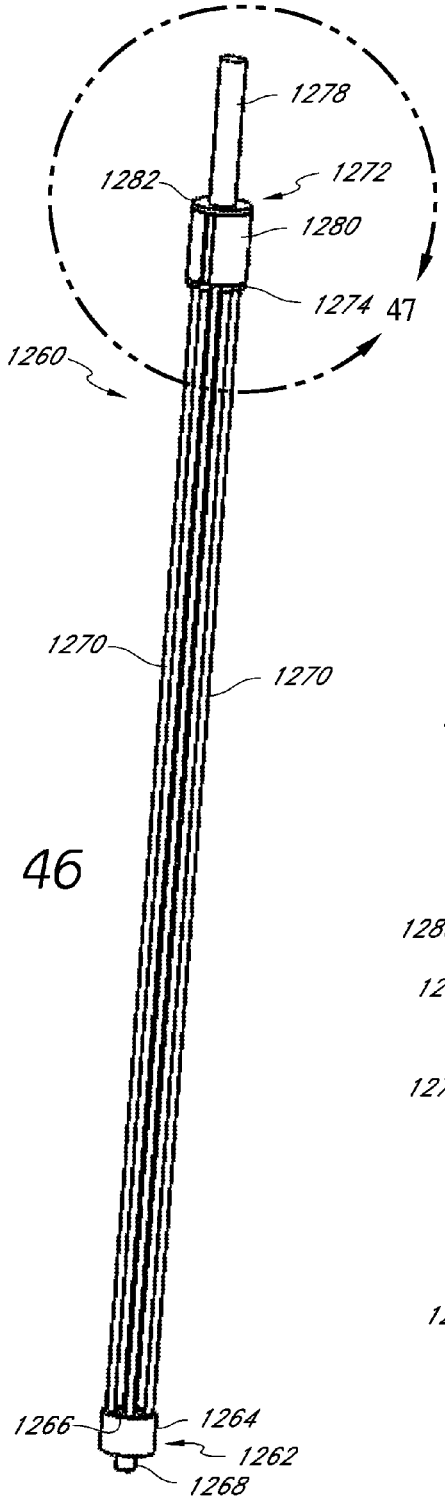
FIG. 46 is a perspective view of an embodiment of a resilient member.
Figure 47:
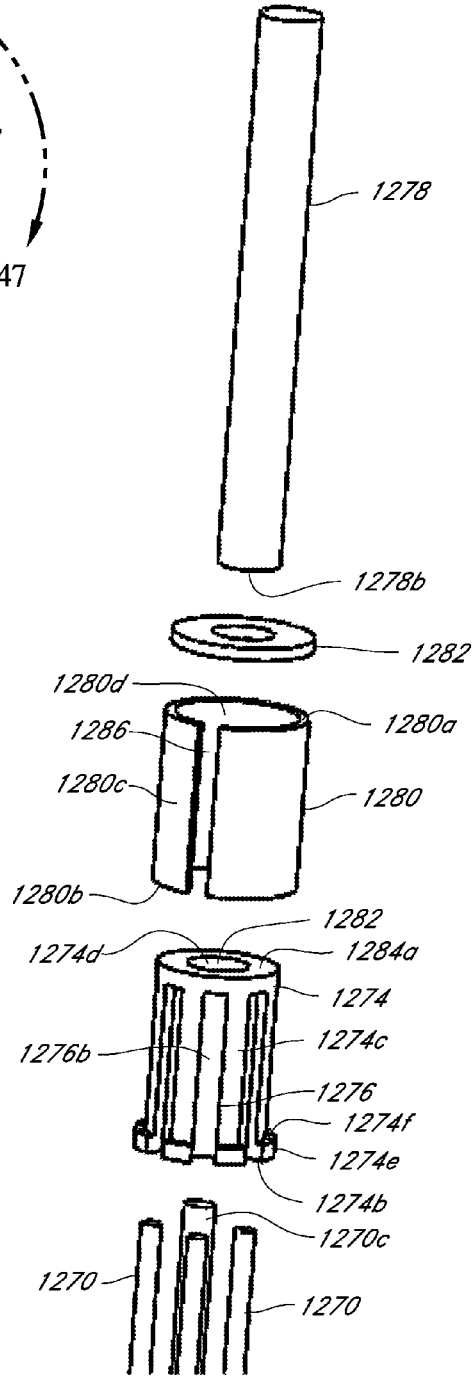
FIG. 47 is an enlarged, exploded perspective view of a portion of the embodiment of the resilient member illustrated in FIG. 46 defined by curve 47 in FIG. 46.

FIGS. 46 and 47 are a perspective view and an exploded perspective view of another embodiment of a resilient member 1260. The resilient member 1260 illustrated in FIGS. 46-47 can be similar to the resilient member 1210 illustrated in FIG. 42A above, except as follows. The handle member 1272 can comprise a handle retention portion 1274 comprising openings 1276. The handle member 1272 also comprises a gripping portion 1278, and a sleeve member 1280. The gripping portion 1278 can be configured to fit within an opening in the handle retention portion 1274 in a similar fashion as described above with respect to resilient member 1110. The sleeve member 1280 can be sized and configured such that the inner surface 1280*d* of the sleeve member 1280 has a similar size and shape as compared to, but slightly larger than, the outer surface 1274*c* of the handle retention portion 1274 so that the sleeve member 1280 can be inserted over, and rotate about, the handle retention portion 1274. An extended portion 1274*d* of the handle retention portion 1274 can be sized and configured to provide a supporting surface 1274*e*, to restrain the axial movement of the sleeve member 1280 in the downward direction so that the bottom surface 1280*b* of the sleeve member 1280 does not move below the supporting surface 1274*f* of the handle retention portion 1274. A similar or other suitable means can be used to prevent or inhibit the sleeve member 1280 from moving in the upward direction once the sleeve member 1280 can be positioned over the handle retention portion 1274, as illustrated in FIG. 46B. An annular member 1282 can then be positioned over the sleeve member 1280. Alternatively, in some embodiments, the sleeve member 1280 could comprise a constricted upper portion configured to inhibit it from translated axially downward beyond a desired position, similar to the sleeve member 1250 described above.

Figures 48A, 48B, 48C:
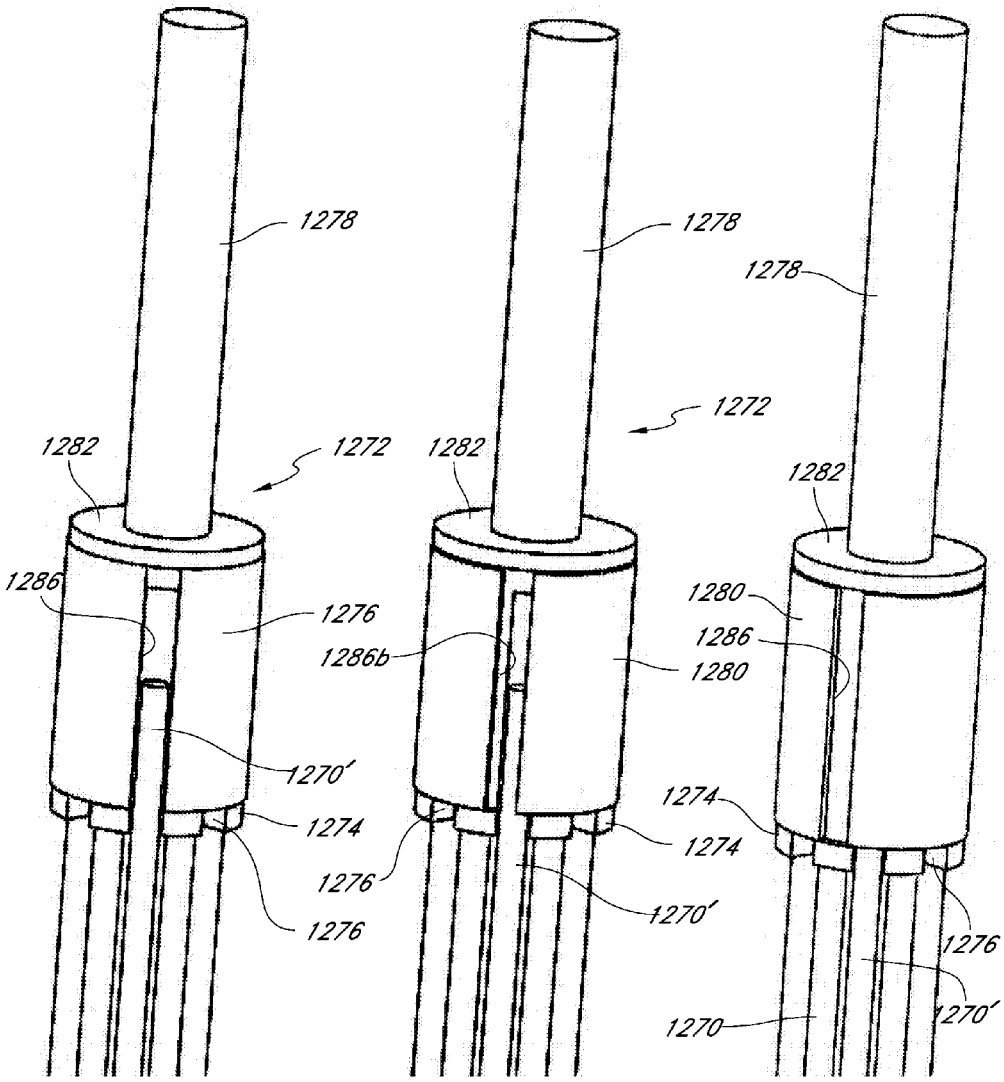
FIGS. 48A-48C are perspective views of the portion of the embodiment of the resilient member illustrated in FIG. 47, illustrating the addition of an embodiment of a stiffening member to such resilient member.
Figures 49A, 49B, 49C, 49D, 50:
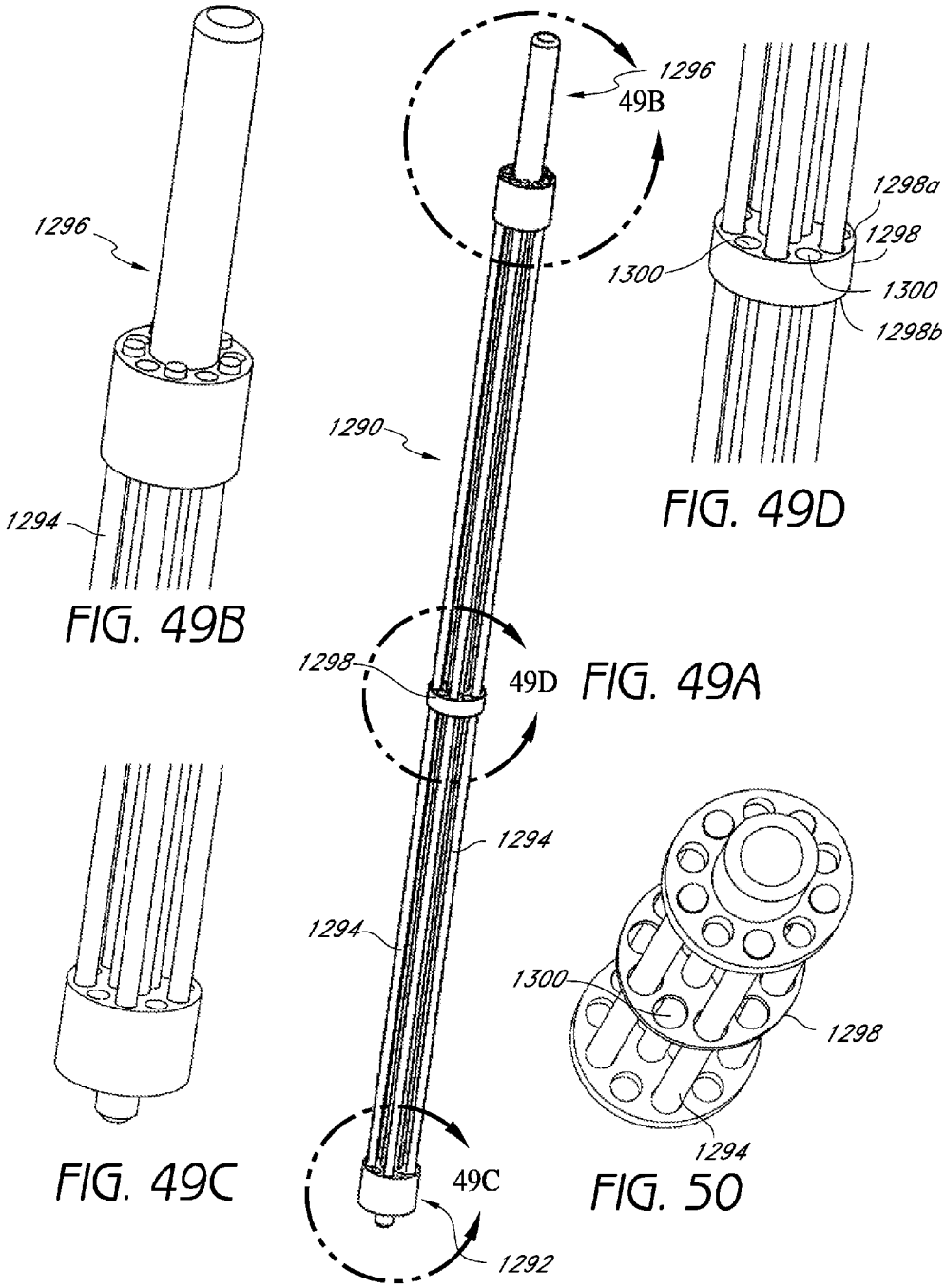
FIG. 49A is a perspective view of an embodiment of a resilient member.
FIG. 49B is an enlarged perspective view of a portion of the embodiment of the resilient member illustrated in FIG. 49A defined by curve 49B in FIG. 49A.
FIG. 49C is an enlarged perspective view of a portion of the embodiment of the resilient member illustrated in FIG. 49A defined by curve 49C in FIG. 49A.
FIG. 49D is an enlarged perspective view of a portion of the embodiment of the resilient member illustrated in FIG. 49A defined by curve 49D in FIG. 49A.
FIG. 50 is a perspective view of the embodiment of the resilient member illustrated in FIG. 49A.

FIGS. 48A-48C are perspective views of the portion of the embodiment of the resilient member 1260 illustrated in FIG. 47, illustrating the addition of an embodiment of a stiffening member 1270' to such resilient member 1260. As illustrated therein, the radially positioned openings 1276 and the sleeve member can be configured so as to allow a user to easily add or remove a stiffening member 1270' to or from the resilient member 1260.

To add a stiffening member 1270' to the resilient member 1270, a user can first insert the bottom portion of the stiffening member 1270' into the desired opening 1266 in the insert member 1264 (not shown). The user then rotates the sleeve member 1280 in either the clockwise or counter-clockwise direction until the slot 1286 formed in the sleeve member 1280 can be sufficiently aligned with the desired opening 1276. The user can then exert a lateral force on the top portion of the stiffening member 1270' to push the stiffening member 1270' into the desired opening 1276 until the outer surface of the stiffening member 1270' abuts the inner surface 1276*b* of the desired opening 1276, as illustrated in FIG. 48A. The user can then rotate the sleeve member 1280 in either the clockwise or counter-clockwise direction until the slot 1286 formed in the sleeve member 1280 can be no longer aligned with the desired opening 1276, as illustrated in FIGS. 48B-

48C and is, rather, generally aligned with the outer surface 1274*c* of the handle retention portion 1274. Additionally, the handle retention portion 1274 can be configured to, or can comprise features such as, but not limited to, detents or flexible tabs that bias or cause the stiffening members 1270 to be held within the openings 1276 during the period of time that the slot 1286 in the sleeve member 1280 can be aligned with a opening 1276 in the handle retention portion 1274.

FIGS. 49A-49D and 50 are perspective views of an embodiment of a resilient member 1290 that can be similar to resilient member 180 described above, except that the resilient member 1290 further comprises a middle retention member 1298 that can be configured to restrain the stiffening members 1294 near the midpoint between the insert member 1292 and the handle member 1296. The radially positioned openings 1300 in the middle retention member 1298 (i.e., those positioned away from the center of the middle retention member 1298) can be configured to provide lateral restraint to the stiffening members 1294, without substantially axially restraining the stiffening members 1294.

Figure 51:
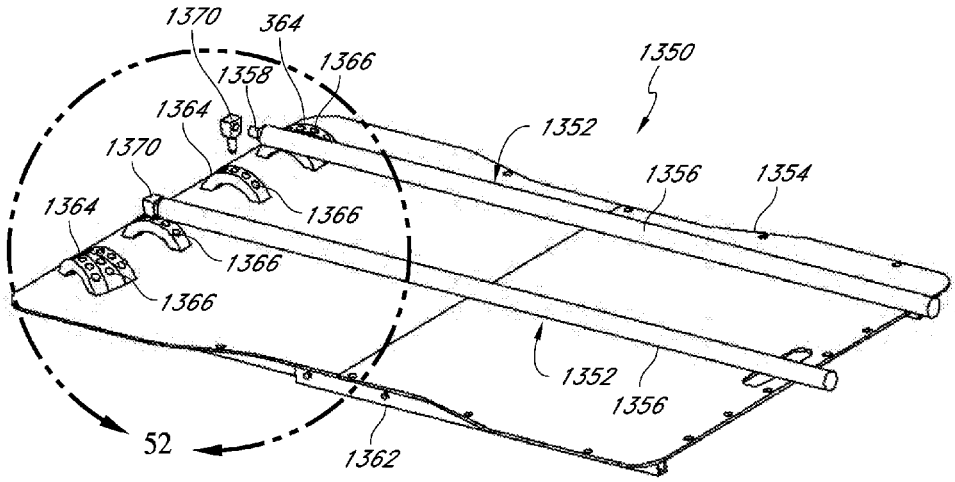
FIG. 51 is a perspective view of another embodiment of an exercise device.
Figure 52:
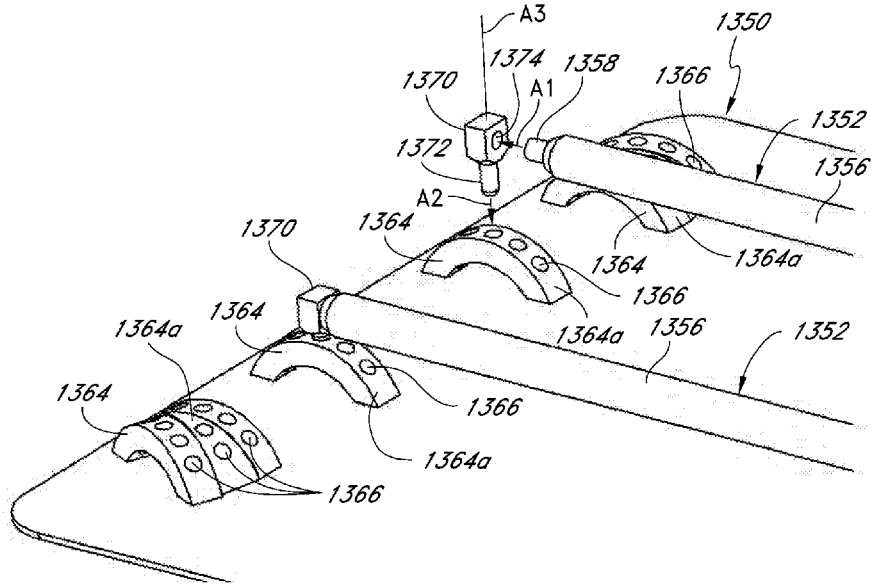
FIG. 52 is an enlarged perspective view of a portion of the embodiment of the exercise device shown in FIG. 51.

FIG. 51 is a perspective view of another embodiment of an exercise device 1350. FIG. 52 is an enlarged perspective view of a portion of the embodiment of the exercise device 1350 shown in FIG. 51. In some embodiments, the exercise device 1350 can comprise one or more resilient members 1352 and a base member 1354. In the illustrated embodiment, and in any embodiment described herein, the base 1354 (or any base described herein) can be configured to be free standing on a generally flat, horizontal surface so as to provide a supporting surface for a user of the exercise device in a standing, sitting, kneeling, or any other desired position. However, the exercise device 1350 is not so limited. In some embodiments, the base 1354 or any portion thereof can be attached to and, hence, supported by a horizontal, vertical or inclined surface, or can be configured to be free standing in a vertical or any angular orientation.

Figure 53:
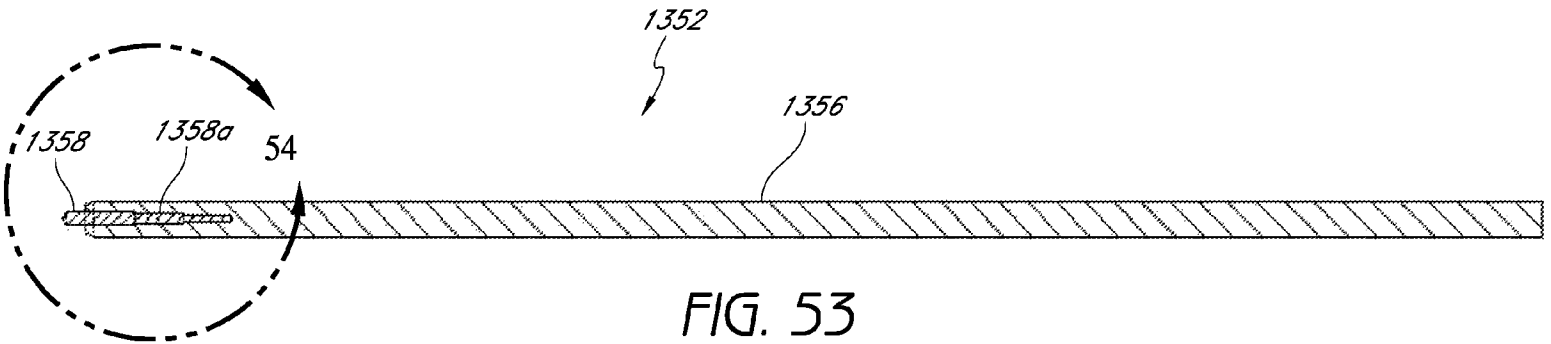
FIG. 53 is a sectional view of the embodiment of one of the resilient members shown in FIG. 51, taken through the longitudinal center of the resilient member.
Figure 54:
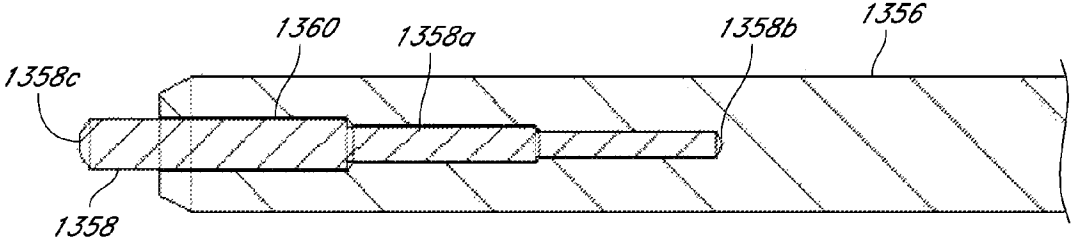
FIG. 54 is an enlarged sectional view of the embodiment of one of the resilient members shown in FIG. 51, taken through the longitudinal center of the resilient member.

FIGS. 53 and 54 are a sectional view and enlarged sectional view, respectively, of the embodiment of one of the resilient members 1352 shown in FIG. 51, taken through the longitudinal center of the resilient member 1352. In some embodiments, as in the illustrated embodiment, the resilient member 1352 can comprise a stiffening member 1356 and an insert member 1358. The stiffening member 1356 can comprise an opening 1360 formed therein configured to receive the inner portion 1358*a* of the insert member 1358. In some embodiments, the opening 1360 can be formed so that the axial centerline of the opening 1360 can be collinear with the axial centerline of the stiffening member 1356. In some embodiments, the opening 1360 and the inner portion 1358*a* of the insert member 1358 can have an approximately matching geometry, and can be configured to define one or more tapered portions having a reduced cross-sectional area. In some embodiments, the opening 1360 and the inner portion 1358*a* can be tapered or otherwise be formed so that the cross-sectional area of the opening 1360 and the inner portion 1358*a* can be reduced. In some embodiments, the insert member 1358 can be press fit within the opening 1360, or otherwise adhered or secured within the opening 1360.

The portion of the insert member 1358 that extends past the end of the stiffening member 1356 can be configured to be supported in a cantilevered disposition by an opening or connection interface of a base member 1354, such as the connection interface 1366. In some of the embodiments, the insert member 1358 or portions thereof can define a generally circular cross-section. In some embodiments, the insert member 1358 can define a square, triangular, ovular, polygonal, or other similar or desired cross-section. Similarly, in any of the embodiments described herein, splines, teeth, protrusions, channels, notches, or other features configured to inhibit the resilient member from rotating (i.e., spinning) within or relative to the connection interface, can be formed on one or more surfaces of the insert member and/or the connection interface to inhibit the resilient member from rotating (i.e., spinning) within or relative to the connection interface.

Additionally, some embodiments of the insert member 1358 can define a stepped or tapered outer surface 1358*a* having a cross-sectional area that can be less at the distal end 1358*b* of the insert member 1358 than at the proximal end 1358*c* of the insert member 1358. For example, in some embodiments, the outer surface 1358*a* of the insert member 1358 can be conically tapered toward the distal end 1358*b* of the insert member 1358 such that the portion of the insert member 1358 and near the distal end 1358*b* defines a cross-sectional area that can be less than the cross-sectional area of the portion of the insert member 1358 near the proximal end 1358*c* of the insert member 1358. The outer surface 1358*a* of the insert member can be linearly or nonlinearly tapered, or can define a stepped tapering surface as illustrated in FIGS. 53 and 54. The opening 1360 formed in the stiffening member 1358 can be formed so as to complement the geometry of the insert member 1358.

The base member 1354 can have a supporting frame 1362. Any components comprising the base member 1354 or supporting frame, or any other base member or supporting frame disclosed herein, can be formed from steel, aluminum, plastic, fiberglass, and/or any other suitable material, composite material, or combination thereof. Additionally, in some embodiments, generally arcuately shaped base connection members 1364 can be supported by the base member 1354. In some embodiments (not illustrated), the base connection member 1364 can be generally spherically shaped. The base connection members 1364 can be fixed to the base member 1354, or can be supported by the base member 1354 in a manner that permits the base connection members 1364 to be rotationally adjustable relative to the base member 1354. In some embodiments, a plurality of base connection members 1364 can be supported by the base member 1354, each being mounted at a different location and/or angular orientation relative to the base member 1354.

The base connection members 1364 can define one or more connection interfaces 1366 that are configured to directly or indirectly support one or more resilient members 1352. In the embodiment illustrated in FIGS. 51 and 52, the connection interfaces 1366 can be cylindrically shaped openings formed at various locations on the base connection members 1364, defining various angular orientations relative to the base 1354 such that, when the resilient member 1352 can be supported by a connection interface 1366, the angular orientation of the longitudinal axis of the resilient member 1352 relative to the base 1354 can be adjusted by changing the connection interface 1366 that defines the support for the resilient member 1352.

Additionally, the base connection members 1364 can be bolted, welded, or otherwise attached or mounted to the base member 1354 in a wide range of angular orientations to further increase the range of the angular orientations of the connection interfaces 1366, each of which can define a removable or non-removable support for a resilient member 1352. Additionally, the angular orientation of the resilient member 1352 can be further adjusted by using an insert interface 1370 that can be configured to be supported by a connection interface 1366. In some embodiments, the insert interface 1370 can define an insert portion 1372 that can have any of the same features, geometries, or other details of any of the other insert members disclosed herein. Additionally, in some embodiments, the insert interface 1370 can define an opening 1374 that can be configured to receive and provide cantilevered support to an insert member of a resilient member, such as insert member 1358 of the resilient member 1352. In some embodiments, the resilient member 1352 can be inserted into the insert interface 1370 by sliding the insert member 1358 of the resilient member 1352 into the opening 1374 of the insert interface 1370 in the direction defined by arrow A1. The insert interface 1370 can be inserted into the connection interface 1366 by sliding the insert portion 1372 of the insert interface 1370 into the connection interface 1366. In some embodiments, the insert interface 1370 can be configured to alter the angle of the resilient member 1352 relative to the connection interface 1366 by an angle between approximately 0° and 180°. In the illustrated embodiment, insert interface 1370 can be configured to alter the angle of the resilient member 1352 relative to the connection interface 1366 by approximately 90°.

In some embodiments, the insert portion 1372 of the insert interface 1370 can be generally shaped so as to complement the geometry of a at least one of the openings, such as the generally cylindrically shaped opening 1366. In this configuration, the insert interface 1370 can be rotated about an axis A3 relative to the connection interface 1366 so that the resilient member 1352 can be rotated about axis A3 relative to the connection interface 1366 and, hence, the base 1354. In some embodiments, the insert interface 1370 can be configured to prevent such rotatability.

Figure 55:
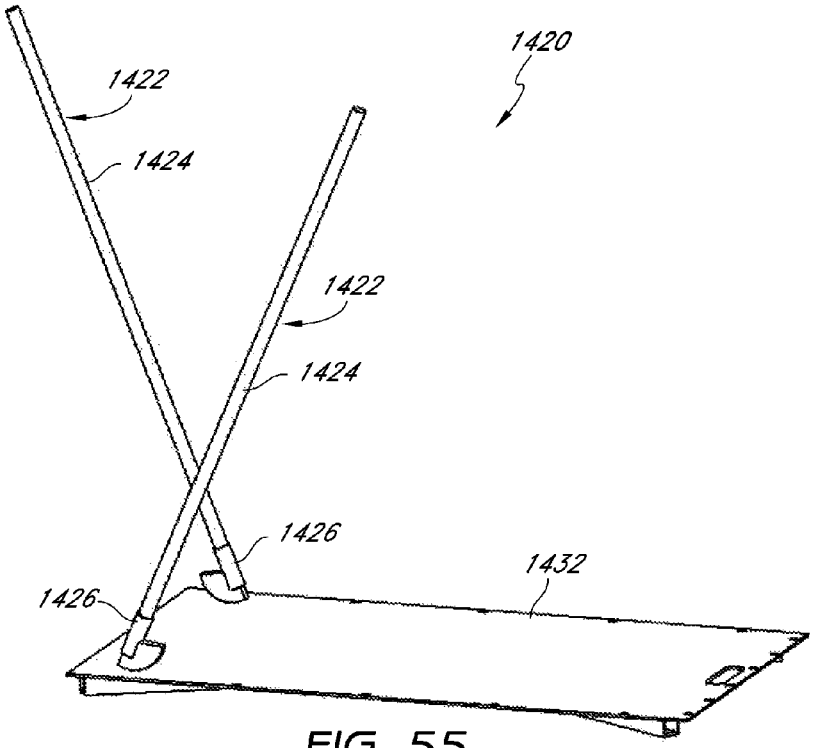
FIG. 55 is a perspective view of another embodiment of an exercise device.
Figure 56:
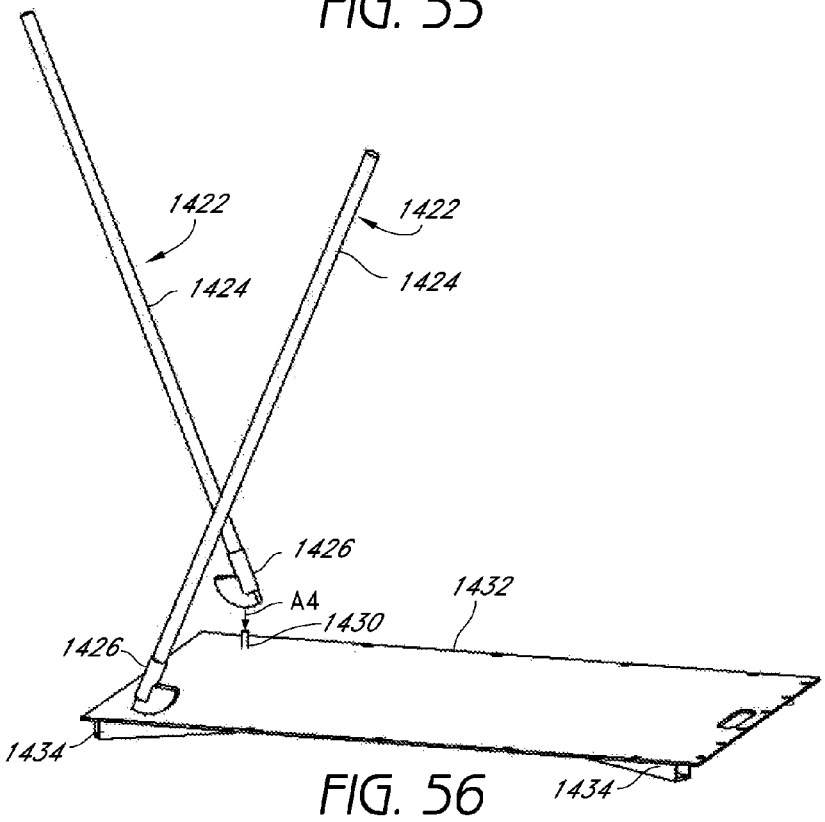
FIG. 56 is a perspective view of the embodiment of an exercise device shown in FIG. 55, showing one resilient member supported by the base member and another resilient member spaced apart from the base member.

FIGS. 55 and 56 are perspective views of another embodiment of an exercise device 1420. In some embodiments, the exercise device 1420 can comprise one or more resilient members 1422, each comprising a stiffening member 1424 and an insert member 1426. The resilient member 1422 can be configured to be supported by one of a plurality of connection interfaces 1430 supported by a base member 1432. In the illustrated embodiment, the base 1432 can have a supporting frame 1434 and can be configured to be free standing on a generally flat, horizontal surface so as to provide a supporting surface for a user of the exercise device in a standing, sitting, kneeling, or any other desired position. However, the exercise device 1350 is not so limited. In some embodiments, the base 1354 or any portion thereof can be attached to and, hence, supported by a horizontal, vertical or inclined surface, or can be configured to be free standing in a vertical or any angular orientation.

In some embodiments, the connection interfaces 1430 can be generally cylindrically or conically shaped, and can be welded, screwed, bolted, or otherwise supported by the base member 1432. In some embodiments, the connection interfaces 1430 can be rigid and can be formed from steel, stainless steel, aluminum, a composite material, or any other suitable material or combination of materials.

Figure 59:
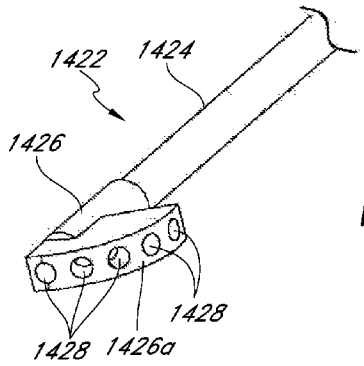
FIG. 59 is a perspective view of a portion of the embodiment of the resilient member shown in FIG. 55.
Figure 58:
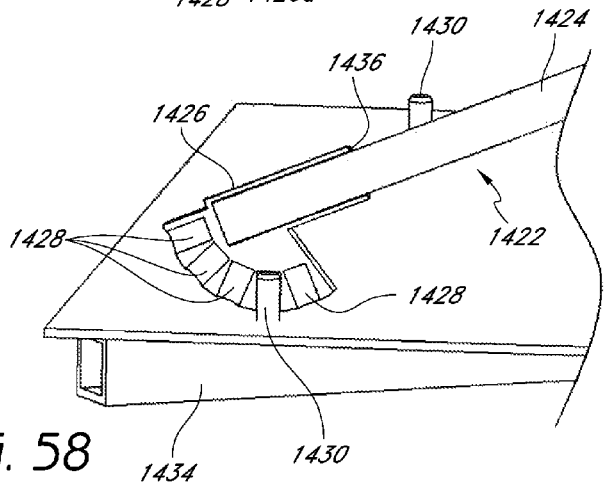
FIG. 58 is an enlarged view of a portion of FIG. 57.
Figure 57:
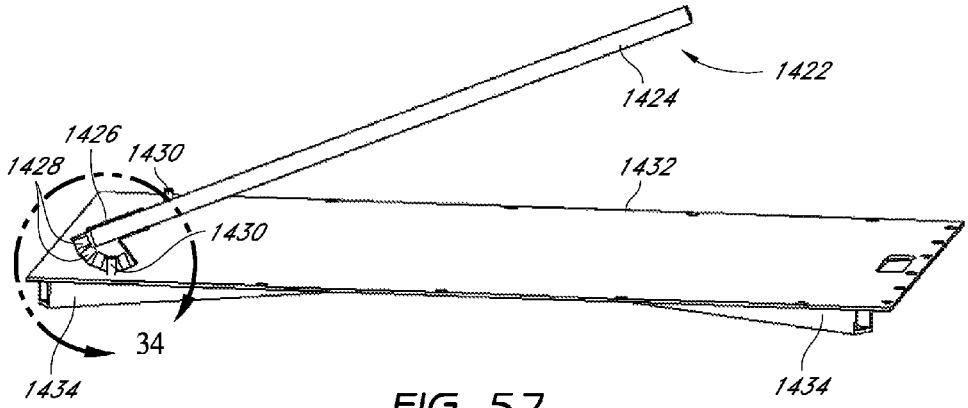
FIG. 57 is a perspective view of the embodiment of an exercise device shown in FIG. 55, wherein the embodiment of the resilient member shown in FIG. 55 is shown in a section view and in a different orientation relative to the base member as compared to the embodiment of the resilient member shown in FIG. 55.

FIG. 57 is a perspective view of the embodiment of the exercise device 1420, wherein the embodiment of the resilient member 1422 is shown in a section view and in a different orientation relative to the base member 1432 as compared to the embodiment of the resilient member 1422 shown in FIG. 55. FIG. 58 is an enlarged view of a portion of the exercise device 1420 shown in FIG. 57, and FIG. 59 is a perspective view of a portion of the embodiment of the resilient member 1422 shown in FIG. 55.

With reference to FIGS. 55-59, the resilient member 1422 can be mounted to or supported by the connection interface 1430 and, hence, the base member 1432, by sliding the insert member 1426 of the resilient member 1422 onto the connection interface 1430 such that the connection interface 1430 can be received by one of the openings 1428 (also referred to herein as support openings) formed in the interface member 1426. In particular, with reference to FIG. 56, the resilient member 1422 can be removably mounted to the connection interface 1430 by moving the resilient member 1422 in the direction defined by arrow A4 relative to the connection interface 1430 so that the connection interface 1430 can be received by one of the openings 1428 formed in the connection interface 1426. In some embodiments, the angular orientation of the resilient member (which can be defined by the longitudinal axis of the resilient member) relative to the base member 1432 can be adjusted by changing the opening 1428 defining the removable support for the resilient member 1422.

In the illustrated embodiment, the connection interfaces 1430 can be supported by the base member 1432 in a generally perpendicular orientation relative to the base member 1432. However, the configuration of the exercise device 1420 is not so limited. In some embodiments, the connection interfaces 1430 can be supported by the base member 1432 at any of a wide range of desired angular orientations relative to the base member 1432. In some embodiments, a plurality of connection interfaces 1430 can be supported by the base member 1432, each being mounted at a different location and/or angular orientation relative to the base member 1432. Additionally, in some embodiments, one or more of the connection interfaces 1430 can be movably supported by the base member 1432 so that a user can adjust the location and/or angular orientation of the connection interface 1430 relative to the base member 1432, similar to the adjustable base members such as, without limitation, adjustable base members 40*a*, 40*b*, and 40*c* described in U.S. Patent Application Publication No. US 2007/0072752, which is incorporated by reference herein.

Each interface member 1426 can define any desired number of openings 1428 formed in the interface member 1426, formed at any desired angular orientation relative to the stiffening member 1424 of each resilient member 1422. In the illustrated embodiment, the surface 1426*a* or portions of the surface 1426*a* of the interface member 1426 can be generally arcuate. In some embodiments, the surface 1426*a* or portions of the surface 1426*a* of the interface member 1426 can be generally planar, spherical, curved (arcuately or otherwise), or can define any desired surface contour. In some embodiments, the interface member 1426 can be formed from the same material or materials that are used to form the stiffening member 1424, and can be integrally formed therewith or formed in a separate process and joined therewith.

In some embodiments, the openings 1428 formed in the insert member 1426 or portions thereof can define a square, triangular, ovular, polygonal, or other similar or desired cross-section. In some embodiments, splines, teeth, protrusions, channels, notches, or other features configured to inhibit the resilient member 1424 from rotating (i.e., spinning) within or relative to the connection interface 1430, can be formed on one or more surfaces of the insert member 1426 (including, without limitation, one or more surfaces of the openings 1428) and/or the connection interface 1430 to inhibit the resilient member 1422 from rotating (i.e., spinning) within or relative to the connection interface 1430. In some embodiments, the openings 1428 formed in the insert member 1426 or portions thereof can be configured to permit the resilient member 1422 to rotate relative to the connection interface 1430.

Figures 60, 61, 62:
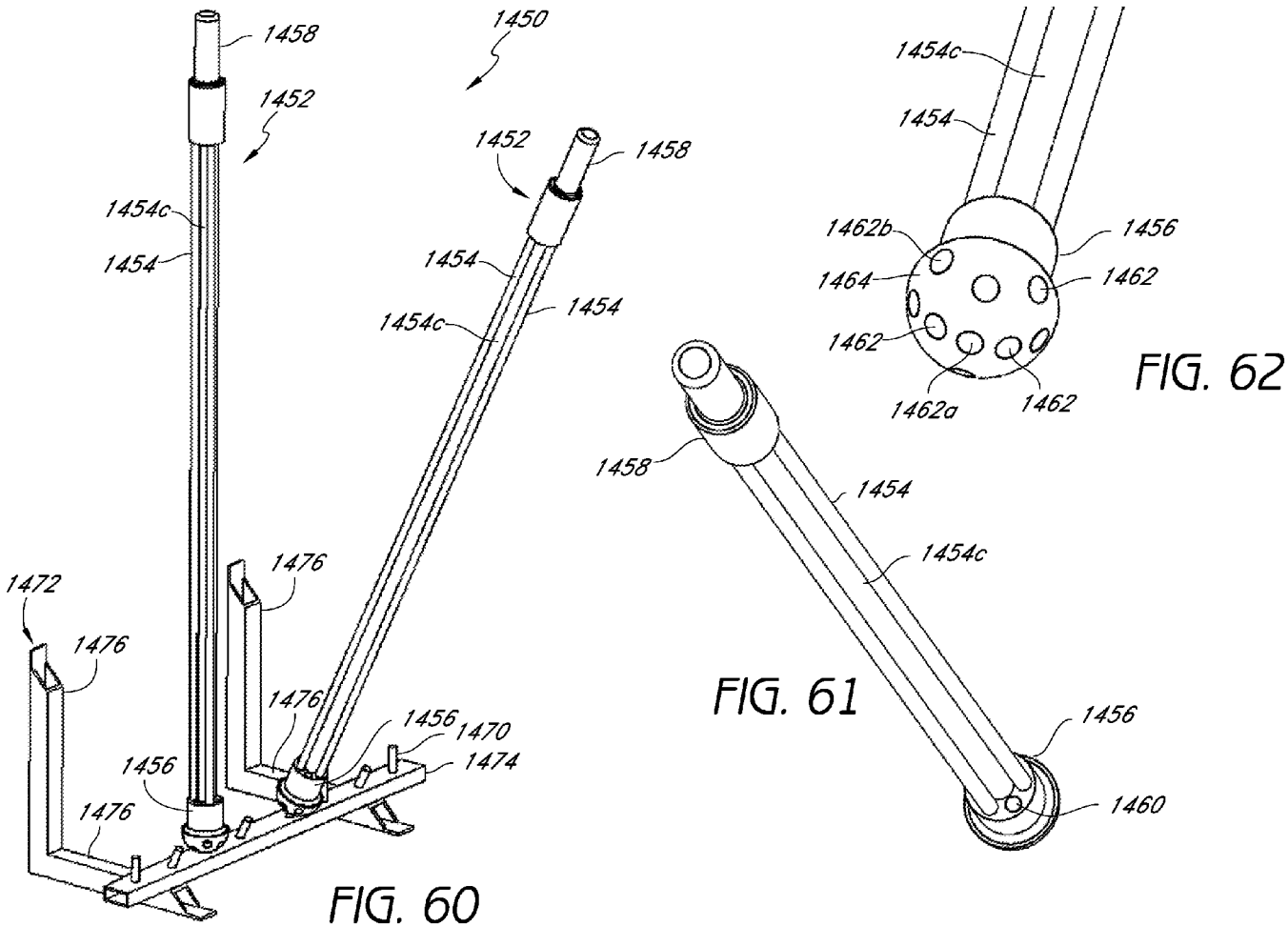
FIG. 60 is a perspective view of another embodiment of an exercise device.
FIG. 61 is a perspective view of the embodiment of the resilient member shown in FIG. 60.
FIG. 62 is a perspective view of a portion of the embodiment of the resilient member shown in FIG. 60.

FIG. 60 is a perspective view of another embodiment of an exercise device 1450. FIGS. 61 and 62 are a perspective view and an enlarged perspective view of a portion, respectively, of the embodiment of the resilient member 1452 shown in FIG. 60. In some embodiments, one or more of the components of the exercise device 1450 can have the same or similar features, materials, geometries, or other details or configurations as any of the other components (similar or otherwise) of the other embodiments described herein.

The resilient member 1452 can be configured to support a center stiffening member 1454*c* as well as to removably support additional stiffening members 1454. With reference to FIGS. 60-62, each of the resilient members 1452 can further comprise a first member or insert member 1456 and a second member or handle 1458. Each of the stiffening members 1454 can be generally resilient or bendable along a substantial or entire portion of its length and can be either removably or non-removably supported by the openings 1460 formed in the insert member 1456. The handle 1458 can also be configured to comprise openings (not illustrated) to either removably or non-removably support the stiffening members 1454. Additionally, in some embodiments, the openings in the handle member 1458 can be configured to permit one or more of the stiffening members 1454 to translate axially within its respective opening.

With reference to FIG. 62, the insert member 1456 can define one or more openings formed in the surface 1464 at different locations and/or angular orientations relative to a longitudinal axis of the resilient member 1452. In some embodiments, the surface 1464 can be spherical. Some of the openings 1462 (also referred to herein as support openings), such as but not limited to opening 1462*a*, can be formed at an angle that can be approximately co-linear with the longitudinal axis of the resilient member 1452. Additionally, in some embodiments, any of the openings 1462 can be formed at any of a wide range of angular orientations relative to the centerline axis of the resilient member 1452. In some embodiments, the openings 1462 can be formed that an angle that can be between approximately 0° and approximately 90°, or more, relative to the centerline axis of the resilient member 1452.

With reference to FIG. 60, each of the resilient members 1452 can be supported by inserting each of the resilient members 1452 onto a protrusion 1470 supported by the base member 1472 such that the protrusion 1470 can be received by one of the openings 1462 formed in the insert member 1456. The protrusions 1470 can be configured to support each of the resilient members 1452 so that at least the insert member 1456 of the resilient member 1452 supported by the protrusion 1470 can be prevented from rotating (i.e., pivoting) relative to the protrusion 1470 and hence, the base 1472.

Thus, by varying the opening 1462 and/or the protrusion 1470 that defines the removable support for the resilient member 1452, a user can adjust the location and/or angular orientation of the resilient member 1452 relative to the base 1472 or the user. In some embodiments, the base member 1472 can be removably or non-removably attached to or supported by a horizontal, vertical, or other supporting surface such as, but not limited to, a floor or ground surface, a wall, a door, or other suitable structure using bolts, screws, clamps, or any other suitable fastening mechanism. In some embodiments, the base member 1472 can be configured to be free standing.

In some embodiments, the base portion 1474 can be removably or non-removably attached to or supported by a horizontal, vertical, or other supporting surface such as, but not limited to, a floor or ground surface, a wall, a door, or other suitable structure using bolts, screws, clamps, or any other suitable fastening mechanism, without the inclusion of the frame members 1476, resulting in a simpler apparatus with fewer component parts. The base portion 1474, if so supported or attached without the frame members 1476, can be configured to define a wider contact surface area relative to the supporting surface, such as by forming or attaching support tabs or wings to the base portion 1474 so as to improve the stability and attachment strength of the base portion 1474 when transverse forces are applied thereto as the resilient members 1452 are deflected from a longitudinal axis of the relaxed resilient member 1452 (i.e., flexed or bent).

Figure 63:
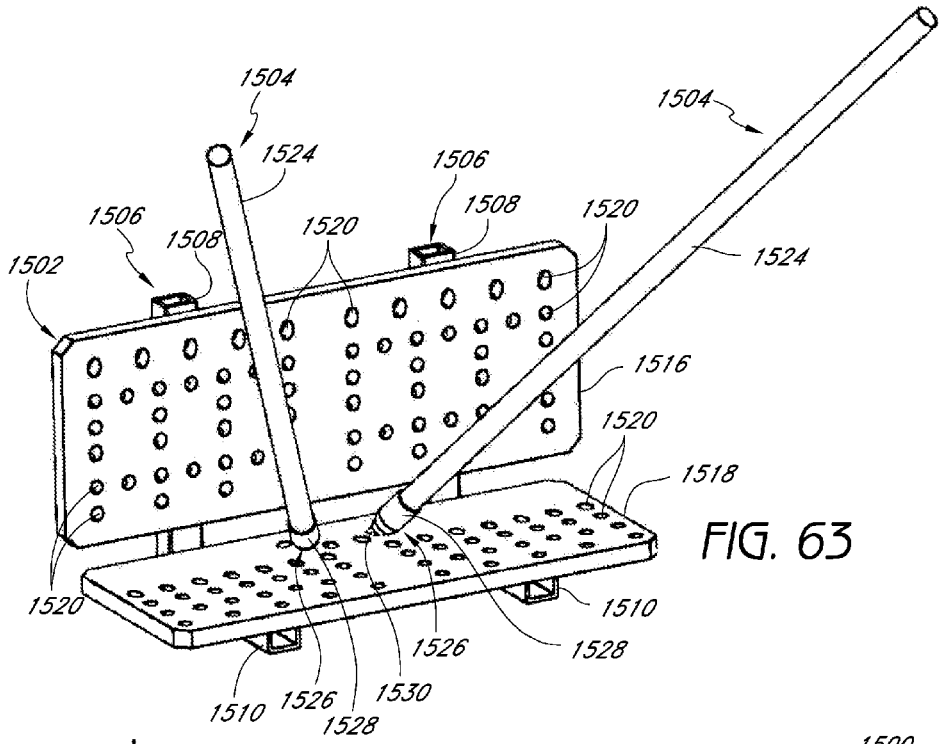
FIG. 63 is a perspective view of another embodiment of an exercise device.
Figure 64:
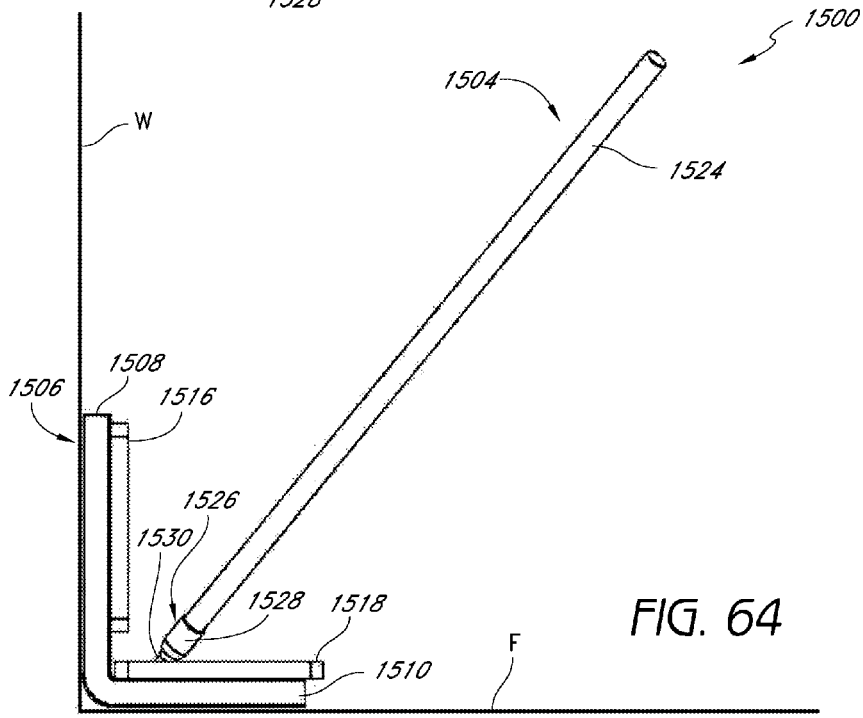
FIG. 64 is a side view of the embodiment of the exercise device shown in FIG. 63.

FIGS. 63 and 64 are a perspective view and a side view, respectively, of another embodiment of an exercise device 1500. In some embodiments, one or more of the components of the exercise device 1500 can have the same or similar features, materials, geometries, or other details or configurations as any of the other components (similar or otherwise) of the other embodiments described herein. The exercise device a 1500 can define a base member 1502 and one or more resilient members 1504 removably or non-removably supported by the base member 1502. The base member 1502 can be formed from one or more frame members 1506, each comprising a first frame member 1508 and a second frame member 1510. The base member 1502 can be removably or non-removably attached to or supported by a horizontal, vertical, or other supporting surface such as, but not limited to, a floor or ground surface (denoted by F in FIG. 64), a wall (denoted by W in FIG. 64), a door, or other suitable structure using bolts, screws, clamps, or any other suitable fastening mechanism. In some embodiments, the base member 1502 can be configured to be free standing.

The base member 1502 can have a first base portion 1516 and a second base portion 1518, each comprising one or more openings 1520, each of which can define a removable or non-removable support for a resilient member 1504. The openings 1520 can be formed at any of a wide ranging variety of locations and/or angular orientations on the first base portion 1516 and second base portion 1518. Thus, by varying the opening 1520 that defines the removable support for the resilient member 1504, a user can adjust the location and/or angular orientation of the resilient member 1504 (which can be defined by the longitudinal axis of the resilient member) relative to the base 1502 or the user.

Each of the resilient members 1504 can define one or more stiffening members 1524 and an insert member 1526. The insert members 1526 can each define a support portion 1528, which can be configured to receive and provide cantilever support to one or more stiffening members 1524, and an insertion portion 1530, which can be configured to be received by some or all of the openings 1520 formed in the base member 1502. The geometry of the insertion portion 1530 can be configured to approximately match the geometry of one or more of the openings 1520 formed in the base member 1502. In some embodiments, the shape and size of each of the openings 1520, which can be cylindrical, conical, or otherwise, can be approximately the same or similar from one opening 1520 to the next. The size and geometry of the insertion portion 1530 of the insert member 1526 can be independent of the size and geometry of the support portion 1528 of each insert member such that each insert member 1526 can be configured to support one or more of a wide range of sizes and shapes of stiffening members 1524 without affecting the size and shape of the insert portion 1530. In this configuration, a wide range of shapes and sizes of stiffening members 1524 can be supported by a uniformly shaped set of the openings 1520.

Figure 66:
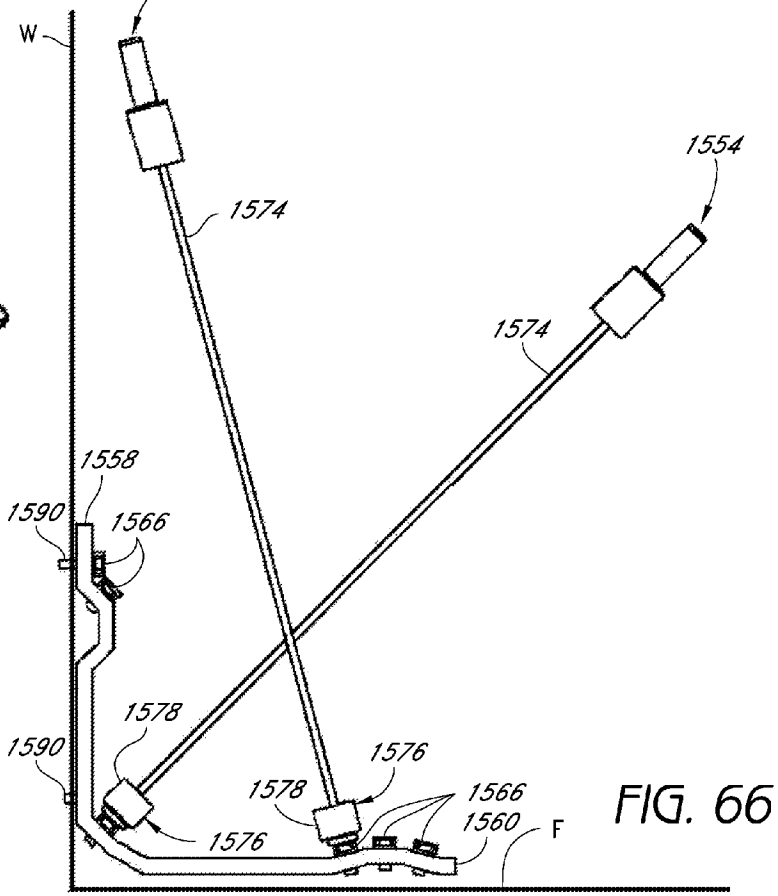
FIG. 66 is a side view of the embodiment of the exercise device shown in FIG. 65.
Figure 65:
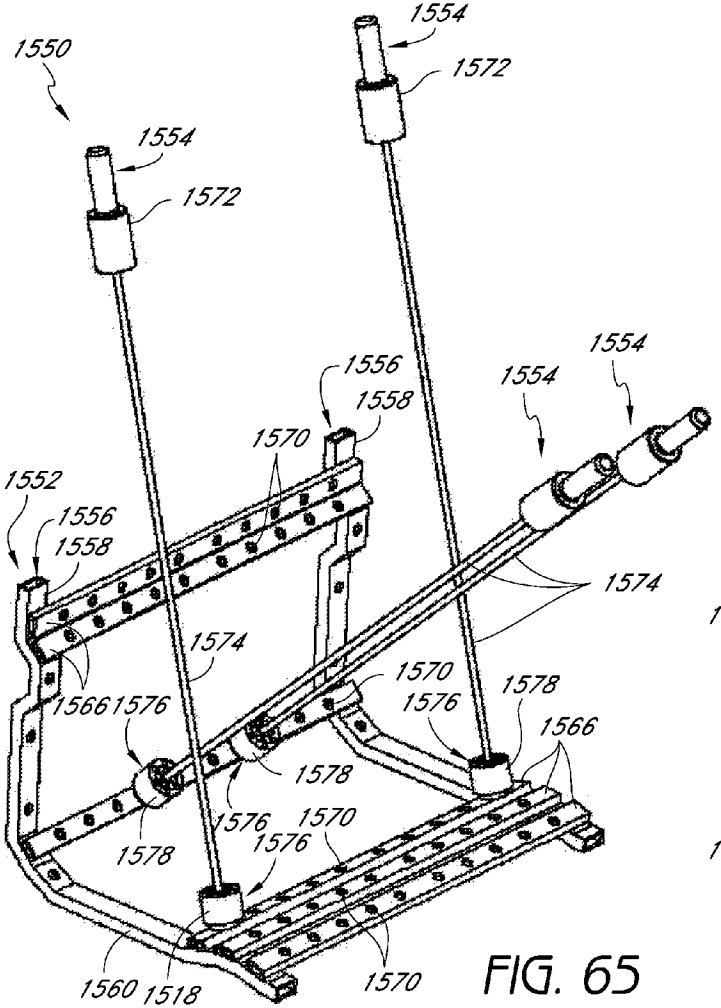
FIG. 65 is a perspective view of another embodiment of an exercise device.

FIGS. 65 and 66 are a perspective view and a side view, respectively, of another embodiment of an exercise device 1550. In some embodiments, one or more of the components of the exercise device 1550 can have the same or similar features, materials, geometries, or other details or configurations as any of the other components (similar or otherwise) of the other embodiments described herein. The exercise device 1550 can define a base member 1552 and one or more resilient members 1554 removably or non-removably supported by the base member 1552. The base member 1552 can be formed from one or more frame members 1556, each comprising a first frame member 1558 and a second frame member 1560. The base member 1552 can be removably or non-removably attached to or supported by a horizontal, vertical, or other supporting surface such as, but not limited to, a floor or ground surface (denoted by F in FIG. 66), a wall (denoted by W in FIG. 66), a door, or other suitable structure using bolts, screws, clamps, or any other suitable fastening mechanism. In some embodiments, the base member 1552 can be configured to be free standing.

The base member 1552 can have one or more base portions 1566, each being bolted, welded, or otherwise attached to or supported by the frame members 1556 at a different location and/or angular orientation as compared to one another. Each of the one or more base portions 1566 can comprise one or more openings 1570. Each of the one or more openings 1570 can define a removable or non-removable support for a resilient member 1554. The openings 1570 can be formed at any of a wide ranging variety of locations and, in some embodiments, angular orientations, on each base portion 1566. Thus, by varying the opening 1570 that defines the removable support for the resilient member 1554, a user can adjust the location and/or angular orientation of the resilient member 1554 (which can be defined by the longitudinal axis of the resilient member) relative to the base 1552 or the user.

Each of the resilient members 1554 can define one or more stiffening members 1574 and an insert member 1576. The insert members 1576 can each define a support portion 1578, which can be configured to receive and provide cantilever support to one or more stiffening members 1574, and an insertion portion (not illustrated), which can be configured to be received by some or all of the openings 1570 formed in the base member 1552. The geometry of the insertion portion (not illustrated) can be configured to approximately match the geometry of one or more of the openings 1570 formed in the base member 1552. In some embodiments, the shape and size of each of the openings 1570, which can be cylindrical, conical, or otherwise, can be approximately the same or similar from one opening 1570 to the next. The size and geometry of the insertion portion (not illustrated) of the insert member 1576 can be independent of the size and geometry of the support portion 1578 of each insert member such that each insert member can be configured to support one or more of a wide range of sizes and shapes of stiffening members 1574 without affecting the size and shape of the insert portion of the insert member 1576. In this configuration, a wide range of shapes and sizes of stiffening members 1574 can be supported by a uniformly shaped set of the openings 1570.

Figure 67:
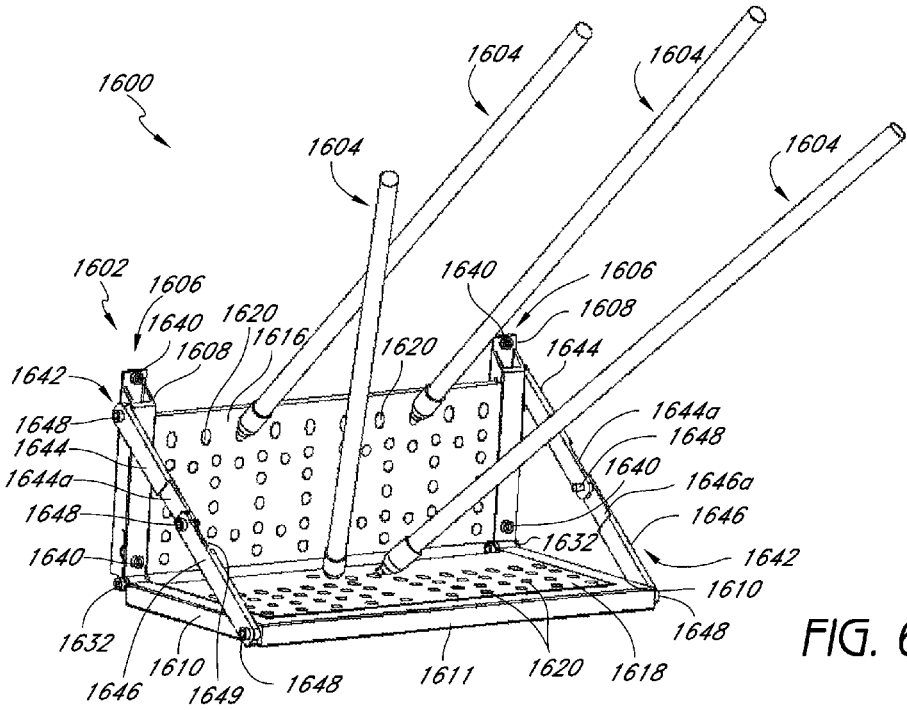
FIG. 67 is a perspective view of another embodiment of an exercise device.
Figure 68:
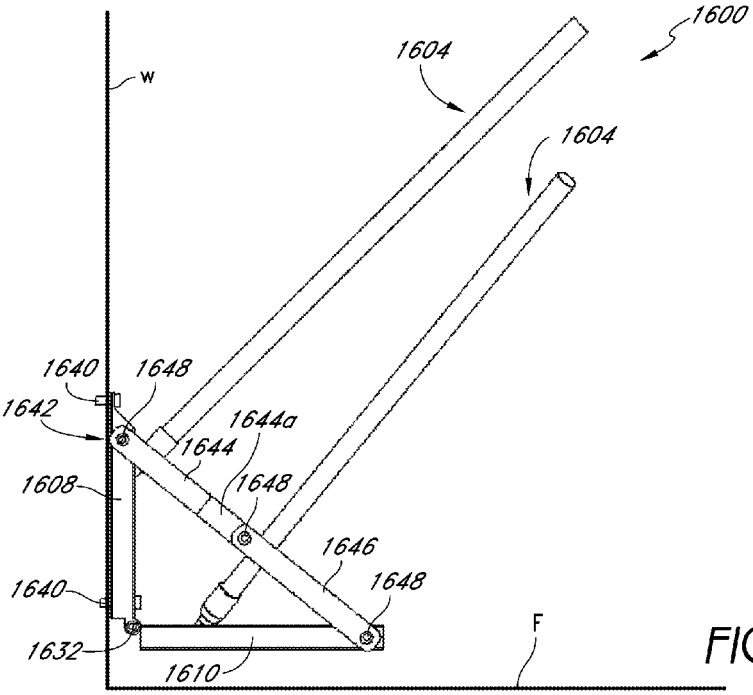
FIG. 68 is a side view of the embodiment of the exercise device shown in FIG. 67.

FIGS. 67 and 68 are a perspective view and a side view, respectively, of another embodiment of an exercise device 1600. In some embodiments, one or more of the components of the exercise device 1600 can have the same or similar features, materials, geometries, or other details or configurations as any of the other components (similar or otherwise) of the other embodiments described herein. The exercise device 1600 can define a base member 1602 and one or more resilient members 1604 removably or non-removably supported by the base member 1602. The base member 1602 can be formed from one or more frame members 1606, each comprising a first frame member 1608 and a second frame member 1610. The base member 1602 can be removably or non-removably attached to or supported by a horizontal, vertical, or other supporting surface such as, but not limited to, a floor or ground surface (denoted by F in FIG. 68), a wall (denoted by W in FIG. 68), a door, or other suitable structure using bolts, screws, clamps, or any other suitable fastening mechanism. In some embodiments, the base member 1602 can be configured to be free standing.

The base member 1602 can have one or more base portions 1616, each being bolted, welded, or otherwise attached to or supported by the frame members 1606. Each of the one or more base portions 1616 can comprise one or more openings 1620. Each of the one or more openings 1620 can define a removable or non-removable support for a resilient member 1604. The openings 1620 can be formed at any of a wide ranging variety of locations and/or angular orientations on each base portion 1616. Thus, by varying the opening 1620 that defines the removable support for the resilient member 1604, a user can adjust the location and/or angular orientation of the resilient member 1604 (which can be defined by the longitudinal axis of the resilient member) relative to the base 1602 or the user.

Each of the resilient members 1604 can define one or more stiffening members and an insert member. The insert members can be configured to be received by some or all of the openings 1620 formed in the base member 1602. The geometry of the insertion portion of each insert member can be configured to approximately match the geometry of one or more of the openings 1620 formed in the base member 1602. In some embodiments, the shape and size of each of the openings 1620, which can be cylindrical, conical, or otherwise, can be approximately the same or similar from one opening 1620 to the next. The size and geometry of the insertion portion of the insert member can be independent of the size and geometry of the support portion of each insert member such that each insert member can be configured to support one or more of a wide range of sizes and shapes of stiffening members without affecting the size and shape of the insert portion of the insert member. In this configuration, a wide range of shapes and sizes of stiffening members can be supported by a uniformly shaped set of the openings 1620.

Each of the frame members 1606 can further comprise a hinge 1632 between the first frame member 1608 and a second frame member 1610 that can be configured to permit the second frame member 1610 to rotate relative to the first frame member 1608. The hinge configuration can permit the base member 1602 to be folded or collapsed during periods of nonuse, so that the exercise device 1600 can occupy a smaller volume of space so as to be more easily stored. Hinged members 1644 and 1646 can be rotationally supported by the first and second frame members 1608, 1610, respectively, to limit the range of rotation of the second frame member 1610 relative to the first frame member 1608, and can provide additional structural support to the base member 1602. The hinged members 1644 and 1646 can be attached to the first and second frame members 1608, 1610 using fasteners 1648. The recessed portions **1644*a* and 1648*a* of the first and second frame members 1608, 1610, respectively, can be configured to permit the hinged members fold up nearly completely so that the second frame member 1610 can lie approximately adjacent to the first frame member 1608 in the stowed configuration. Fasteners 1640 can be used to fix the first frame member 1608 two and 180** desired or suitable support structure.

Figure 69:
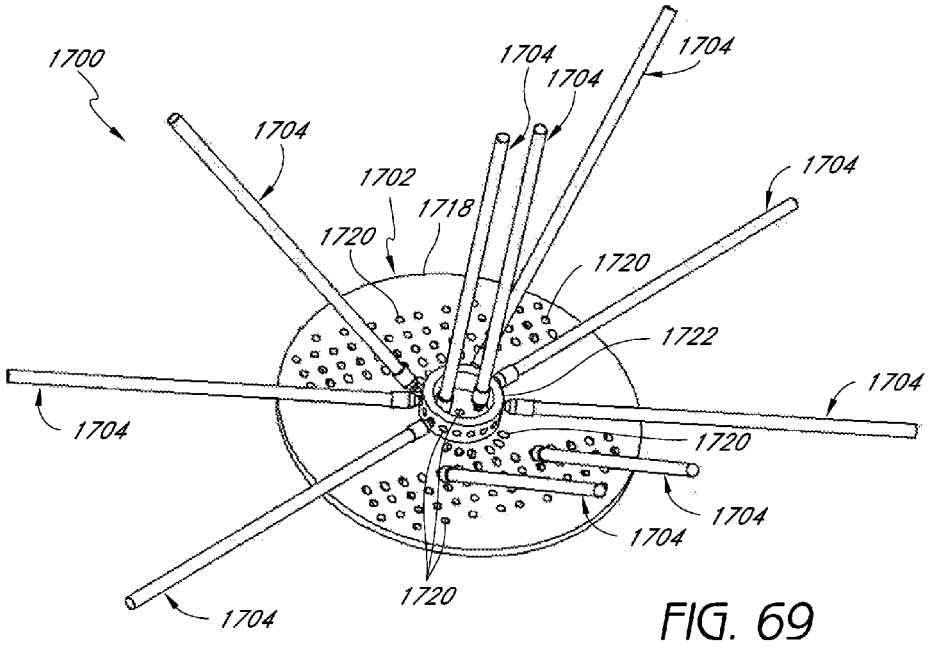
FIG. 69 is a perspective view of another embodiment of an exercise device.
Figure 70:
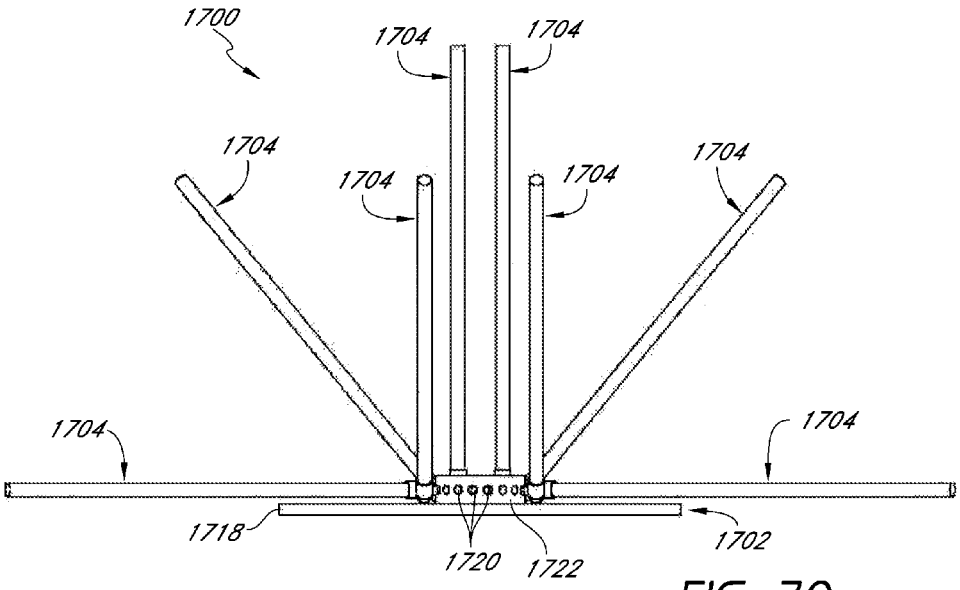
FIG. 70 is a side view of the embodiment of the exercise device shown in FIG. 69.

FIGS. 69 and 70 are a perspective view and a side view, respectively, of another embodiment of an exercise device 1700. In some embodiments, one or more of the components of the exercise device 1700 can have the same or similar features, materials, geometries, or other details or configurations as any of the other components (similar or otherwise) of the other embodiments described herein. The exercise device 1700 can define a base member 1702 and one or more resilient members 1704 removably or non-removably supported by the base member 1702. In some embodiments, the base member 1702 can be removably or non-removably attached to or supported by a horizontal, vertical, or other supporting surface such as, but not limited to, a floor or ground surface (denoted by F in FIG. 70), a wall (denoted by W in FIG. 70), a door, or other suitable structure using bolts, screws, clamps, or any other suitable fastening mechanism. In some embodiments, the base member 1702 can be configured to be free standing.

The base member 1702 can have one or more first base portions 1718, each of which can comprise one or more openings 1720, and a second base portion 1722, which can also comprise one or more openings 1720. Each of the one first base portions 1718 can define any circular (as illustrated), square, rectangular, polygonal, or other suitable or desired shape. The second base member 1722 can have a circular, annular, square, rectangular, polygonal, or other desired or suitable cross-sectional shape. The exercise device 1700 can be configured to permit multiple users to use the exercise device 1700 simultaneously.

Each of the one or more openings 1720 can define a removable or non-removable support for a resilient member 1704. The openings 1720 can be formed at any of a wide ranging variety of locations and/or angular orientations on the first base portion 1718. Thus, by varying the opening 1720 that defines the removable support for the resilient member 1704, a user can adjust the location and/or angular orientation of the resilient member 1704 (which can be defined by the longitudinal axis of the resilient member) relative to the base 1702 or the user.

Each of the resilient members 1704 can define one or more stiffening members and an insert member. The insert members can be configured to be received by some or all of the openings 1720 formed in the base member 1702. The geometry of the insertion portion of each insert member can be configured to approximately match the geometry of one or more of the openings 1720 formed in the base member 1702. In some embodiments, the shape and size of each of the openings 1720, which can be cylindrical, conical, or otherwise, can be approximately the same or similar from one opening 1720 to the next. The size and geometry of the insertion portion of the insert member can be independent of the size and geometry of the support portion of each insert member such that each insert member can be configured to support one or more of a wide range of sizes and shapes of stiffening members without affecting the size and shape of the insert portion of the insert member. In this configuration, a wide range of shapes and sizes of stiffening members can be supported by a uniformly shaped set of the openings 1720.

Figure 72:
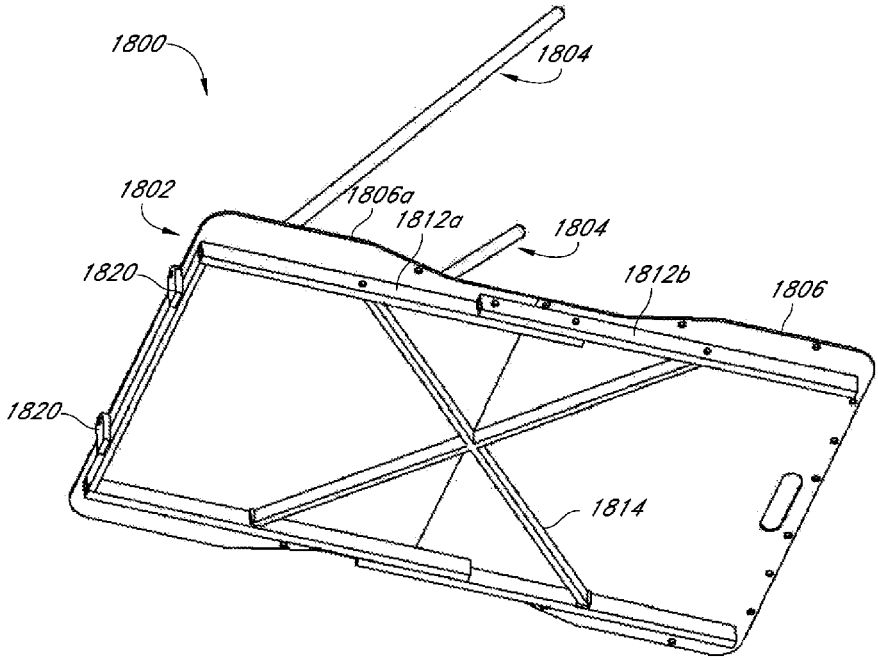
FIG. 72 is a perspective view of the bottom portion of the embodiment of an exercise device shown in FIG. 71.
Figure 71:
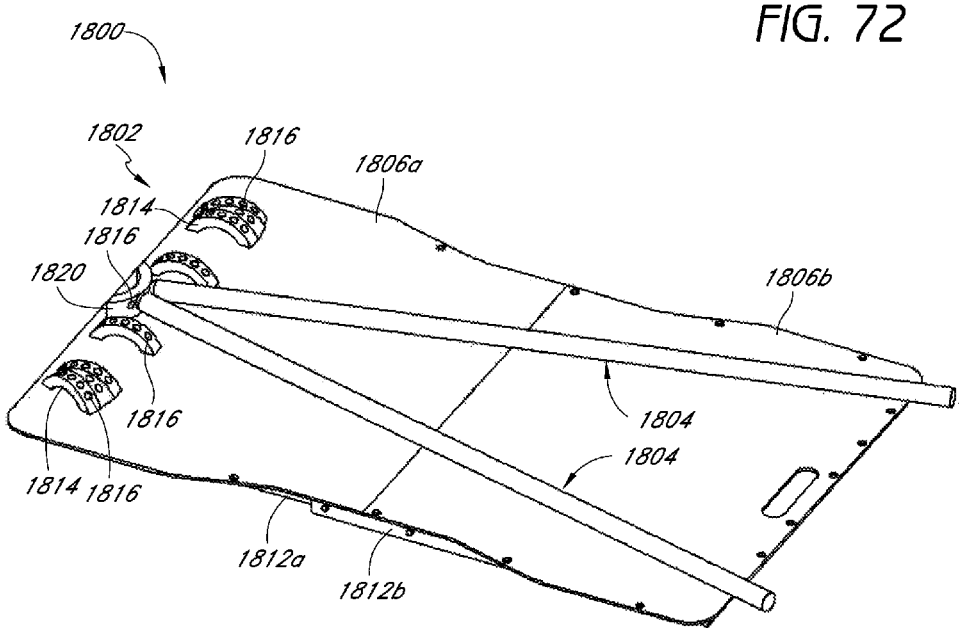
FIG. 71 is a perspective view of the top portion of another embodiment of an exercise device.

FIGS. 71 and 72 are perspective views of the top and bottom portions, respectively, of another embodiment of an exercise device 1800. In some embodiments, one or more of the components of the exercise device 1800 can have the same or similar features, materials, geometries, or other details or configurations as any of the other components (similar or otherwise) of the other embodiments described herein. In some embodiments, the exercise device 1800 can comprise a base member 1802 and one or more resilient members 1804. In some embodiments, the base member 1802 can comprise first and second base portions 1806*a*, 1806*b*, respectively.

In the illustrated embodiment, and in any embodiment described herein, the base 1802 (or any base described herein) can be configured to be free standing on a generally flat, horizontal surface so as to provide a supporting surface for a user of the exercise device in a standing, sitting, kneeling, or any other desired position. However, the exercise device 1800 is not so limited. In some embodiments, the base 1802 or any portion thereof can be attached to and, hence, supported by a horizontal, vertical or inclined surface, or can be configured to be free standing in a vertical or any angular orientation.

The base member 1802 can have a supporting frame 1812. Any components comprising the base member 1802 or supporting frame 1812, or any other base member or supporting frame disclosed herein, can be formed from steel, aluminum, plastic, fiberglass, and/or any other suitable material, composite material, or combination thereof. Additionally, in some embodiments, generally arcuately shaped base connection members 1814 can be supported by the base member 1802. In some embodiments (not illustrated), the base connection member 1814 can be generally spherically shaped. The base connection members 1814 can be fixed to the base member 1802, or can be supported by the base member 1802 in a manner that permits the base connection members 1814 to be rotationally adjustable relative to the base member 1802. In some embodiments, a plurality of base connection members 1814 can be supported by the base member 1802, each being mounted at a different location and/or angular orientation relative to the base member 1802.

The base connection members 1814 can define one or more connection interfaces 1816 that are configured to support one or more resilient members 1804. In the embodiment illustrated in FIGS. 71-72, the connection interfaces 1816 can be cylindrically shaped openings formed at various locations on the base connection members 1814, defining various angular orientations relative to the base 1802 such that the angular orientation of the longitudinal axis of the resilient member 1804 relative to the base 1802 can be adjusted by changing the connection interface 1816 that defines the support for the resilient member 1804.

Additionally, the base connection members 1814 can be bolted, welded, or otherwise attached or mounted to the base member 1802 in a wide range of angular orientations to further increase the range of the angular orientations of the connection interfaces 1816, each of which can define a removable or non-removable support for a resilient member 1804.

The first and second base portions 1806*a*, 1806*b* can be assembled together by fastening the overlapping portions of the frame 1812*a* with the overlapping portions of the frame 1812*b*. Configuring the base member 1802 to comprise to removably attachable base portions 1806*a*, 1806*b* can permit the base member 1802 to break down to a smaller size during periods of nonuse of the exercise device 1800. An additional cross-brace 1814 can be bolted or otherwise removably attached to the first and second base portions 1806*a*, 1806*b* to provide additional stiffness and support to the base member 1802. One or more horizontal base connection members 1820 can also be supported by the base member 1802 to provide additional connection interfaces 1816 to support the one or more resilient members 1804.

Figure 73:
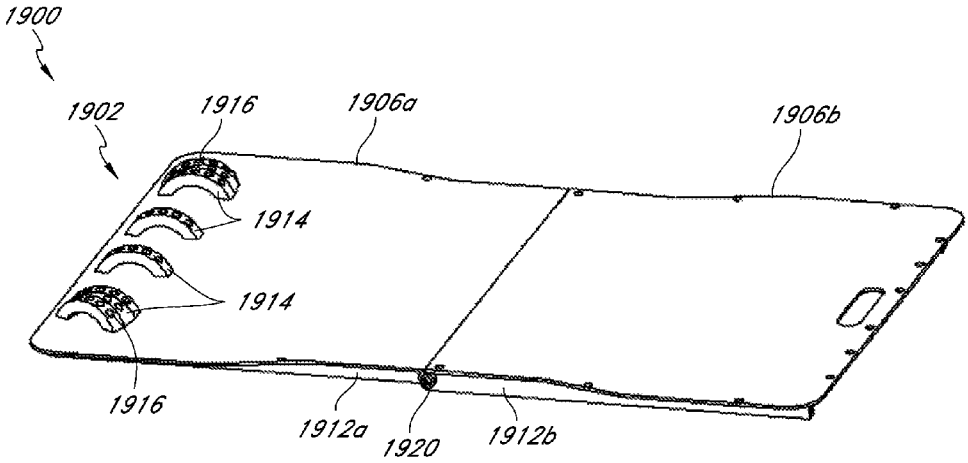
FIG. 73 is a perspective view of another embodiment of an exercise device, showing the exercise device in an operational position.
Figure 74:
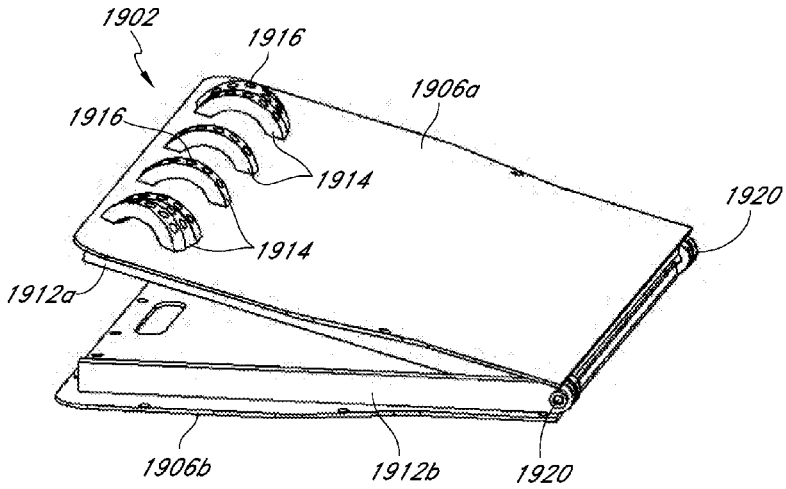
FIG. 74 is a perspective view of the embodiment of the exercise device shown in FIG. 73, showing the exercise device in a partially collapsed or folded position.

FIG. 73 is a perspective view of another embodiment of an exercise device, showing the exercise device in an operational position. FIG. 74 is a perspective view of the embodiment of the exercise device shown in FIG. 73, showing the exercise device in a partially collapsed or folded position. In some embodiments, one or more of the components of the exercise device 1900 can have the same or similar features, materials, geometries, or other details or configurations as any of the other components (similar or otherwise) of the other embodiments described herein. In some embodiments, the exercise device 1900 can comprise a base member 1902 and one or more resilient members (not illustrated). In some embodiments, the base member 1902 can comprise first and second base portions 1906*a*, 1906*b*, respectively.

In the illustrated embodiment, and in any embodiment described herein, the base 1902 (or any base described herein) can be configured to be free standing on a generally flat, horizontal surface so as to provide a supporting surface for a user of the exercise device in a standing, sitting, kneeling, or any other desired position. However, the exercise device 1900 is not so limited. In some embodiments, the base 1902 or any portion thereof can be attached to and, hence, supported by a horizontal, vertical or inclined surface, or can be configured to be free standing in a vertical or any angular orientation.

The base member 1902 can have a supporting frame 1912. Any components comprising the base member 1902 or supporting frame 1912, or any other base member or supporting frame disclosed herein, can be formed from steel, aluminum, plastic, fiberglass, and/or any other suitable material, composite material, or combination thereof. Additionally, in some embodiments, generally arcuately shaped base connection members 1914 can be supported by the base member 1902. In some embodiments (not illustrated), the base connection member 1914 can be generally spherically shaped. The base connection members 1914 can be fixed to the base member 1902, or can be supported by the base member 1902 in a manner that permits the base connection members 1914 to be rotationally adjustable relative to the base member 1902. In some embodiments, a plurality of base connection members 1914 can be supported by the base member 1902, each being mounted at a different location and/or angular orientation relative to the base member 1902.

The base connection members 1914 can define one or more connection interfaces 1916 that are configured to support one or more resilient members (not illustrated). In the embodiment illustrated in FIGS. 73-74, the connection interfaces 1916 can be cylindrically shaped openings formed at various locations on the base connection members 1914, defining various angular orientations relative to the base 1902 such that the angular orientation of the longitudinal axis of the resilient member 1904 relative to the base 1902 can be adjusted by changing the connection interface 1916 that defines the support for the resilient member 1904.

Additionally, the base connection members 1914 can be bolted, welded, or otherwise attached or mounted to the base member 1902 in a wide range of angular orientations to further increase the range of the angular orientations of the connection interfaces 1916, each of which can define a removable or non-removable support for a resilient member 1904. The first and second base portions 1906*a*, 1906*b* can be joined together by a rotatable hinge 1920 that permits the base 1902 to be collapsed to a stowed position. FIG. 74 illustrates the base member 1902 in a partially stowed position for clarity. The base member 1902 can be configured to be fully collapsed to break down to a smaller size during periods of nonuse of the exercise device 1900. An additional cross-brace (not illustrated) can be bolted or otherwise removably attached to the first and second base portions 1906*a*, 1906*b* to provide additional stiffness and support to the base member 1902.

Other sizes, shapes, and configurations of the base, resilient members, base interface members, connection interfaces, or any other components or combination of components described herein or known in the art or to one of ordinary skill in the art can be used with the exercise device of this disclosure. For example, the components and assemblies described in U.S. Patent Application Publication No. US 2007/0072752, published Mar. 29, 2006, can be used to practice the exercise device of this disclosure. The entirety of U.S. Patent Application Publication No. US 2007/0072752, is expressly incorporated by reference herein and made a part of the present specification as if fully set forth herein.

Although the embodiments in this disclosure have been disclosed in the context of a certain preferred embodiments and examples, it will be understood by those skilled in the art that the embodiments of the present disclosure extend beyond the specifically disclosed embodiments to other alternative embodiments and/or uses of the embodiments of the present disclosure and obvious modifications and equivalents thereof. In addition, while a number of variations of the embodiments of the present disclosure have been shown and described in detail, other modifications, which are within the scope of the embodiments of the present disclosure, will be readily apparent to those of skill in the art based upon this disclosure. It is also contemplated that various combinations or subcombinations of the specific features and aspects of the embodiments may be made and still fall within the scope of the embodiments of the present disclosure. Accordingly, it should be understood that various features and aspects of the disclosed embodiments can be combined with or substituted for one another in order to form varying modes of the disclosed embodiments of the present disclosure. Thus, it is intended that the scope of this disclosure herein disclosed should not be limited by the particular disclosed embodiments described above.

What is claimed is:

1. A resistance device for exercise comprising:

a support member positioned at a first end portion of the resistance device, the support member having a first end portion and a second end portion;

a first resilient member having a first end portion and a second end portion and at least one opening longitudinally oriented through at least a portion of the first resilient member; and a second resilient member positioned within the at least one opening;

wherein:

the first end portion of the first resilient member is configured to be attached to the support member such that the support member overlaps and surrounds the first end portion of the first resilient member;

the first resilient member is supported in a cantilevered disposition by the support member;

the resistance device is configured such that the first end portion of the resistance device is supportable in a cantilevered disposition and the second end portion is radially unrestrained; and the resistance device is configured to provide a resistance force when a user exerts a force on at least the second end portion of the resistance device that causes the resistance device to bend.

2. The resistance device of claim 1, further comprising a third resilient member positionable within the at least one opening in the first resilient member, the third resilient member being configured to increase the resistance of the resistance device when the resistance device is bent by a user.

3. The resistance device of claim 1, further comprising a fourth resilient member positionable within the at least one opening in the first resilient member, the fourth resilient member being configured to increase the resistance of the resistance device when the resistance device is bent by a user.

4. The resistance device of claim 1, wherein the first resilient member comprises a plurality of openings and the resistance device comprises a plurality of resilient members that are each positionable within the plurality openings, the plurality of resilient members being configured to increase the resistance of the resistance device when the resistance device is bent by a user.

5. The resistance device of claim 1, wherein the resistance device is substantially rigid in an axial direction.

6. The resistance device of claim 1, wherein the support member is configured such that the first end portion thereof is supportable in a cantilevered disposition by a connection interface of an exercise base member.

7. A resistance device for fitness related exercise comprising:

a support member positioned at a first portion of the resistance device;

a first stiffening member; and a second stiffening member;

wherein:

the support member is configured to be removably supported by a base member in a cantilevered disposition so that the first portion of the resistance device is substantially prevented from pivoting relative to the exercise device base member;

the support member supports an end portion of the first stiffening member such that the first stiffening member extends from the support member in a cantilevered disposition;

the support member supports an end portion of the second stiffening member such that the second stiffening member extends from the support member in a cantilevered disposition;

the second stiffening member is positioned in an opening formed through the first stiffening member; and the first and second stiffening members are positioned so as to be substantially parallel when the resistance device is in a relaxed state.

8. The resistance device of claim 7, wherein at least one of the first stiffening member and the second stiffening member is removably supported by the support member.

9. The resistance device of claim 7, wherein at least a portion of the second stiffening member is free to translate relative to the first stiffening member.

10. The resistance device of claim 7, wherein the support member comprises a plurality of parallel openings through at least a portion of the support member, and wherein each the plurality of openings is configured to support an end portion of a stiffening member.

11. The resistance device of claim 7, further comprising a handle grip removably or non-removably secured thereto.

12. The resistance device of claim 7, wherein at least the first stiffening member comprises fiberglass.

13. The resistance device of claim 7, wherein at least the first stiffening member comprises plastic.

14. The resistance device of claim 7, further comprising a second support member that is spaced apart from the support member and configured to at least radially support at least a second portion of at least the first stiffening member.

15. The resistance device of claim 14, wherein at least a portion of the second support member is free to rotate.

16. The resistance device of claim 14, wherein the second support member provides a gripping surface for a user.

17. The resistance device of claim 7, further comprising a second support member that is spaced apart from the support member and configured to at least radially support at least a second portion of at least the first stiffening member such that, when a user exerts a force on the second support member, at least the second portion of at least the first stiffening member deflects from the longitudinal axis of the relaxed position of the first stiffening member and a resistance is provided.

18. A resistance device for fitness related exercise, comprising:

a first member that is substantially rigid; and a second member that is resilient about at least a substantial portion of its length, the second member comprising a first end and a second end, wherein;

the first member of the resistance device is configured to be removably supported by an opening in an exercise device base member in a cantilevered disposition so that, in use, a first end portion of the resistance device is prevented from pivoting relative to the exercise device base member and such that a second end portion of the resistance device is radially unrestrained;

the first member is positioned generally at the first end portion of the resistance device;

the first member is configured to support at least the first end of the second member such that the second member is non-removably attached to the first member and such that the second member extends from the first member in a cantilevered disposition wherein the first end of the second member is prevented from pivoting relative to the first member; and the resistance device is configured to produce a resistance force when a user exerts a force on the resistance device so as to deflect at least the second end of the second member away from the relaxed position of the longitudinal axis of the second member.

19. The resistance device of claim 18, further comprising a third member that is resilient about at least a substantial portion of its length, the third member comprising a first end and a second end, the first member being configured to support at least the first end of the third member such that the third member extends from the first member in a cantilevered disposition wherein the first end of the third member is prevented from pivoting relative to the first member.

20. The resistance device of claim 19, wherein the second member comprises at least one axially aligned opening through at least a portion of the second member, and the at least one axially aligned opening is configured to at least receive the third member.

21. The resistance device of claim 20, wherein the resistance device is configured such that the third member is removably positionable within the at least one axially aligned opening.

22. The resistance device of claim 19, further comprising a fourth member that is resilient about at least a substantial portion of its length, the fourth member comprising a first end and a second end, the first member being configured to support at least the first end of the fourth member such that the fourth member extends from the first member in a cantilevered disposition wherein the first end of the fourth member is prevented from pivoting relative to the first member.

23. The resistance device of claim 22, wherein the second member comprises at least one axially aligned opening through at least a portion of the second member, and the at least one axially aligned opening is configured to at least receive the third member and the fourth member.

24. The resistance device of claim 23, wherein the resistance device is configured such that at least one of the third member and the fourth member is removably positionable within the at least one axially aligned opening.

25. The device of claim 18, wherein a portion of the resistance device is configured such that an alternative gripping member can be supported thereby, the alternative gripping member being configured to at least allow the user to vary the orientation of his or her hand relative to the resistance device.

26. The device of claim 18, wherein the first member comprises an axial opening through a portion of the first member, the resistance device being configured such that the first end of the second member is supported within the opening.

27. The device of claim 18, wherein the first member comprises a plurality of openings configured to support the first end of the second member and end portions of other bendable resilient members.

28. The device of claim 18, wherein the second member has a non-helical shape.

29. The device of claim 18, wherein the second member has a cylindrical shape.

30. A method of exercising the muscles of one's body, comprising:

supporting a support member of a resistance device in a cantilevered disposition in a first position in a base member, the resistance device comprising:

a stiffening member;

a support member positioned at a first portion of the resistance device and configured to be supported in a cantilevered disposition so that the first portion of the resistance device is substantially prevented from pivoting, the support member further configured to support a first portion of the stiffening member such that the stiffening member extends therefrom in a cantilevered disposition; and exerting a force on a radially unrestrained portion of the resistance device so as to deflect at least a portion of the resistance device and effect an exercising of one or more muscles in the user's body;

increasing the resistance force provided by the resistance device by supporting at least one additional stiffening member with the support member, wherein each of the at least one additional stiffening members supported by the support member is supported such that at least a first portion of the at least one additional stiffening member extends from the support member in a cantilevered disposition; and removing the resistance device from the first position and supporting the resistance device in a second position in the base member.

* * * * *